US005519482A

United States Patent [19]

Johdai et al.

[11] Patent Number: 5,519,482

[45] Date of Patent: May 21, 1996

[54] SHEET FEEDING APPARATUS AND AUTOMATIC DOCUMENT FEEDER

[75] Inventors: Akiyoshi Johdai; Hirokazu Matsuo; Akira Ohhata, all of Toyohashi, Japan

[73] Assignee: Minolta Camera Kabushiki Kaisha, Osaka, Japan

[21] Appl. No.: 427,659

[22] Filed: Apr. 21, 1995

Related U.S. Application Data

[63] Continuation of Ser. No. 75,397, Jun. 9, 1993, abandoned.

[30] Foreign Application Priority Data

| | | | |
|---|---|---|---|
| Jun. 15, 1992 | [JP] | Japan | 4-154564 |
| Jun. 15, 1992 | [JP] | Japan | 4-154565 |
| Jun. 15, 1992 | [JP] | Japan | 4-154566 |
| Jun. 15, 1992 | [JP] | Japan | 4-154567 |
| Jun. 15, 1992 | [JP] | Japan | 4-155007 |
| Jun. 15, 1992 | [JP] | Japan | 4-155008 |
| Jun. 16, 1992 | [JP] | Japan | 4-156527 |
| Jun. 16, 1992 | [JP] | Japan | 4-156528 |
| Jun. 16, 1992 | [JP] | Japan | 4-156529 |

[51] Int. Cl.[6] ..... G03G 21/00

[52] U.S. Cl. ..... 355/309; 271/270; 355/318

[58] Field of Search ..... 355/309, 313, 355/316, 317, 318, 320, 321, 24, 25, 208; 271/270, 202, 203

[56] References Cited

U.S. PATENT DOCUMENTS

| | | | |
|---|---|---|---|
| 4,000,943 | 1/1977 | Bar-on | 355/313 |
| 4,526,461 | 7/1985 | Eertink | 355/317 |
| 4,579,327 | 4/1986 | Furuichi | 271/270 X |
| 4,634,263 | 1/1987 | Miwa | 355/309 |
| 4,860,057 | 8/1989 | Saeki et al. | 355/23 |
| 4,937,634 | 6/1990 | Hirabayashi et al. | 355/309 |
| 5,005,055 | 4/1991 | Matsuo et al. | 355/311 |
| 5,018,716 | 5/1991 | Yoshida et al. | 271/270 X |
| 5,205,548 | 9/1990 | Yamada et al. | 271/270 X |
| 5,257,064 | 10/1993 | Okamoto | 355/24 |

FOREIGN PATENT DOCUMENTS

| | | |
|---|---|---|
| 60-140364 | 7/1985 | Japan . |
| 0187142 | 7/1989 | Japan . |

*Primary Examiner*—Robert Beatty
*Attorney, Agent, or Firm*—Burns, Doane, Swecker & Mathis

[57] ABSTRACT

An automatic document feeder (ADF) for feeding a document across a platen is attachable to different types of copying machines which have different copying speeds. The ADF has a detector for detecting the copying speed of the copy machine and a controller for adjusting the document feeding speed of the ADF to the copying speed of the copy machine. The controller also controls the feeding speed of the document at a standard speed in a condition which does not lower copying efficiency and at a higher speed in a condition which lowers copying efficiency. A condition which does not lower copying efficiency is feeding documents other than the last document from the platen. A condition which lowers copying efficiency is feeding the first document to the platen and ejection of the last document from the platen.

7 Claims, 72 Drawing Sheets

FORWARD ROTATION
SE11
SE12
x
y
f
63
64
65
66
70
71
72
73
75
76
140
141
142
143
145
146
147
148
148a
148b
149
149a
149b

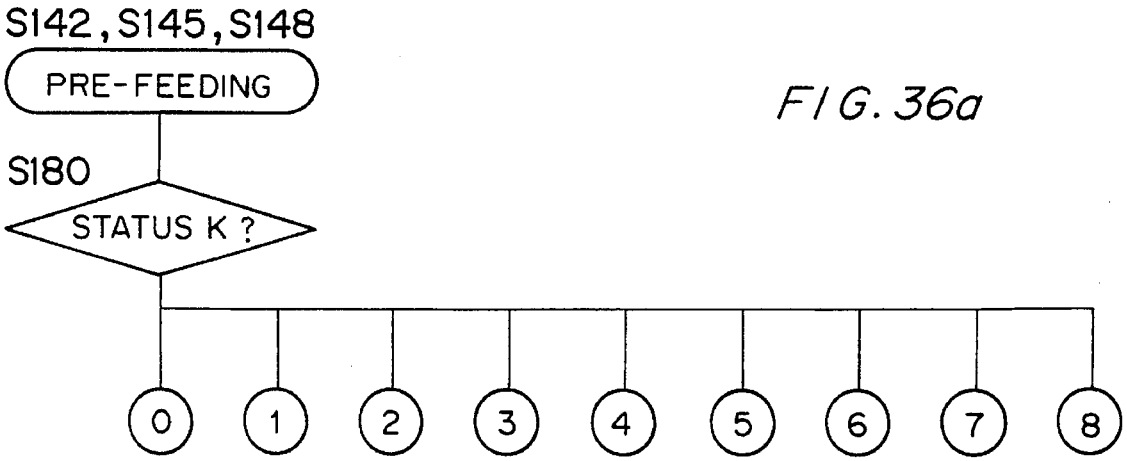
FIG. 36a
FIG. 36b
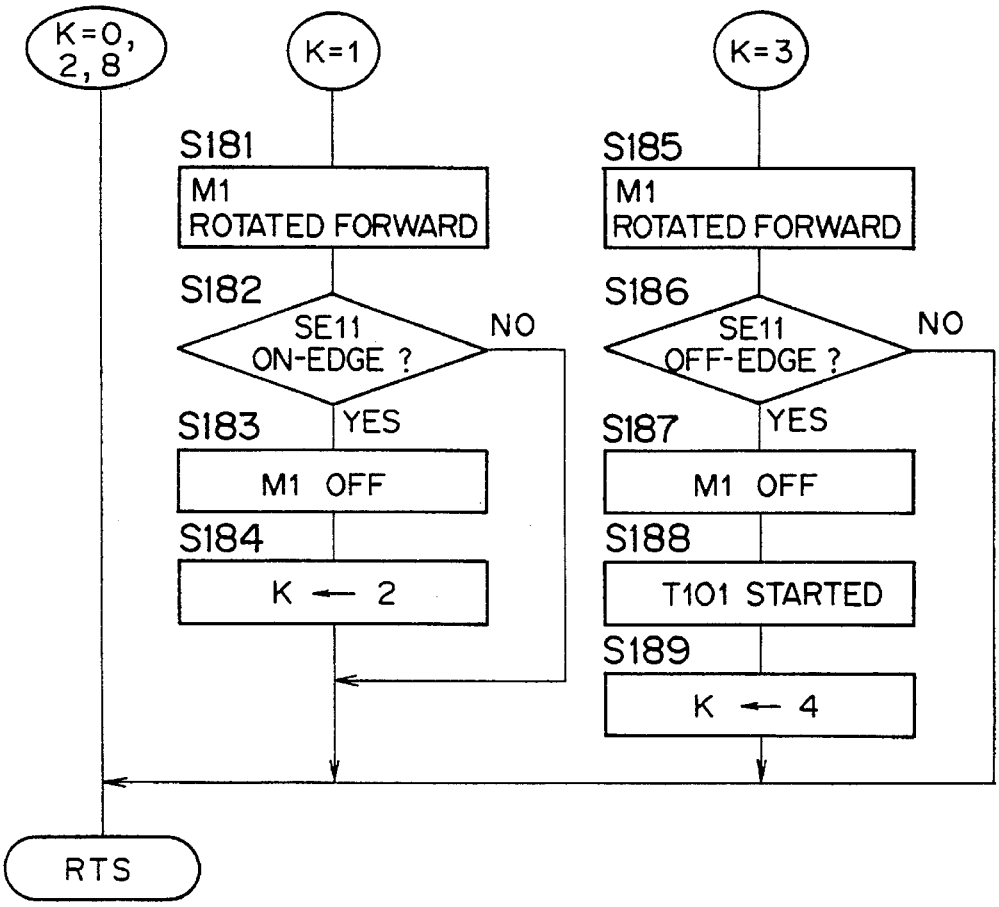

S=0,4
S=1

S321
HIGH-SPEED FORWARD ROTATION 1
S322
SE2 OFF-EDGE ?
NO
YES
S323
SIZE DETECTION
S324
SE1 ON ?
NO
YES
S328
HERASE ← 1
S325
T202 STARTED
S326
M3 DECREASE SPEED
S327
S ← 2
S333
PLSCNT 1 =P05 ?
NO
YES
S334
LSIZE ← 1
S329
DCNT3 = 2 ?
NO
YES
S330
M3 DECREASE SPEED
S331
S ← 8
S332
S ← 5
RTS

S=5
S344
HIGH-SPEED FORWARD ROTATION 2
S345
PLSCNT1 = P03 ?
NO
YES
C
S346
M3 DECREASE SPEED
S347
SCALE SETTING
S348
SE2 OFF ?
NO
YES
S349
SE1 ON ?
NO
YES
S350
K ← 3
S352
K ← 1
S353
LSIZE = 1 ?
NO
YES
S354
HERASE ← 1
S355
PRE-FEEDING INHIBITION FLAG ← 1
S356
DCNT1 INCREMENT
S357
JAM TREATMENT
S351
S ← 6
RTS

SHEET FEEDING APPARATUS AND AUTOMATIC DOCUMENT FEEDER

This application is a continuation of application Ser. No. 08/075,397, filed Jun. 9, 1993 now abandoned.

BACKGROUND OF THE INVENTION

1. Field of the Invention

The present invention relates to a sheet feeding apparatus, and more particularly to a sheet feeding apparatus for feeding a document from a tray onto a platen glass of a copying machine, stopping the document in a specified position on the platen glass and ejecting the document from the platen glass.

2. Description of Related Art

An automatic document feeder attached to an electrophotographic copying machine generally has a pre-feed section which comprises a pick-up roller (or belt) for applying a frictional force to a document to feed the document, a pressing plate for pressing the leading portion of a stack of documents against the feed roller and a leading edge regulation plate for regulating leading edges of documents to align the documents on a tray. Conventionally, the pressing plate is so made that it retreats from its pressing position each time a document has been fed out of the tray. This is for the following reasons. The fed-out document is once stopped and then fed onto a platen glass by a register roller pair. If the pressing plate keeps pressing the stack of documents, when the register roller pair draws and further feeds the document, resistance will be large, whereby the document will be stopped in a wrong position and/or load torque will be large. Also, if the pressing plate keeps pressing the stack of documents, immediately after the trailing edge of a document passes through a separating member, a next document will be fed out of the tray, that is, double-feeding will occur, which may cause size misdetection and sheet jamming. On the other hand, the leading edge regulation plate retreats from a regulating position to a retreating position at the start of feeding of the stack of documents and keeps in the retreating position until the last document is fed out of the tray. If the leading edge regulation plate reciprocates between the regulating position and the retreating position repeatedly during the feeding of the stack, the leading edges of the documents may be damaged, and/or the documents may be fed askew.

Conventionally, the pressing plate and the leading edge regulation plate have separate driving sources (e.g. solenoids). However, providing the separate driving sources is disadvantageous in attaining a space-saving structure. If solenoids, of which speeds of pulling the plungers out (the speed when the loads stop) are high, are used as the driving sources, noise is generated.

An automatic document feeder shall stop a document in a right position on a platen glass for scanning accurately. In a conventional type of automatic document feeder, a conveyer belt is driven by a pulse motor, and the document conveying amount is controlled by detecting the number of pulses. In this type, since clutches are provided in the driving system, the document positioning on the platen glass is not always accurate because of a delay in mechanical response.

An automatic document feeder shall be attachable to different kinds of copying machines. In order to maintain high copy productivity in a combination with any kind of copying machine, the automatic document feeder must have a document conveying speed corresponding to the copying speed of a highest-speed type copying machine. However, if the automatic document feeder has the same document conveying speed even when it is attached to a low-speed type copying machine, noise will be remarkable, and the lives of the components will be shortened.

Incidentally, as modes of stopping a document in a specified position (scanning position) on the platen glass, the following two modes have been adopted: a scale mode wherein a document stops when its leading edge comes into contact with a scale disposed at a scanning reference point; and a pulse control mode wherein the document conveying amount attained by the conveyer belt is detected (generally, the number of pulses driving the motor is detected) and driving of the conveyer belt is controlled accordingly.

The scale mode has an advantage that the document positioning is very accurate because the scale directly stops the document. However, if the document is thin, in the scale mode, trouble such as bending of the leading edge of the document and/or sheet jamming may occur. On the other hand, the pulse control mode has an advantage that even if the document is thin, the trouble will not occur. However, in the pulse control mode, the document positioning is not so accurate as in the scale mode because of slipping of the document and/or a response delay of the driving mechanism.

It is preferred that an automatic document feeder has a document conveying speed corresponding to the copying speed of the copying machine. More specifically, if a change of documents on the platen glass is completed within a time while the optical system of the copying machine is returning to its home position after scanning, the copy productivity can be maintained in 100%. Practically, however, actions of the automatic document feeder are not only for the document change but also for other purposes, and there are some actions which lower the copying efficiency of the copying machine.

In connection with a copying system composed of a copying machine and an automatic document feeder, recently, a two-in-one mode has been developed. In the two-in-one mode, two documents are set on the platen glass side by side and copied onto a single copy sheet. If this mode is further developed so as to make a set of copies of the same sheet size from a set of documents containing different sizes, for example, to copy two A4-sized documents onto a single A3-sized copy sheet and to copy a single A3-sized document onto an A3-sized copy sheet, it will be very advantageous. However, conventionally, if documents of different sizes are in a stack to be copied in the two-in-one mode, sheet jamming is judged in connection with a large size document, and the operation is discontinued. The copying machine also cannot respond to documents of different sizes fed in the two-in-one mode.

A count mode wherein the automatic document feeder feeds a stack of documents once before copying so as to count the documents has been developed. Since the operation in the count mode does not directly contribute to copying, preferably, the operation is finished as speedily as possible. In a type of automatic document feeder wherein each document is stopped on the platen glass with its leading edge positioned at a scanning reference point which is located in a downstream portion of the platen glass, the interval between documents is unnecessarily large for the count mode, and the conveyer belt idles unnecessarily. Accordingly, the counting in this type takes a time. Also in a type of automatic document feeder wherein a scanning reference point is located in an upstream of the platen glass, if the distance between the scanning reference point and the register roller pair is long, the interval between documents is unnecessarily large for the count mode, and the same problem will occur.

Additionally, a pre-step mode has been developed. In the pre-step mode, if documents to be fed are of a size smaller than a half of the platen glass, a first document and a second document are set in a scanning position where the leading edge of a document is positioned at a scanning reference point which is located in the downstream end of the platen glass and in a pre-step position where the leading edge of a document is positioned at an intermediate reference point which is located substantially in the center of the platen glass respectively, and further a third document is fed to an entrance of the platen glass. In the pre-step mode, compared with an ordinary feeding mode, only a half time is required for a change of documents, and this contributes to maintenance of a high copy productivity in a high-speed copying system. However, conventionally, if documents of different sizes are in a stack fed in the pre-step mode, sheet jamming is judged in connection with a large size document, and the operation is discontinued. The copying machine also cannot respond to the large size document fed in the pre-step mode.

In the two-in-one mode described above, two documents set on the platen glass are ejected from the platen glass onto an ejected-document tray with no space between the documents. In this state, the latter document may hit the former document, which causes page disorder on the ejected-document tray.

SUMMARY OF THE INVENTION

It is an object of the present invention to provide an automatic sheet feeder which has a simple driving system.

Another object of the present invention is to provide an automatic sheet feeder which does not generate noise.

A further object of the present invention is to provide an automatic document feeder which stops a document in a right position on a platen glass accurately.

Another object of the present invention is to provide an automatic document feeder which changes documents on a platen glass speedily.

Another object of the present invention is to provide an automatic document feeder which adjusts its document conveying speed to the copying speed of a copying machine to which the automatic document feeder is attached so as to maintain a high copy productivity.

Another object of the present invention is to provide an automatic document feeder which stops a document in the scale mode or the pulse control mode selectively and maintains a high copy productivity.

Another object of the present invention is to provide an automatic document feeder which avoids lowering the copying efficiency.

Another object of the present invention is to provide an automatic document feeder and a copying machine which can feed and copy documents in the two-in-one mode even if a large size document is present in a stack of documents.

Another object of the present invention is to provide an automatic document feeder which counts documents speedily so as not to lower the copying efficiency.

Another object of the present invention is to provide an automatic document feeder and a copying machine which can feed and copy documents in the pre-step mode even if a large size document is present in a stack of documents.

A further object of the present invention is to provide a sheet transporting apparatus which makes a space between two sheets being ejected continuously so as to prevent disorder of sheets on an ejected-sheet tray.

In order to attain the objects above, an automatic sheet feeder according to the present invention comprises: regulating means for regulating a leading edge, in respect to a document feeding direction, of a stack of sheets on a tray; pressing means for pressing the stack of documents against the feeding means; and driving means for moving the regulating means and the pressing means between their respective active (regulating or pressing) positions and retreating positions relatively to each other.

In other words, the regulating means and the pressing means are driven by the same driving means so as to move between the respective active positions and the retreating positions. Thus, since the regulating means and the pressing means have a common single driving system, a simple and compact structure can be achieved. Further, in the automatic sheet feeder, the driving means has a cam which is rotatable both forward and in reverse, and the regulating means and the pressing means move with forward or reverse rotation of the cam. It is possible to make the cam in a shape which contributes to lowering of the speed of stopping the load. Therefore, compared with using a solenoid, the motion is smooth, and noise is not generated.

This feature of the present invention is applicable to a pre-feed section of an automatic document feeder, a copy sheet feed section and a copy sheet refeed section of a copying machine or a printer.

An automatic document feeder according to the present invention comprises: a register roller for stopping a document fed out of a tray once and feeding the document onto a platen glass; driving means which is connected to the feeding means and the register roller with no clutches in-between; counting means for counting pulse signals indicating the number of rotations of the driving means; and control means for detecting a document feeding amount attained by the register roller and the feeding means from the value counted by the counting means from the moment when the register roller starts feeding the document.

A document fed out of a tray is once stopped by the register roller, whereby a possible skew of the document is corrected. Then, the driving means drives the register roller and the feeding means to feed the document to a specified position (scanning position) on the platen glass. The document feeding amount at that time is detected from the value counted by the counting means. Because the counting starts when the register roller starts feeding the document and because no clutches are provided between the driving means and the feeding means and between the driving means and the register roller, the accuracy of the document positioning on the platen glass is improved.

Further, in the automatic document feeder, a scanning reference point, where the leading edge of a document is to be positioned for scanning, is located in a downstream portion of the platen glass, and when the leading edge of a document comes to an intermediate reference point which is located substantially in the center of the platen glass, the document is once stopped and a next document is fed to the register roller. With this control system, if documents to be fed are of a size smaller than a half of the platen glass, serial feeding is possible. More specifically, a first document is set with its leading edge positioned at the scanning reference point, a second document is set with its leading edge positioned at the intermediate reference point, and a third document is set with its leading edge at the register roller. Then, for a change of documents, it is required to move the documents only by about a half of the distance between the register roller and the scanning reference point, and the change of documents is carried out speedily.

Another automatic document feeder according to the present invention comprises control means for adjusting its own document feeding speed to the copying speed of a copying machine to which the automatic document feeder is attached. Specifically, the control means receives a copying speed signal generated from control means of the copying machine and the adjustment of the document feeding speed is made in accordance with the signal. Alternatively, the control means has manual input means with which an operator can select one from several optional values as the document feeding speed. The manual input means is, for example, a dip switch. Also, the control means may have detecting means for detecting copying speed data in a contact portion with the copying machine. More specifically, the copying machine has a magnet indicating its copying speed, and the automatic document feeder has a sensor for detecting the magnet. The control means reads the copying speed from a signal sent from the sensor and adjusts the document feeding speed. The document feeding speed of the automatic document feeder is originally set at a value corresponding to the highest copying speed such that the copy productivity will not be lowered even if the automatic document feeder is attached to a high-speed copying machine, and when the automatic document feeder is attached to a copying machine which has a lower copying speed, the document feeding speed is automatically changed to a lower value.

Another automatic document feeder according to the present invention is operational in a first control mode wherein a scale member disposed on a scanning reference point which is located in a downstream portion of a platen glass protrudes over the platen glass so as to stop the leading edge of a document fed on the platen glass, in a second control mode wherein the scale member retreats from the platen glass, and feeding means is turned off in accordance with detection of a document feeding amount to stop a document with its leading edge positioned at the scanning reference point, and in a pre-step mode wherein two successive documents are fed simultaneously until the leading edge of the former document comes to the scanning reference point and the leading edge of the latter document comes to an intermediate reference point which is located substantially in the center of the platen glass. In the first control mode, the feeding means is driven to attain a larger document feeding amount than in the second control mode. Specifically, supposing that the distance between a point where the leading edge of a document is stopped before the document is fed onto the platen glass and the scanning reference point is L, in the first control mode, the feeding means is driven by an amount corresponding to a document feeding amount $L+\alpha$. However, practically, the document is fed by the amount L, and the feeding means idles by the amount $\alpha$. In a combination of the pre-step mode and the second control mode, the feeding means is driven by an amount of $L/2$ for its one-step action. In a combination of the pre-step mode and the first control mode, the feeding means is driven by an amount of $(L/2)+(\alpha/2)$ for its one-step action.

In the pre-step mode, a change of documents is carried out very speedily, and a high copy productivity is maintained. In a combination of the pre-step mode and the first control mode, a document is fed intermittently by the amount of $(L/2)+(\alpha/2)$, and at the scanning reference point, the leading edge of the document certainly comes into contact with the scale member because of the overrun amount $\alpha$.

Another automatic document feeder according to the present invention has control means for controlling the driving means of the feeding means such that the feeding means operates at a standard speed in a condition which does not lower the copying efficiency and that the feeding means operates at a higher speed in a condition which lowers the copying efficiency. The condition which lowers the copying efficiency means a state that the automatic document feeder is doing a job which is not directly in connection with copying, namely, feeding of a first document to a scanning position on a platen glass, ejection of a last document from the platen glass, feeding of a duplex document (document having images on both sides), or feeding documents one by one to count the documents. In any of these conditions, the feeding means is driven at a high speed so that the copying efficiency will not be lowered.

Another automatic document feeder according to the present invention comprises: first control means which, if two successive documents are of a size smaller than a half of a platen glass, allows side-by-side setting of the two documents on the platen glass and feeding of a next document out of a tray; second control means which, if the former of two successive documents is of a size larger than a half of the platen glass, allows setting of only the former document on the platen glass and feeding of the latter document out of the tray; and third control means which, if the latter of two successive documents is of a size larger than a half of the platen glass, inhibits feeding of a next document out of the tray. The first, the second and the third control means are to perform feeding in the two-in-one mode. If a stack of documents to be fed contains only small size documents, the first control means operates. In this case, while two documents are placed on the platen glass, a next document is fed to an entrance of the platen glass, thereby, shortening the time required for a change of documents. If a large size document is present in the stack as an odd sheet, the second control means operates, and if a large size document is present in the stack as an even sheet, the third control means operates. In a case that the third control means operates, after setting of two documents on the platen glass, the trailing end portion of the latter document, which is of a large size, is still in the pre-feed section. In this case, by inhibiting detection of sheet jamming, the feeding can be continued.

A copying apparatus according to the present invention is provided with the automatic document feeder comprising the first, the second and the third control means, and in the copying apparatus, when the third control means operates, that is, when a first small size document and a second large size document are continuously set on the platen glass, only the image of the first document is copied onto a copy sheet. If copying is carried out in the ordinary manner of the two-in-one mode in this case, the image of the first document and the image of the former half of the second document will be copied onto a copy sheet. However, in the copying apparatus, such trouble can be avoided. After copying of the first document, the first document is ejected, and only the second document, which is of a large size, is set on the platen glass for copying. In this way, even if a large size document is present in a stack of documents to be copied, copying of all the documents are continuously done.

Another automatic document feeder according to the present invention is operational in a count mode of counting documents, and in the count mode, each document is stopped in a second position which is upstream of a first position (scanning position) on a platen glass. The closer the second position is to a stand-by position of a next document, the shorter the interval between the documents fed in the count mode is, thereby shortening the time required for the counting.

Another automatic document feeder according to the present invention comprises: first control means which, if two successive documents are of a size smaller than a half of a platen glass, allows successive intermittent feeding of the two documents to a pre-step position where the leading edge of a document is positioned at an intermediate reference point which is located substantially in the center of the platen glass and then to a scanning position where the leading edge of a document is positioned at a scanning reference point which is located in a downstream portion of the platen glass and feeding of a next document to an entrance of the platen glass; and second control means which, if a document fed to the pre-step position is of a size larger than a half of the platen glass, inhibits feeding of a next document.

The first and the second control means is to perform feeding in the pre-step mode. If a stack of documents to be fed contains only small size documents, the first control means operates. In this case, feeding of a document out of a tray, feeding to the pre-step position and feeding to the scanning position are performed successively and intermittently. Thus, the time required for a change of documents is shortened. If a large size document is present in the stack of documents, the second control means operates to complete the feeding of the documents. In this case, when the large size document is fed to the pre-step position, the trailing portion of the document is still in the pre-feed section. The second control means inhibits feeding of a next document to prevent sheet jamming, whereby the feeding is continued. The second control means also inhibits detection of sheet jamming when the large size document is fed to the pre-step position, whereby the feeding is continued.

Further, a copying apparatus according to the present invention is provided with the automatic document feeder comprising the first and the second control means, and if a large size document is set in the scanning position in the pre-step mode, the copying apparatus carries out book division copying. If the document is copied in the ordinary manner of the pre-step mode, only the former half of the document will be copied, and the latter half will not be copied. In the copying apparatus, however, such trouble is avoided. Additionally, the copying apparatus may perform the following operation instead of the book division copying. First, the former half of the large size document is copied, and the document is fed by an amount corresponding to a half of the length of the document. Then, the latter half of the document is copied.

A sheet transporting apparatus according to the present invention comprises: first sheet transporting means disposed in an upstream portion of a sheet path; second sheet transporting means disposed in a downstream portion of the sheet path; driving means for driving the first sheet transporting means and the second sheet transporting means; and control means which controls the driving means to reverse the first sheet transporting means after the leading edge of the former and the leading edge of the latter of two successive sheets reach the second sheet transporting means and the first sheet transporting means respectively and before the leading edge of the latter sheet reaches the second sheet transporting means. With the reverse rotation of the first sheet transporting means, the latter sheet is moved backward. Meanwhile, on the other hand, the former sheet keeps to be fed forward by the second sheet transporting means. The reverse rotation of the first sheet transporting means is a short-time action, and the first sheet transporting means is switched to forward rotation immediately. This action makes a space between the sheets, whereby disorder of sheets on an ejected-sheet tray is prevented.

Further, if the first sheet transporting means and the second sheet transporting means are driven by a single driving source, the same effect can be attained by providing switching means for switching the rotation of the first sheet transporting means between forward and reverse and maintaining the forward rotation of the second sheet transporting means during the reverse rotation of the first sheet transporting means.

BRIEF DESCRIPTION OF THE DRAWINGS

These and other objects and features of the present invention will be apparent from the following description with reference to the accompanying drawings, in which:

a first embodiment is shown as long as no specific instructions are provided;

FIGS. 36*a* through 36*d* are flowcharts showing a subroutine of the CPU2 for pre-feeding a document to the register roller pair;

DETAILED DESCRIPTION OF THE PREFERRED EMBODIMENTS

Preferred embodiments of the present invention are hereinafter described with reference to the accompanying drawings.

Figure 1:
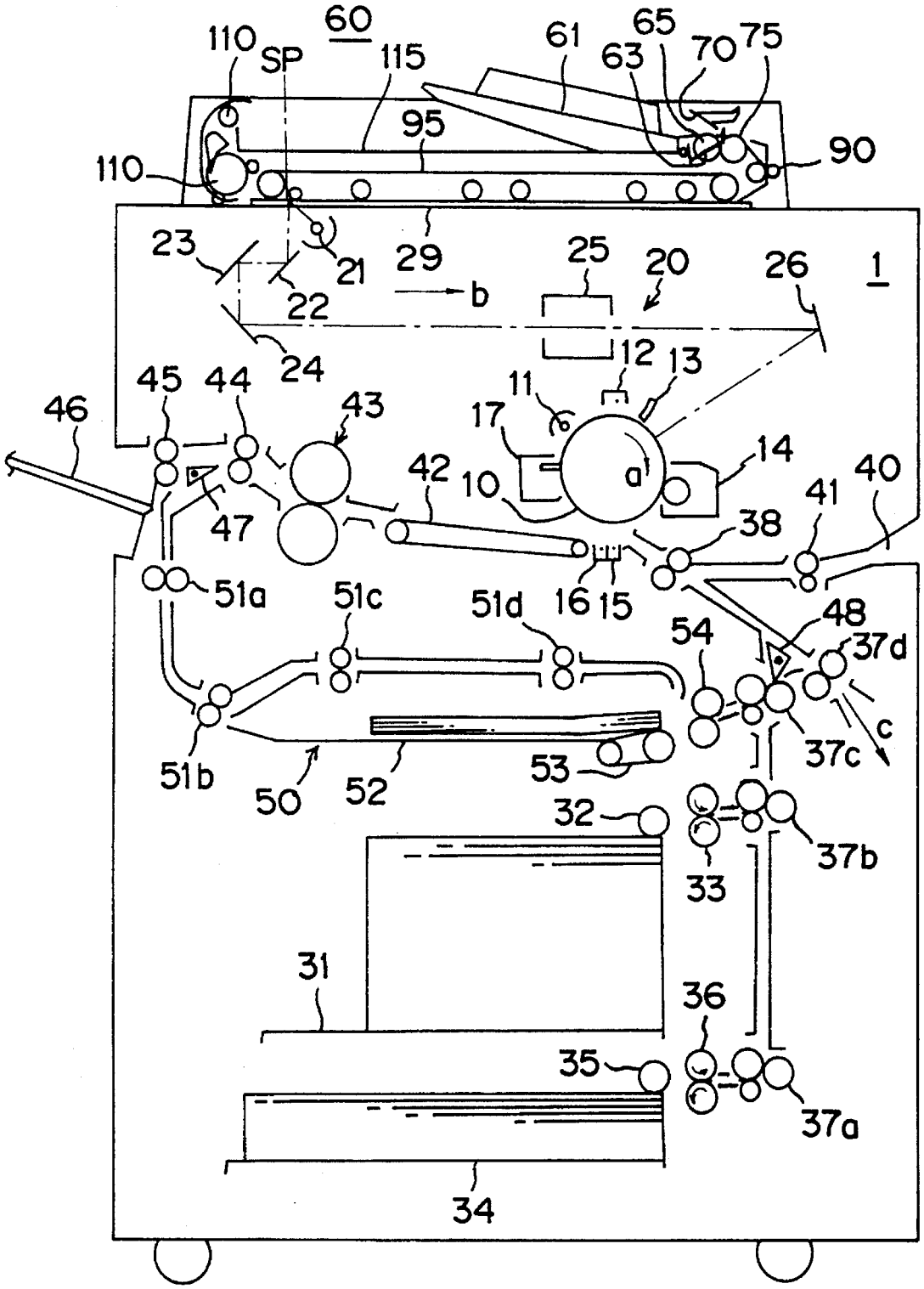
FIG. 1 is a schematic view of a copying apparatus composed of a copying apparatus body and an automatic document feeder (ADF) according to the present invention.

Referring to FIG. 1, the structure of a copying apparatus provided with an automatic document feeder (hereinafter referred to as ADF) according to the present invention is described.

An ADF 60 is disposed on a copying apparatus body 1. In the center of the apparatus body 1, a photosensitive drum 10 is disposed such that the photosensitive drum 10 is driven to rotate in a direction indicated with arrow a at a constant circumferential speed v. Around the photosensitive drum 10, there are provided a main eraser 11, an electric charger 12, a sub eraser 13, a magnetic brush type developing device 14, a transfer charger 15, a separation charger 16 and a blade type cleaner 17 in order in respect with the rotating direction of the drum 10. Further, an optical system 20 is disposed above the photosensitive drum 10.

The photosensitive drum 10 is a conventional type which has a photoconductive layer on its surface. With the rotation in the direction of arrow a, the photosensitive drum 10 is processed by the main eraser .11, the electric charger 12 and the sub eraser 13, that is, subjected to charge erasing, charging and image interval/side charge erasing. Thereafter, the photosensitive drum 10 is exposed to a light from the optical system 20 so that an image of an original document set on a platen glass 29 will be reproduced as an electrostatic latent image on the photosensitive drum 10. The electrostatic latent image is developed into a toner image by the developing device 14.

The optical system 20, which is disposed immediately under the platen glass 29, scans an image of an original document which is set on the platen glass 29 with its one end positioned at a scanning reference point SP. More specifically, for the image scanning, a lamp 21 and a first mirror 22 move together in a direction indicated with arrow b at a speed of v/m (v: circumferential speed of the photosensitive drum 10 and constant regardless of copying magnification, m: copying magnification). Meanwhile, a second mirror 23 and a third mirror 24 move in the direction of arrow b at a speed of v/2m. In order to change the copying magnification, the optical path length is changed by shifting the position of a projection lens 25 along the optical axis and turning a fourth mirror 26.

Copy sheets are contained in an upper copy sheet feed section 31 of an elevator type and a lower copy sheet feed section 34 of a tray type. In accordance with selection of an operator, copy sheets are fed one by one from either one of the copy sheet feed sections 31 and 34. The copy sheet feed section 31 is provided with a feed roller 32 and a separation roller pair 33 composed of a forwarding roller and a reversing roller, and likewise the copy sheet feed section 34 is provided with a feed roller 35 and a separation roller pair 36. Each sheet fed out of the upper copy sheet feed section 31 is transported to a timing roller pair 38 through transporting roller pairs 37*b* and 37*c*. Each sheet fed out of the lower copy sheet feed section 34 is transported to the timing roller pair 38 through a transporting roller pair 37*a* as well as the roller pairs 37*b* and 37*c*.

Additionally, manual feeding of copy sheets is possible. In the manual feeding, copy sheets are fed from a manual feed port 40, and each sheet is transported to the timing roller pair 38 through a roller pair 41.

A copy sheet transported to the timing roller pair 38 is once stopped, and in synchronization with the image formed on the photosensitive drum 10, the timing roller pair 38 is driven to rotate, whereby the copy sheet is fed to a transfer section. At the transfer section, the copy sheet sticks to the photosensitive drum 10, and the image is transferred from the photosensitive drum 10 to the sheet by corona discharge from the transfer charger 15. Thereafter, the sheet is separated from the photosensitive drum 10 by alternating corona discharge from the separation charger 16. Then, the sheet is fed to a fixing device 43, where the image is fixed on the sheet, through a conveyer belt 42. Finally, the sheet is ejected onto an ejected-sheet tray 46 through a transporting roller pair 44 and an ejection roller pair 45.

The photosensitive drum 10 continues rotating in the direction of arrow a even after the image transfer so that the cleaner 17 will remove residual toner and that the main eraser 11 will erase residual charge. Thus, the photosensitive drum 10 gets ready for the next copying.

Further, the copying apparatus can operate in a duplex copying mode in which images are copied on both sides of a copy sheet and in a composite copying mode in which images are copied on one side of a copy sheet. For the duplex copying and the composite copying, a sheet refeeding unit 50 and diverters 47 and 48 are provided. The diverter 47 is usually in a position indicated with a solid line so as to guide the sheet to the ejected-sheet tray 46. In a case of the duplex or the composite copying, when a copy sheet has obtained a first image on a first side, the diverter 47 slightly pivots counterclockwise and is set in a position to guide the sheet to an intermediate tray 52. The sheet is transported into the intermediate tray 52 with its imaged side up through transporting roller pairs 51*a*, 51*b*, 51*c* and 51*d*. When a specified number of copy sheets are stored in the intermediate tray 52, a refeeding signal is generated. In response to the refeeding signal, the copy sheets are fed out of the intermediate tray 52 to the transporting roller pair 37*c* one by one from the lowermost sheet by a refeeding belt 53 and a separation roller pair 54.

In the duplex copying mode, the diverter 48 is in a position indicated with a solid line to guide a refed copy sheet upward to the timing roller pair 38. The sheet is fed to the transfer section to obtain a second image on its second side. Then, the second image is fixed on the sheet, and the sheet is ejected onto the ejected-sheet tray 46. In the composite copying mode, on the other hand, the diverter 48 slightly pivots counterclockwise and is set in a position to guide a refed sheet to a transporting roller pair 37*d*, and the roller pair 37*d* transports the sheet in a direction indicated with arrow c. Immediately before the trailing end of the sheet passes through the nipping portion of the roller pair 37*d*, the roller pair 37*d* is reversed, whereby the sheet is transported toward the timing roller pair 38. In this way, the sheet is turned over and upside down. The sheet obtains a second image on its first side where the first image has been formed, and the second image is fixed. Then, the sheet is ejected onto the ejected-sheet tray 46.

Incidentally, in this copying apparatus body 1, serial feeding is carried out. Specifically, while a first copy sheet is waiting at the timing roller pair 38, a second and/or a third copy sheet is fed into the sheet path. For example, in a case of feeding from the lower copy sheet feed section 34, a first and successively a second sheet are fed into the sheet path, and further a third sheet is fed to the transporting roller pair 37*a*. The serial feeding is carried out not only in multiple copying but also in single copying using the ADF 60, which increases the copying speed.

The structure and the operation of the ADF 60 are hereinafter described.

Figure 2:
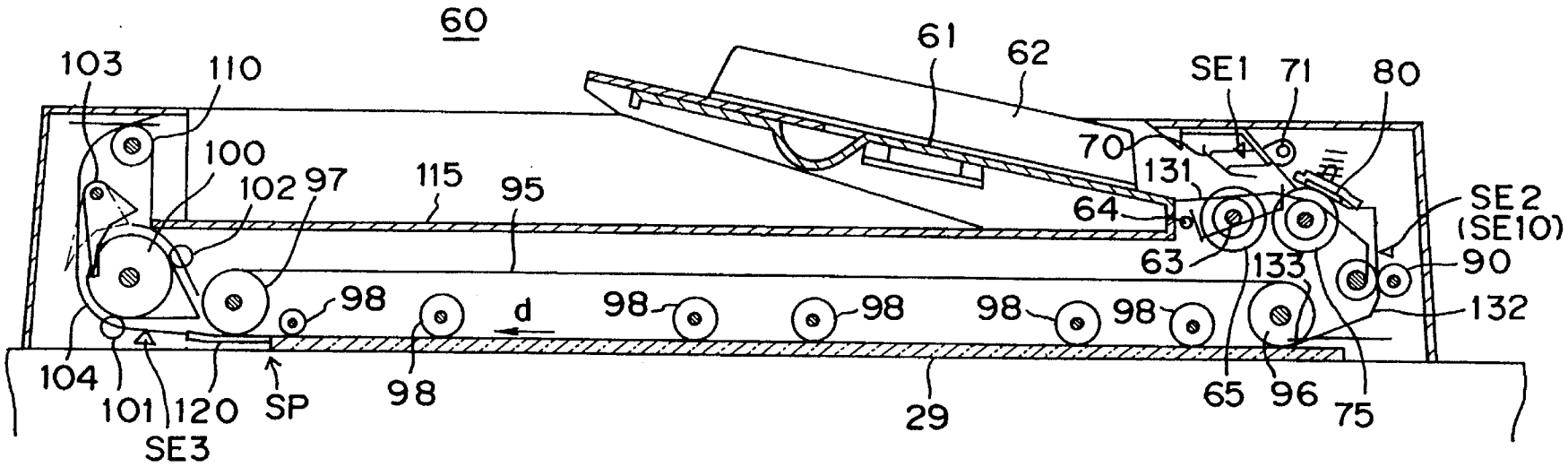
FIG. 2 is a sectional view of the ADF showing its internal structure.

First referring to FIG. 2, the general structure and operation of the ADF 60 are described. The ADF 60 mainly consists of a document tray 61, side regulation plates 62, a leading edge regulation plate 63, a pick-up roller 65, a document pressing plate 70, a separation roller 75, a separation pad 80, a register roller pair 90, a conveyer belt 95, a reversing roller 100, an ejection roller 110 and an ejected-document tray 115. The ADF 60 is mounted on the apparatus body 1 such that the conveyer belt 95 is positioned on the platen glass 29. The ADF 60 is fitted to the apparatus body 1 by hinges (not shown) in the rear side and is capable of pivoting on the hinges so as to cover and uncover the platen glass 29. If the operator wishes to set an original document on the platen glass 29 manually, the ADF 60 shall be lifted up. The open or closed state of the ADF 60 is detected by a magnetic sensor (not shown), and the ADF 60 is operational only while the magnetic sensor detects the closed state of the ADF 60.

Original documents are stacked on the tray 61 with the first page on the top and facing up. The sides of the stack of documents are regulated by the side regulation plates 62, and the leading edge of the stack of documents is regulated by the leading edge regulation plate 63.

The leading edge regulation plate 63 and the pressing plate 70 are pivoted on shafts 64 and 71 respectively. The leading edge regulation plate 63, while the original documents are being fed one by one from the first to the last, is kept in a retreating position. The pressing plate 70, when each document is to be fed out of the tray 61, pivots downward from a retreating position indicated with a solid line in FIG. 2 so as to press the leading portion of the stack of documents against the pick-up roller 65.

The pick-up roller 65 and the separation roller 75 are driven to rotate clockwise so as to feed a document out of the document tray 61. The feeding starts with the bottom of the stack of documents. Each document fed out of the tray 1 passes between the separation roller 75 and the separation pad 80 and is fed to the register roller pair 90.

The document fed to the register roller pair 90 is once stopped. After a specified time, the register roller pair 90 is driven to rotate, whereby the document is transported to the entrance of the platen glass 29.

The conveyer belt 95 is stretched between a driving roller 96 and a driven roller 97 endlessly such that the belt 95 covers the platen glass 29 entirely. A number of back-up rollers 98 are provided inside the round of the conveyer belt 95 so as to press the belt 95 against the platen glass 29. The conveyer belt 95 is driven to rotate in a direction indicated with arrow d, and the document is set such that the leading edge is positioned at the scanning reference point SP which is the border of a scale 120 and the platen glass 29.

The reversing roller 100 is provided with pinch rollers 101 and 102. Further, for handling of a duplex document (document which has images on both sides), a diverter 103 is provided. The diverter 103 is usually in a position indicated with a solid line. After scanning, the document is discharged from the platen glass 29 with rotation of the conveyer belt 95 in the direction of arrow d and clockwise rotation of the reversing roller 100. Then, the document is guided upward by the guide plate 104 and the diverter 103 in the position of the solid line and ejected onto the ejected-document tray 115 through the ejection roller 110. In a case of feeding of a duplex document, the diverter 103 is switched to be in a position indicated with a dashed line. In copying of a duplex document, its reverse side (latter page) of the document is first copied. Therefore when the document is fed from the tray 61 onto the platen glass 29, the diverter 103 is set in the position indicated with the dashed line, and in order to place the document with its reverse side facing down, the document passes through the platen glass 29 and is turned over by the reversing roller 100. Then, with reverse rotation (rotation in a direction reverse to arrow d) of the conveyer belt 95, the document is set on the platen glass 29. After scanning of the reverse side, the document is turned over by the reversing roller 100 again and returned onto the platen glass 29, whereby the document is set on the platen glass 29 with its front side facing down.

Figure 26:
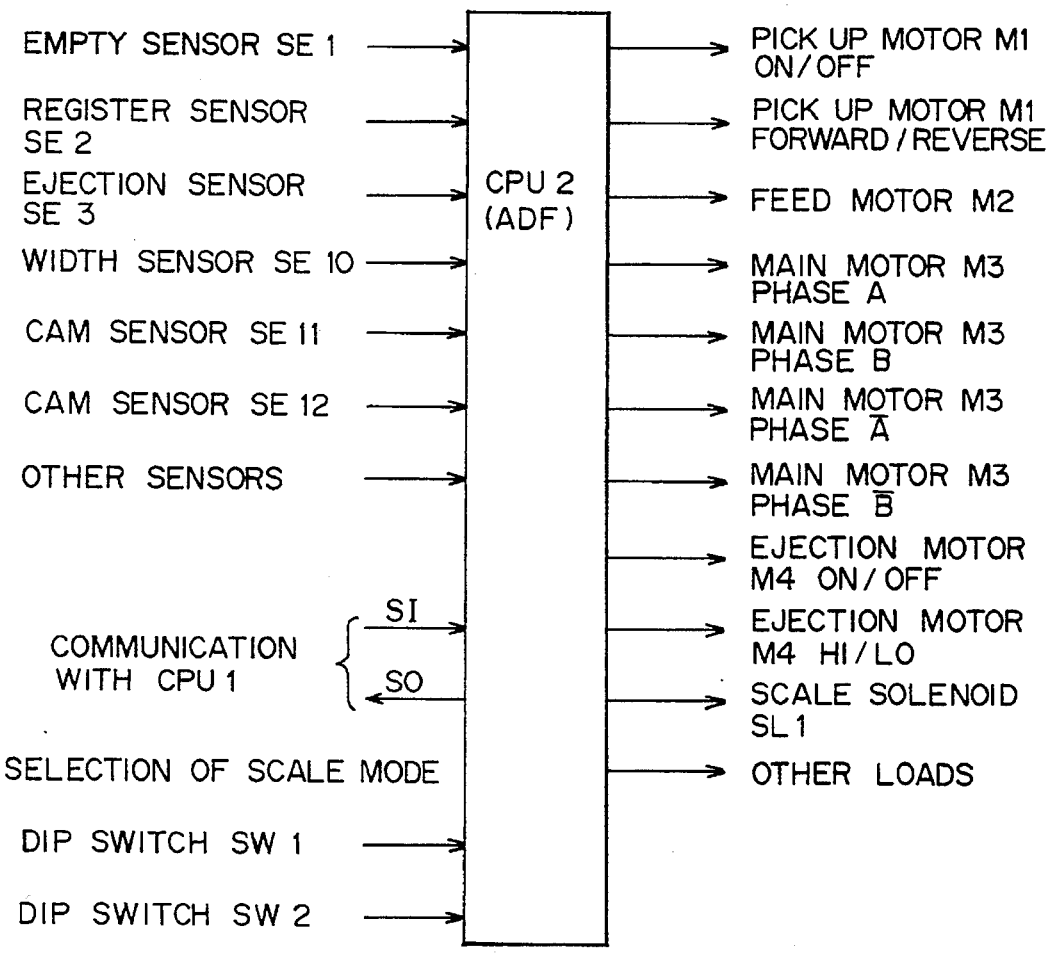
FIG. 26 is a block diagram of a control circuit for the ADF.

The reversing roller 100 and the ejection roller 110 are driven to rotate by an ejection motor M4 (see FIG. 26).

The ADF 60 is provided with sensors SE1, SE2, SE3 and SE10. The sensor SE1 detects the presence and the non-presence of a document on the tray 61. The sensor SE2 is disposed immediately before the register roller pair 90. The sensor SE2 detects a document coming and going and also detects the length of the document in cooperation with a timer. The sensor SE10 is disposed at the side of the sensor SE2 and detects the width of the document. The size of the document including whether vertically-fed or laterally-fed is judged from the detection of the sensors SE2 and SE10. The sensor SE3 is disposed immediately before the reversing roller 100.

Next, each element of the ADF 60 is described in detail.

The scale 120 is used as a reference when an original document is set on the platen glass 29 manually. The original document is placed on the platen glass 29 with an end thereof set in accordance with a mark of the scale 120. Additionally, in automatic document feeding by use of the ADF 60, when a document is conveyed on the platen glass 29 by the conveyer belt 95, the scale 120 stops the document with its leading edge positioned at the scanning reference point SP.

Figure 3:
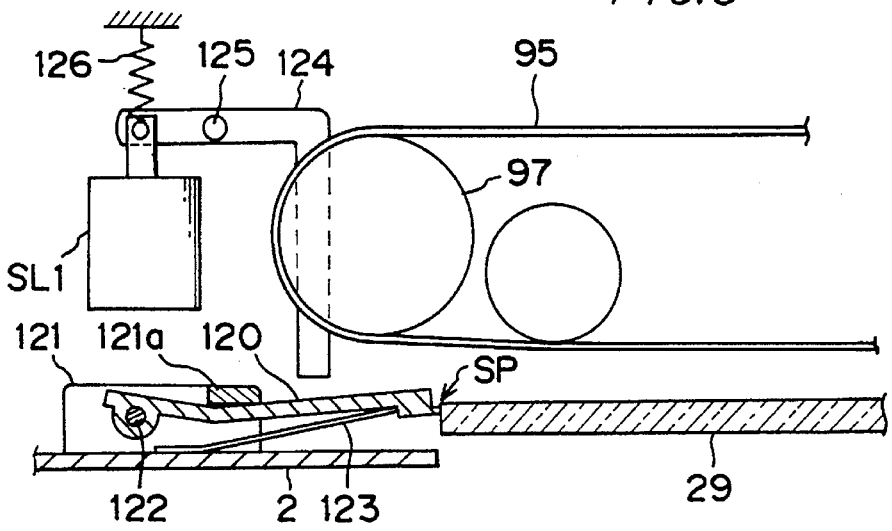
FIG. 3 is a fragmentary sectional view of the ADF showing a scanning reference point and its periphery in a state that the ADF is slightly lifted up.
Figure 4:
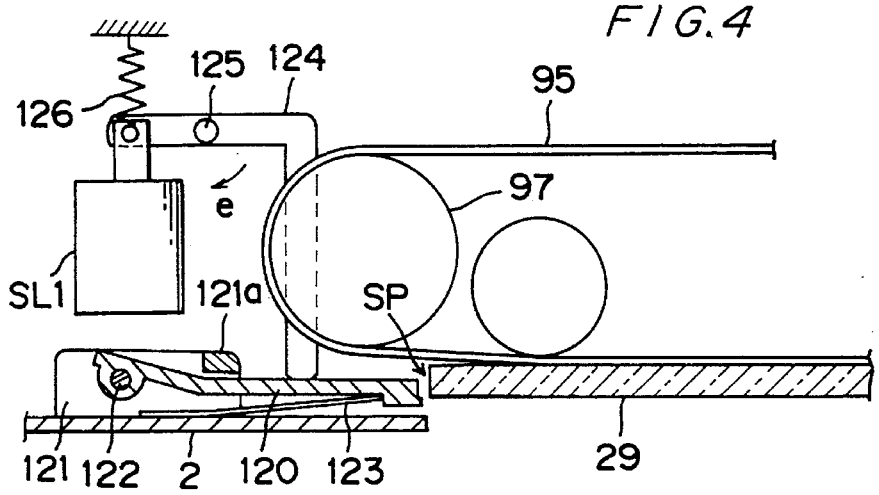
FIG. 4 is a fragmentary sectional view of the ADF showing the scanning reference point and its periphery in a state that a scale is in a retreating position.

More specifically, as shown in FIGS. 2, 3 and 4, the scale 120 is fitted in a holder 121 provided on an upper frame 2 of the apparatus body 1 such that the scale 120 can pivot on a pin 122 and that the end of the scale 120 is urged upward by a plate spring 123. The upward pivot of the scale 120 is regulated by a wall 121*a* of the holder 121 or the end of a lever 124 connected to a solenoid SL1. The lever 124 is pivoted on a pin 125 inside the ADF 60, and its rear end is connected to a plunger of the solenoid SL1. While the solenoid SL1 is off, a spring 126 makes the lever 124 pivot on the pin 125 in a direction indicated with arrow e in FIG. 4, and the end of the lever 124 presses the scale 120. At that time, the scale 120 comes slightly under the upper surface of the platen glass 29.

In manual document setting, as the ADF 60 is lifted up from the platen glass 29, the end of the lever 124 separates from the scale 120. Thereby, the scale 120 pivots upward until the wall 121*a* of the holder 121 stops the pivot (see FIG. 3). At that time, the scale 120 comes slightly above the upper surface of the platen glass 29. In this state, the operator sets an original document on the platen glass 29 referring to a mark of the scale 120.

In automatic document feeding by use of the ADF 60, in this embodiment, there are adopted two modes of stopping a document with its leading edge exactly at the scanning reference point SP: a scale mode and a pulse control mode.

In the scale mode, the leading edge of a document conveyed by the conveyer belt 95 comes into contact with the scale 120, and the document stops. In this case, the solenoid SL1 is turned on so that the lever 124 will pivot in the reverse direction of arrow e (see FIG. 5). Thereby, the scale 120 pivots upward until the wall 121*a* of the holder 121 stops the scale 120, and the lever 124 comes above the upper surface of the platen glass 29. In this state, a document D conveyed in a direction of arrow d by the conveyer belt 95 comes into contact with the scale 120, whereby the document D is stopped exactly at the scanning reference point SP.

In the pulse control mode, both the register roller pair 90 and the conveyer belt 95 are driven by a main motor (stepping motor) M3 so that the sheet conveying speed of the roller pair 90 and that of the belt 95 will be the same, and thereby, a conveying distance L of a document (see FIG. 15) is controlled accurately. The conveying distance per driving pulse of the main motor M3 is previously known. The main motor M3 is driven with a number of pulses corresponding to the conveying distance L from the register roller pair 90 to the scanning reference point SP, whereby a document waiting at the register roller pair 90 can be conveyed to the scanning reference point SP accurately. While the register roller pair 90 and the conveyer belt 95 are operated in the pulse control mode, the solenoid SL1 is kept off, and the scale 120 is slightly under the upper surface of the platen glass 29 (see FIG. 4).

In the scale mode, a document is stopped with its leading edge positioned at the reference point SP when it collides with the scale 120. Therefore the scale mode has an advantage of higher accuracy of the positioning of the document. However, it has a disadvantage that if the document is thin, trouble such as bending of the leading edge of the document and sheet jamming may occur. On the other hand, the pulse control mode has an advantage that the trouble may not occur even if the document is thin. However, because of slipping of the document and/or a response delay of the driving mechanism, the accuracy of the positioning is not so high as the scale mode.

In this embodiment, the scale mode and the pulse control mode which have the advantages and disadvantages contrary to each other can be selected. The selection is made by use of dip switches SW1 and SW2 (see FIG. 26) provided in the apparatus body 1.

Figure 6:
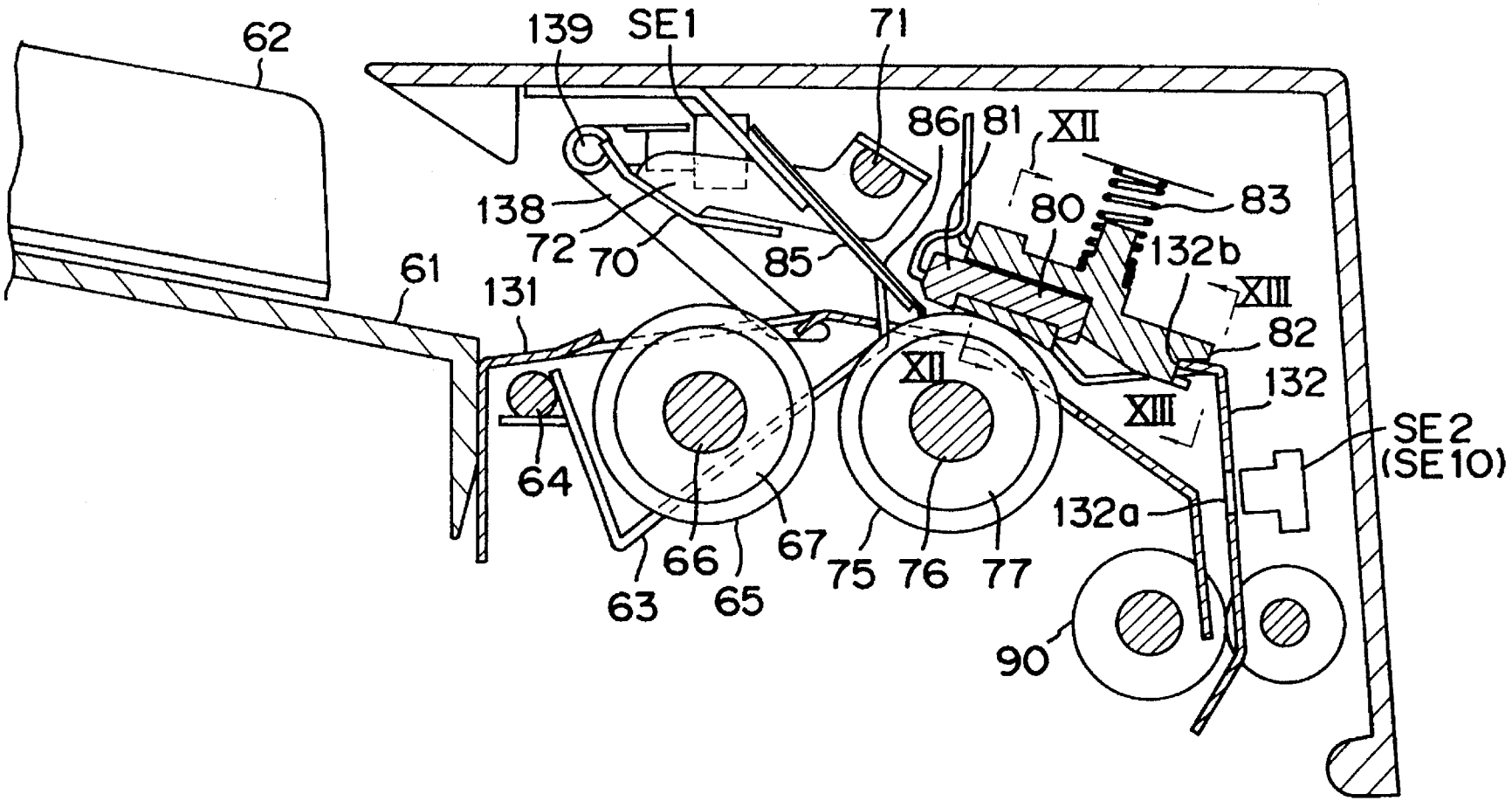
FIG. 6 is a fragmentary sectional view of the ADF showing a pre-feed section.

Next referring to FIG. 6, a pre-feed section is described.

A document guide plate 131 protrudes from the edge of the tray 61 on a level slightly lower than the top portions of the pick-up roller 65 and the separation roller 75 and extends to the register roller pair 90. Another document guide plate 132 extends from the upper portion of the separation roller 75 to the downstream side of the register roller pair 90. The leading edge regulation plate 63 is fitted to a shaft 64 and disposed under the guide plate 131. The regulation plate 63 is movable between a regulating position where the edge of the regulation plate 63 is projected on the guide plate 131 and a retreating position where the edge of the regulation plate 63 is under the guide plate 131. The leading edge regulation plate 63 is usually set in the regulating position and receives original documents placed on the tray 61 by an operator. Thereby, the regulation plate 63 provides the operator with a feeling that the original documents have been set on the tray 61 and regulates the leading edges of the documents. When a document feeding start signal is generated, the leading edge regulation plate 63 comes down to the retreating position. The regulation plate 63 is kept in the retreating position until all the documents on the tray 61 are fed out thereof.

Figure 7:
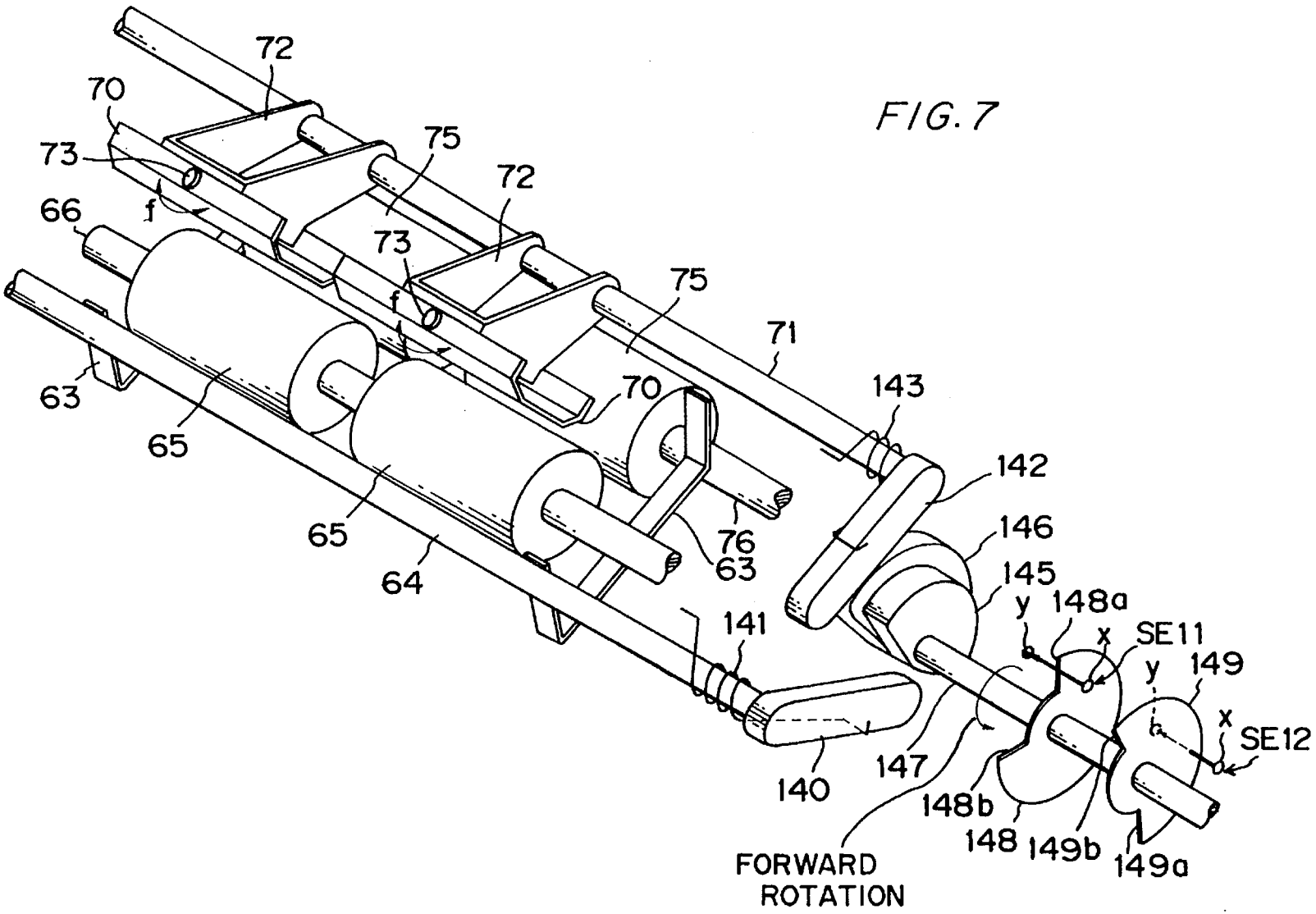
FIG. 7 is a perspective view of a driving mechanism of a leading edge regulation plate and a document pressing plate.
Figure 11:
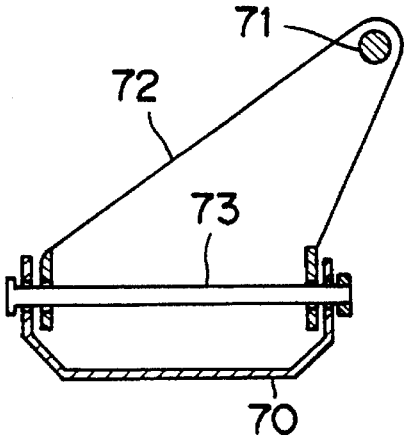
FIG. 11 is a sectional view of a fitting structure of the pressing plate.

The document pressing plate 70 has two plates supported by holders 72, and the holders 72 are fitted to a shaft 71. As shown in FIG. 7, the two plates face two wheels of the pick-up roller 65 respectively, and each of the plate pivots on a pin 73 standing on the corresponding holder 72 in a direction indicated with arrow f (see FIG. 11). The pressing plate 70 is movable between a retreating position illustrated in FIG. 6 and a pressing position to press the leading portion of the documents against the pick-up roller 65 elastically. The pressing plate 70 is usually in the retreating position, and the pressing plate 70 comes down to the pressing position when each document is to be fed out of the tray 61. The reason why the plate 70 is fitted to the holder 72 in such a manner to pivot on the pin 73 in the direction of arrow f is to apply a pressure entirely and evenly to the upper surface of the stack of documents on the tray 61. The even pressure applied to the stack of documents ensures the bottom document the feeding power of the pick-up roller 65.

The empty sensor SE1 (see FIG. 6) is a transmitting type photosensor, and an actuator 138 is pivoted on a shaft 139 so as to advance into and retreat from the optical axis of the sensor SE1. The actuator 138 usually hangs from the shaft 139 by its own weight, and if there are no documents on the tray 61, the lower end of the actuator 138 will be under the guide plate 131. In this state, the upper end of the actuator 138 is in the optical axis of the sensor SE1. When documents are set on the tray 61, the actuator 138 pivots upward, and the upper end of the actuator 138 retreats from the optical axis of the sensor SE1. The register sensor SE2 and the width sensor SE10 are reflective type photosensors, and holes 132*a* are made in the guide plate 132 so that the sensors SE2 and SE10 can detect a document.

The pick-up roller 65 and the separation roller 75 each have two wheels. The wheels are coated with rubber and driven to rotate by a single motor M2 (see FIG. 26). The pick-up roller 65 and the separation roller 75 apply a high frictional force to documents so that the documents will be fed one by one from the bottom one.

Figure 12:
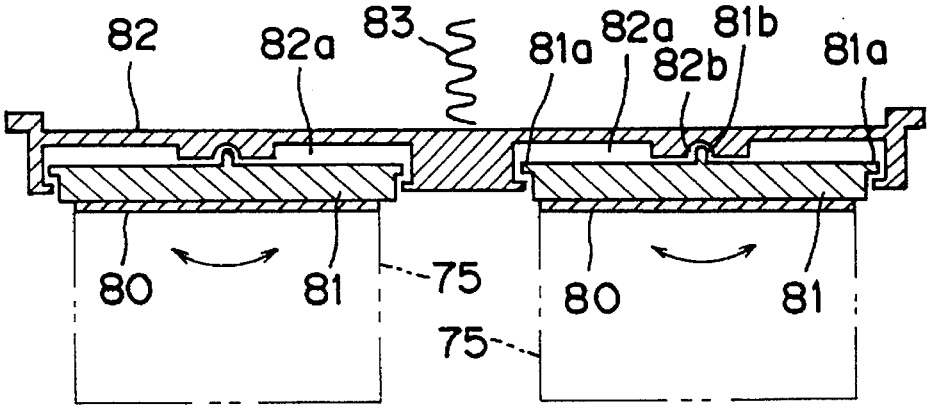
FIG. 12 is a sectional view of the pre-feeding section of the ADF, taken along the line XII—XII in FIG. 6.
Figure 13:
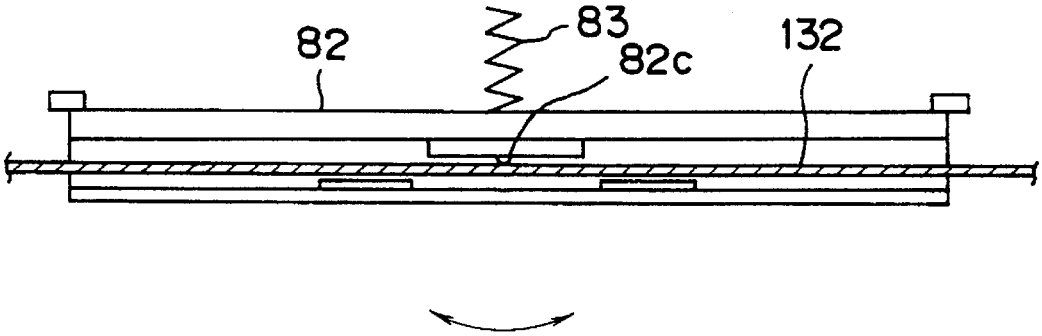
FIG. 13 is a sectional view of the pre-feeding section of the ADF, taken along the line XIII—XIII in FIG. 6.

The separation pad 80 has two rubber pads fixed on plates 81, and the plates 81 are fitted in a holder 82. As shown in FIG. 12, the rubber pads are pressed against the two wheels of the separation roller 75 by a coil spring 83 disposed in the center of the holder 82. Because the holder 82 has recesses 82*a*, the fitting of the plates 81 to the holder 82 is loose. However, each of the plates 81 has projections 81*a* at both sides and a projection 81*b* on the upper surface, and the upper projection engages with a hole 82*b* of the holder 82. Thereby, the plates are prevented from disengaging from the holder 82. The holder 82 is inserted in a cutout 132*b* of the guide plate 132 (see FIG. 6), and a projection 82*c* of the holder 82 provided with a force from the coil spring 83 presses the guide plate 132 (see FIG. 13). In the structure, each of the rubber pads is capable of pivoting in the four directions on the projection 81*b* of the corresponding plate 81, and the separation pad 80 as a whole is capable of pivoting in the four directions on the projection 82*c* of the holder 82. With this structure, the posture of the holder 82 can be automatically adjusted to deformation of the guide plate 132, and the rubber pads can be pressed against the two wheels of the separation roller 75 evenly at all times. Additionally, the pressure of the separation pad 80 can be regulated only by regulating the force of the spring 83.

Incidentally, the friction $\mu 1$ between the separation roller 75 and a document, the friction $\mu 2$ between the separation pad 80 and the document and the friction $\mu 3$ between documents have a relation $\mu 1 > \mu 2 > \mu 3$. Therefore even if two or more documents are fed out by the pick-up roller 65 at a time, only the bottom one will pass between the separation roller 75 and the separation pad 80.

Further, in order to improve the sheet separating effect, a pre-separation plate 85 with a flexible sheet 86 is provided (see FIG. 6). The pre-separation plate 85 is disposed above the leading-edge regulation plate 63 such that the plate 85 is downwardly slant in respect with the document feeding direction. The lower edge of the plate 85 is immediately before the separation pad 80 and at a slight distance from the separation roller 75. The lower edge of the flexible sheet 86 is lightly in contact with the separation roller 75. A plurality of documents fed by the pick-up roller 65 hit their leading edges on the pre-separation plate 85, and the lower one or two documents pass through the plate 85. The flexible sheet 86 is an auxiliary of the pre-separation plate 85.

Next referring to FIG. 7, a driving mechanism of the leading-edge regulation plate 63 and the pressing plate 70 is described.

The shaft 64 supporting the leading-edge regulation plate 63 is fitted with a lever 140 at one end and urged counterclockwise by a torsion spring 141. Thereby, the leading-edge regulation plate 63 is set in the regulating position above the guide plate 131. The shaft 71 supporting the holders 72 of the pressing plate 70 is fitted with a lever 142 at one end and urged counterclockwise by a torsion spring 143. Thereby, the pressing plate 70 presses documents toward the pick-up roller 65 elastically.

Between the levers 140 and 142, sector cams 145 and 146 are disposed. The cams 145 and 146 are fitted around a shaft 147 which is connected to a reversible pick-up motor M1 (see FIG. 26). The lever 140 faces the circumference of the cam 145, and the lever 142 faces the circumference of the cam 146. With rotation of the cams 145 and 146, the levers 140 and 142 pivot, and accordingly the leading-edge regulation plate 63 and the pressing plate 70 are positioned. The shaft 147 is fitted with disks 148 and 149 each of which has a notch. When an edge 148*a* or 148*b* of the notch of the disk 148 crosses the optical axis of a transmitting type photosensor SE11 (light emitting element x and light receiving element y), the photosensor SE11 is turned on or off. Likewise, when an edge 149*a* or 149*b* of the notch of the disk 149 crosses the optical axis of a transmitting type photosensor SE12, the photosensor SE12 is turned on or off. The rotation of the cams 145 and 146 is controlled in accordance with the turning-on and turning-off of the photosensors SE11 and SE12.

Figure 8:
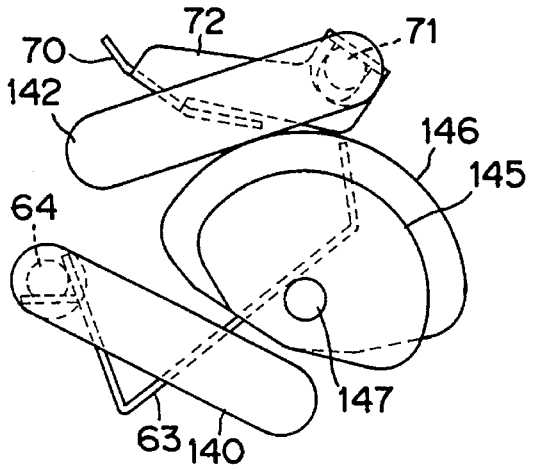
FIG. 8 is a view explaining the positions of the leading edge regulation plate and the document pressing plate in respect to rotation of a cam in a state that they are in home positions.
Figure 9:
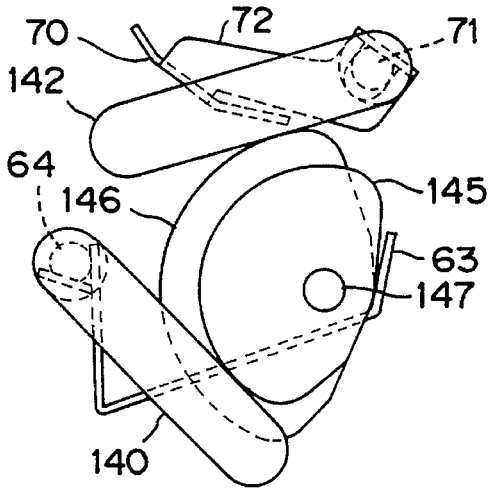
FIG. 9 is a view explaining the positions of the leading edge regulation plate and the document pressing plate in respect to rotation of the cam in a state that they are in retreating positions during pre-feeding.
Figure 10:
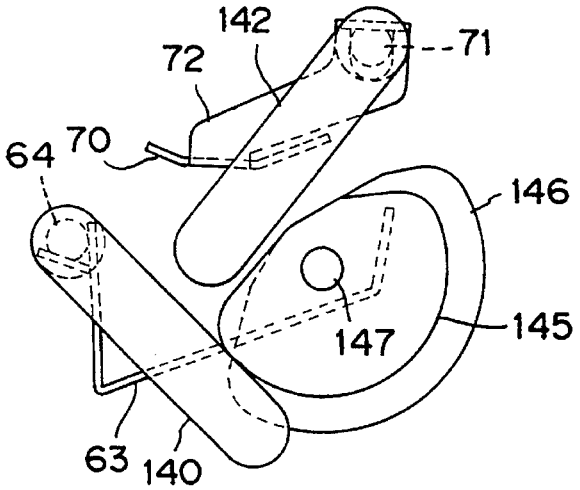
FIG. 10 is a view explaining the positions of the leading edge regulation plate and the document pressing plate in respect to rotation of the cam in a state that the pressing plate comes to a pressing position during the pre-feeding.

While the ADF 60 is standing by, the levers 140 and 142 and the cams 145 and 146 are in the positions illustrated in FIGS. 7 and 8 (home positions). In this state, the leading-edge regulation plate 63 is in the regulating position, and the pressing plate 70 is in the retreating position. When an ADF start signal is generated, the pick-up motor M1 is rotated forward, whereby the cams 145 and 146, and the disks 148 and 149 are rotated counterclockwise together with the shaft 147. When the sensor SE11 detects the notch edge 148*a* of the disk 148 and is turned on, that is, when it is detected that the cams 145 and 146 come in the home positions, the pick-up motor M1 is once stopped. Thereafter, when a document exchange signal is generated, the pick-up motor M1 is rotated forward to rotate the cams 145 and 146, and the disks 148 and 149 counterclockwise. When the cams 145 and 146 are rotated by an angle of 90 degrees, the lever 140 comes into contact with the arc of the cam 145 as shown in FIG. 9 and pivots downward against the force of the torsion spring 141, and accordingly the leading-edge regulation plate 63 comes down to the retreating position under the guide plate 131. On the other hand, the lever 142 keeps in contact with the arc of the cam 146, and the pressing plate 70 keeps in the retreating position. When the cams 145 and 146 are further rotated by an angle of 160 degrees (an angle of 250 degrees from the home position), the sensor SE11 detects the notch edge 148*b* of the disk 148 and is turned on, and the pick-up motor M1 is stopped. In this moment, as shown in FIG. 10, the lever 140 keeps in contact with the arc of the cam 145, and the leading-edge regulation plate 63 keeps in the retreating position. On the other hand, the lever 142 loses the support of the arc of the cam 146 and pivots downward because of the force of the torsion spring 143, and accordingly the pressing plate 70 comes down to the pressing position to press the leading portion of the stack of documents against the pick-up roller 65.

In this state, the pick-up roller 65 and the separation roller 75 are rotated, and a single document is fed out of the tray 61. When the leading edge of the document reaches the register roller pair 90, the pick-up motor M1 is reversed. Thereafter, when the cams 145 and 146 are rotated clockwise by an angle of 160 degrees, that is, when the sensor SE12 detects the notch edge 149*a* of the disk 149 and is turned on, the pick-up motor M1 is stopped. At that time, the levers 140 and 142 are back in the positions illustrated in FIG. 9. Accordingly, the leading-edge regulation plate 63 is kept in the retreating position, and the pressing plate 70 pivots upward and releases the stack of documents from the pressure. Pre-feeding (feeding to the register roller pair 90) of the succeeding document is performed in the same manner. Every time a document exchange signal is generated, the pick-up motor M1 is rotated forward and in reverse each by an angle of 160 degrees, and accordingly the pressing plate 70 reciprocates between the pressing position and the retreating position, whereas the leading-edge regulation plate 63 keeps in the retreating position.

As described, in this embodiment, a simple system is used as a driving mechanism of the leading-edge regulation plate 63 and the pressing plate 70. Since the cams 145 and 146 are used in the system, there is no noise in driving the regulation plate 63 and the pressing plate 70. In the system, the leading-edge regulation plate 63 keeps in the retreating position from the beginning to the end of feeding of a stack of documents, and damage on the leading edges of documents and skew of the documents can be prevented. Further, since the pressing plate 70 comes to the pressing position only while the leading portion of a document is passing through the separation roller 75 and pivots up to the retreating position afterwards, it is less likely that two or more documents are fed at a time.

Next, the register roller pair 90 is described.

The register roller pair 90 receives a document fed out of the tray 61 by the pick-up roller 65 and the separation roller 75 at the nipping portion and corrects skew of the document by hitting the leading edge of the document. A specified time after the sensor SE2 detects the leading edge of the document, the feed motor M2 is turned off so as to stop the rotation of the pick-up roller 65 and the separation roller 75. At that time, the leading edge of the document is stopped by the nipping portion of the register roller pair 90, and the document makes a loop.

Thereafter, the main motor M3 is turned on to rotate the register roller pair 90, timed to the copying operation of the apparatus body 1. With the rotation of the register roller pair 90, the document is fed to the entrance of the platen glass 29. In this embodiment, the pick-up roller 65 and the separation roller 75 are driven by the feed motor M2, and the register roller pair 90 is driven by the main motor M3 which also drives the conveyer belt 95. Further, one way clutches 67 and 77 are provided between the pick-up roller 65 and its driving shaft 66 and between the separation roller 75 and its driving shaft 76 respectively (see FIG. 6). Thereby, even if the feed motor M2 is off, the pick-up roller 65 and the separation roller 75 idle clockwise in FIG. 6 while the register roller pair 90 feeds the document.

Figure 14:
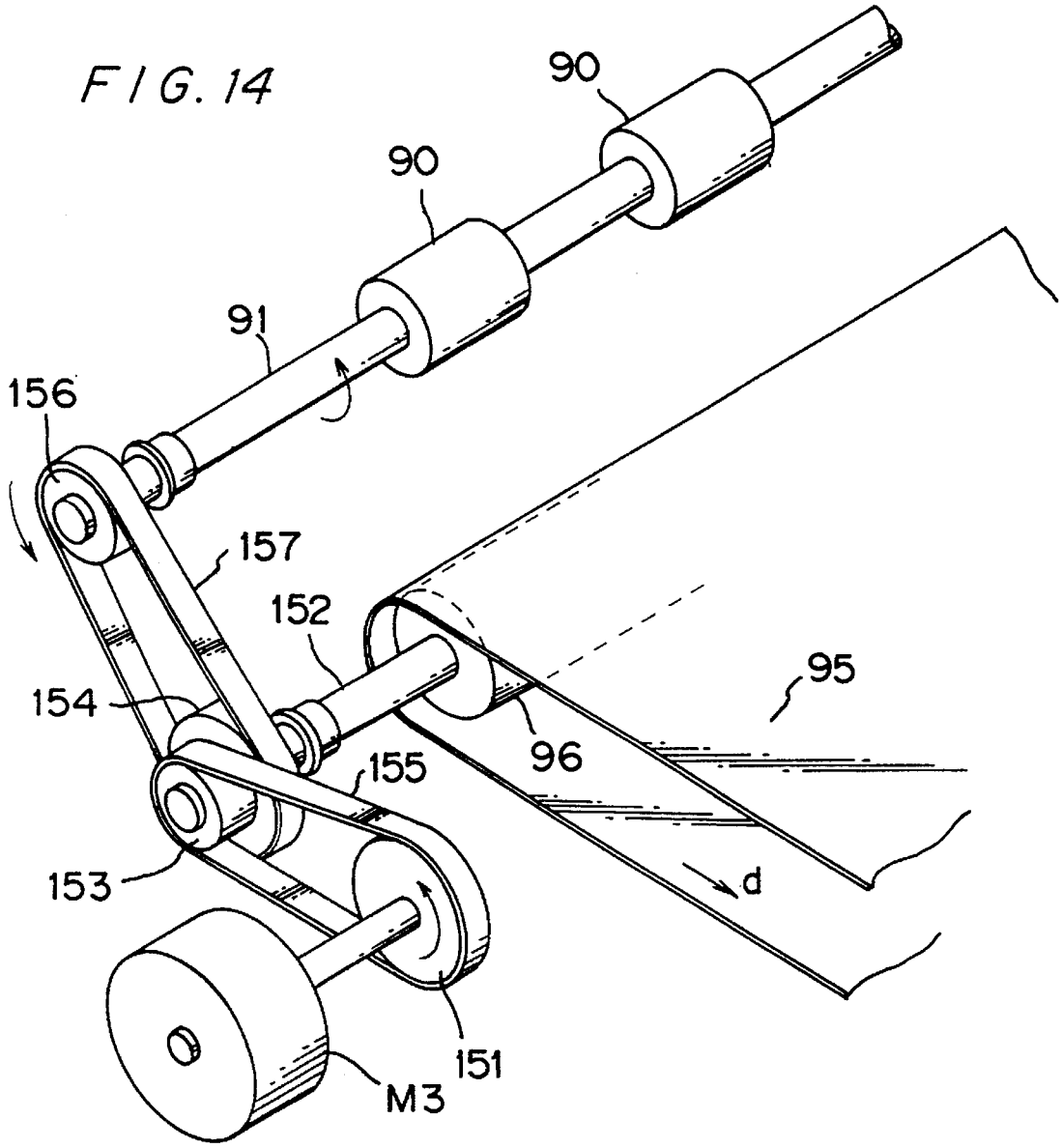
FIG. 14 is a driving mechanism of a conveyer belt and a register roller pair.

Now referring to FIG. 14, the driving mechanism of the register roller pair 90 and the conveyer belt 95 is described.

The register roller pair 90 and the conveyer belt 95 are connected with each other by the main motor M3 with no clutches in-between. The main motor M3 is a stepping motor which can rotate both forward and in reverse by order of a pulse signal. A timing belt 155 stretched between an output pulley 151 of the main motor M3 and a pulley 153 fixed to a shaft 152 of a driving roller 96 of the conveyer belt 95. A timing belt 157 is stretched between a pulley 154 integrally provided with the pulley 153 and a, pulley 156 fixed to a shaft 91 of the register roller pair 90.

In the structure, when the main motor M3 rotates forward (counterclockwise in FIG. 14), the rotation is transmitted to the driving roller 96 via the pulley 151, the belt 155, the pulley 153 and the shaft 152, whereby the conveyer belt 95 is rotated forward (in a direction of arrow d). At the same time, the rotation of the belt 155 is transmitted to the shaft 91 via the pulley 154, the belt 157 and the pulley 156, whereby the register roller pair 90 is rotated.

Next, operation modes of the ADF 60 is described.

In this embodiment, there are five document feeding modes: a pre-step mode, a two-in-one mode and a count mode as well as a simplex mode and a duplex mode which are conventional. Further, as mentioned, there are two document stopping modes: the scale mode and the pulse control mode. With respect to feeding of a document, in the following description, set positions of a document are called as follows. While the document is set with its leading edge positioned at the scanning reference point SP, it is said that the document is in a scanning position. While the document is set with its leading edge positioned at an intermediate reference point IP or IP', it is said that the document is in a pre-step position. While the document is stopped with its leading edge nipped by the register roller pair 90, it is said that the document is in a pre-feeding position. The size of the platen glass 29 corresponds to an A3 vertically-fed document. In the following, the operation modes of the ADF 60 are described in connection with feeding of A4 laterally-fed documents and A3 vertically-fed documents. As long as no specific sizes are provided, a small size means an A4 laterally-fed size, and a large size means an A3 vertically-fed size.

Figure 15:
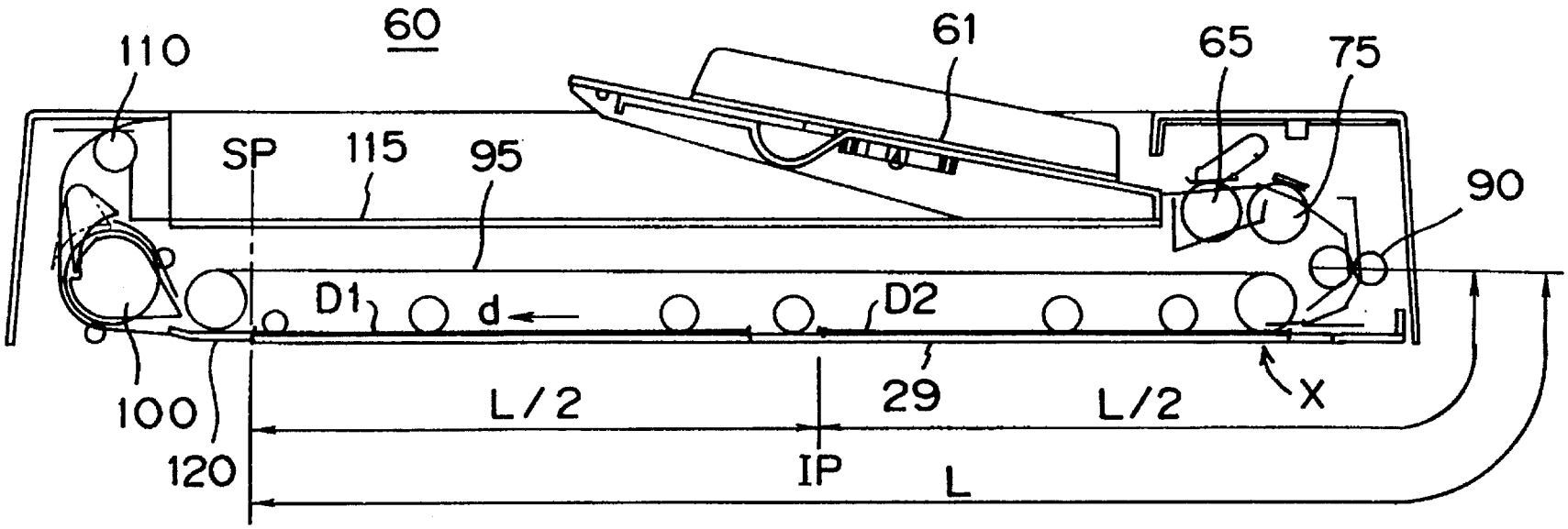
FIG. 15 is a view explaining document feeding by a stepping motor in a case that documents are stopped in a pulse control mode.
Figure 16:
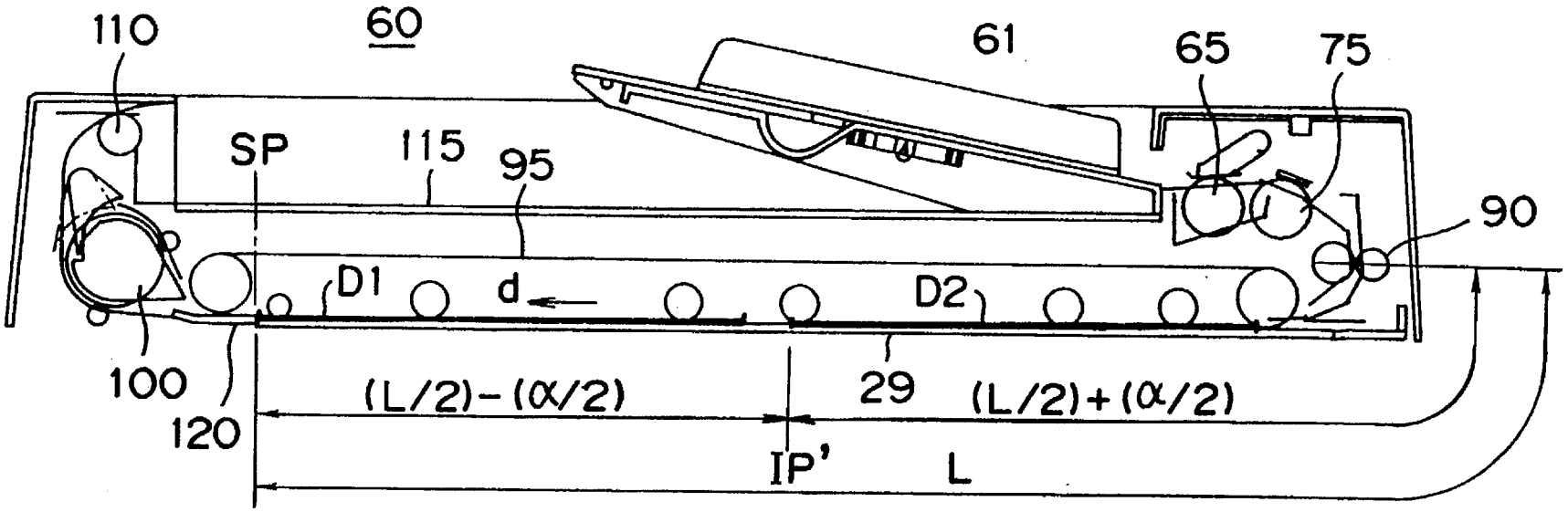
FIG. 16 is a view explaining document feeding by the stepping motor in a case that documents are stopped in a scale mode.

The pre-step mode is possible if the length of documents with respect to the feeding direction is basically shorter than a half of the distance between the scanning reference point SP and the nipping portion of the register roller pair 90. In the pre-step mode, as shown in FIGS. 15 and 16, three successive first, second and third documents D1, D2 and D3 are set in the scanning position, the pre-step position and the pre-feeding position respectively. In a combination of the pre-step mode and the pulse control mode, in changing documents, the main motor M3 is rotated forward by a number of pulses P02 corresponding to a half of the distance L between the register roller pair 90 and the scanning reference point SP, that is, the distance between the nipping portion of the register roller pair 90 and the intermediate reference point IP (see FIG. 15). After scanning of the first document D1 in the scanning position, by the rotation of the motor M3 by the number of pulses P02, the second document D2 is conveyed from the pre-step position to the scanning position, and the third document D3 is conveyed from the pre-feeding position to the pre-step position.

In a combination of the pre-step mode and the scale mode, in changing documents, the main motor M3 is rotated forward by a number of pulses P02' corresponding to a distance $(L/2)+(\alpha/2)$ (see FIG. 16). The symbol $\alpha$ denotes an overrun distance which guarantees contact of the leading edge of a document with the scale 120. Accordingly, the second document D2 is set with its leading edge positioned at a point IP' which is at a distance of $(L/2)+(\alpha/2)$ from the register roller pair 90. Then, with the rotation of the motor M3 by the number of pulses P02', the second document D2 is provided by the conveyer belt 95 with a force to move by the distance $(L/2)+(\alpha/2)$. However, when the document D2 is conveyed by a distance of $(L/2)-(\alpha/2)$, its leading edge comes into contact with the scale 120, whereby the document D2 is prevented from moving further. In other words, the conveyer belt 95 idles with respect to the document D2 by the distance $\alpha$.

Figure 5:
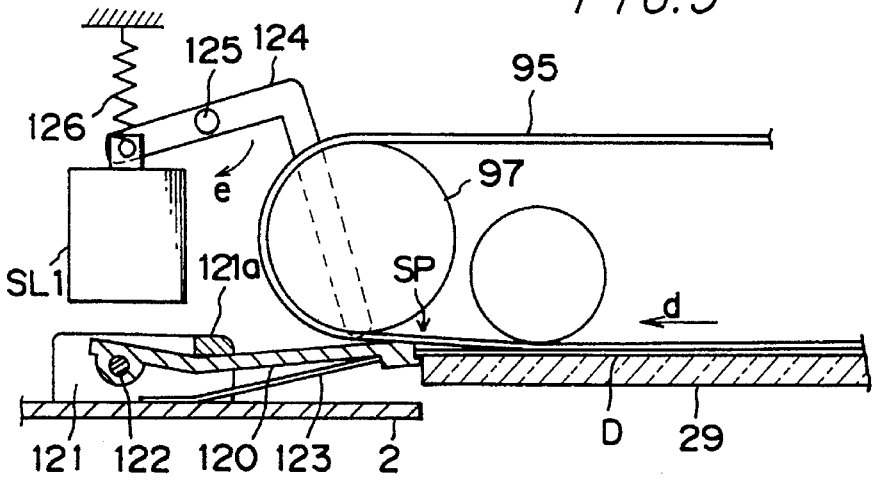
FIG. 5 is a fragmentary sectional view of the ADF showing the scanning reference point and its periphery in a state that the scale protrudes over a platen glass.

The position of the scale 120 in the scale mode has been described referring to FIGS. 4 and 5. The solenoid SL1 is usually kept off, and the scale 120 is in the retreating position shown in FIG. 4. Immediately before a document reaches the scanning position, the solenoid SL1 is turned on, and the scale 120 protrudes over the platen glass 29 as shown in FIG. 5. Then, when the main motor M3 is turned off after setting of the document in the scanning position, the solenoid SL1 is turned off, and the scale 120 comes down.

FIGS. 17*a* through 17*i* show a process of document feeding in the pre-step mode.

Figure 17A:
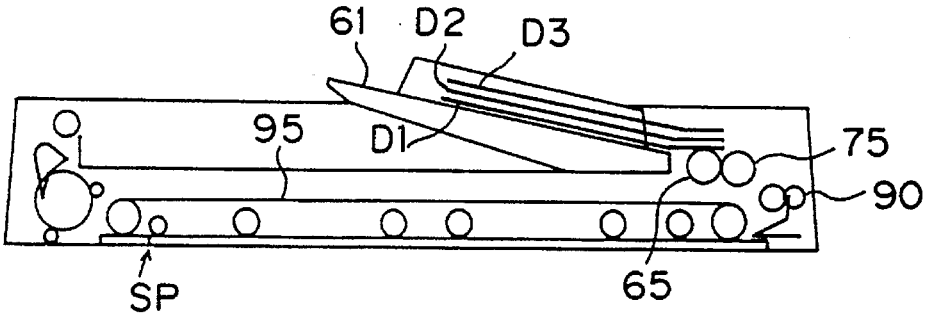
FIGS. 17*a* through 17*i* are views explaining a process of document feeding in a pre-step mode.
Figure 17B:
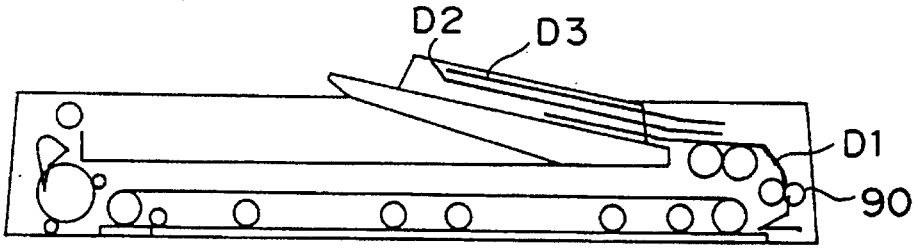
Figure 17C:
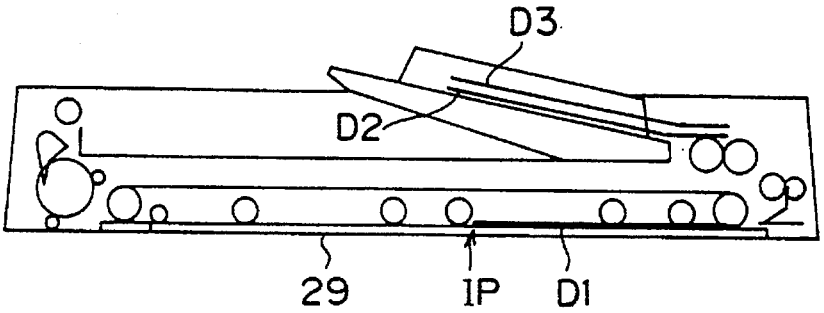
Figure 17D:
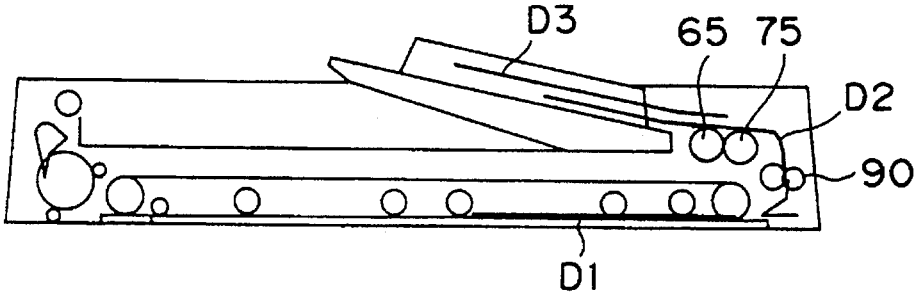
Figure 17E:
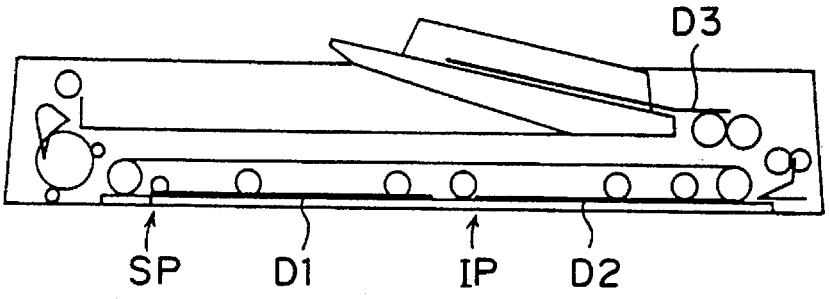
Figure 17F:
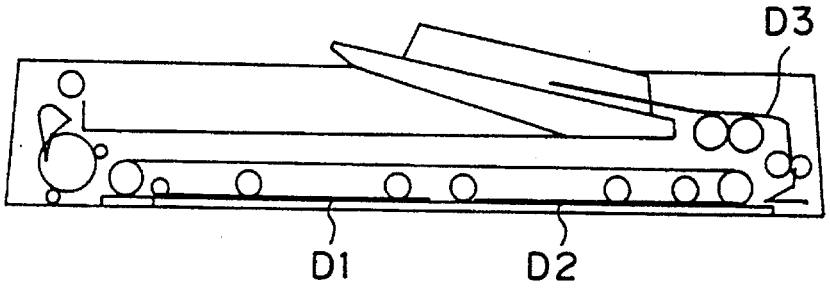
Figure 17G:
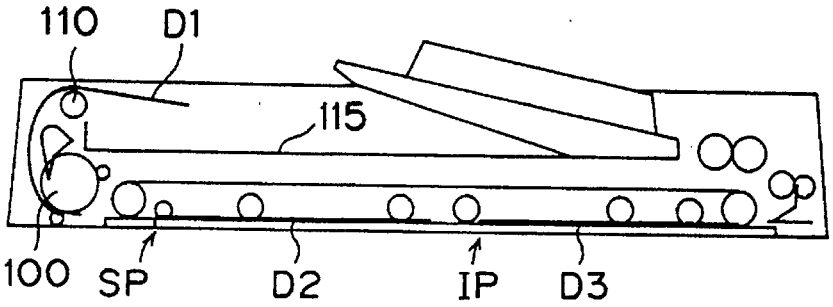
Figure 17H:
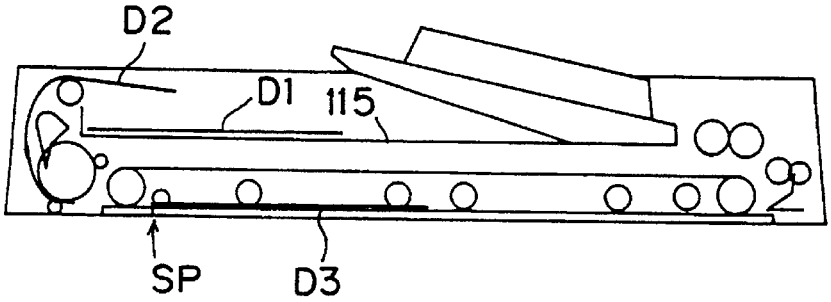
Figure 17I:
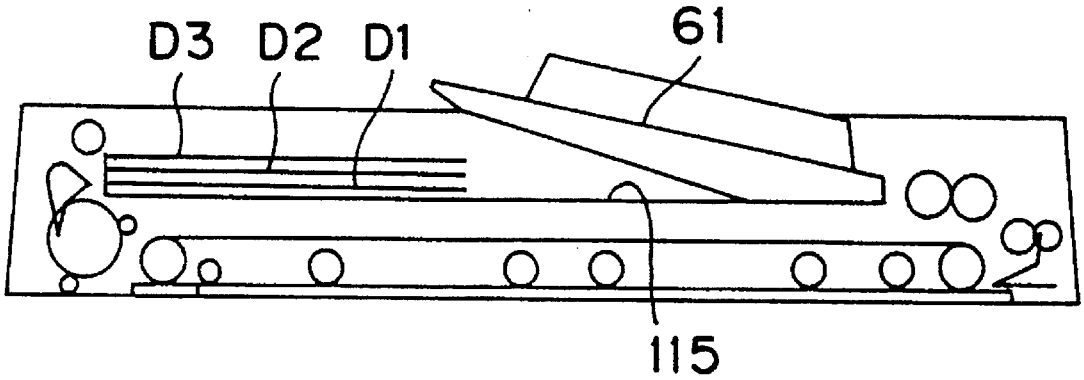

FIG. 17*a* shows a state wherein three documents D1, D2 and D3 of the small size are stacked on the tray 61. First, the leading edge regulation plate 63 moves down and retreats from the regulating position, and the pressing plate 70 moves down. The pick-up roller 65 and the separation roller 75 are rotated so as to feed the first document D1 out of the tray 61. The fed document D1 is stopped with its leading edge nipped between the register roller pair 90 (see FIG. 17*b*). Next, the main motor M3 is rotated forward by the number of pulses P02, and the document D1 is conveyed to the pre-step position (see FIG. 17*c*). Then, the pick-up roller 65 and the separation roller 75 are rotated so as to feed the second document D2 out of the tray 61, and the document D2 is stopped with its leading edge nipped between the register roller pair 90 (see FIG. 17*d*). The main motor M3 is further rotated forward by the number of pulses P02, and the documents D1 and D2 are conveyed to the scanning position and to the pre-step position respectively (see FIG. 17*e*). In this state, copy sheet feeding and scanning of the first document D1 by use of the optical system 20 are carried out a number of times corresponding to the number of copy sets to be made. During the scanning, the third document D3 is fed to the pre-feeding position (see FIG. 17*f*).

After the scanning of the first document D1, the main motor M3 is rotated forward by the number of pulses P02, and simultaneously the ejection motor M4 is turned on so as to rotate the reversing roller 100 and the ejection roller 110. Thereby, the document D1 is ejected onto the tray 115, and the documents D2 and D3 are conveyed to the scanning position and the pre-step position respectively (see FIG. 17*g*). In this state, scanning of the second document D2 is carried out. After the scanning, the main motor M3 is rotated forward by the number of pulses P02, and the ejection motor M4 is turned on. Thereby, the document D2 is ejected onto the tray 115, and the third document D3 is conveyed to the scanning position (see FIG. 17*h*). After scanning of the document D3, the main motor M3 and the ejection motor M4 are turned on, and thereby the document D3 is ejected onto the tray 115 (see FIG. 17*i*).

In this embodiment, when the sensor SE2 detects the trailing edge of a document conveyed onto the platen glass 29 from the pre-feeding position, the empty sensor SE1 is checked. If there is a document on the tray 61, the document is fed out of the tray 61 to the pre-feeding position. If there are no documents on the tray 61, the leading edge regulation plate 63 is returned to the regulating position.

As has been described, in the pre-step mode, documents are fed intermittently by a distance of L/2, thereby shortening the time for changing documents. More specifically, it makes possible to change documents within a time while the optical system 20 is returning to its home position after scanning. Consequently, the productivity of the copying apparatus is improved. Feeding of a third document to the pre-feeding position during scanning of a first document especially contributes to the improvement in the productivity.

As shown in FIG. 14, the register roller pair 90 and the conveyer belt 95 have the same driving source, the main motor M3, and no clutch is provided in-between. Additionally, the main motor M3 is a stepping motor driven by pulses. Therefore by controlling the number of pulses supplied to the motor M3, the conveying of a document from the register roller pair 90 to the scanning position is carried out accurately. The motor M3 does not need to be a stepping motor, and in order to obtain the same effect, the following structure is possible. An encoder is fitted to the rotating shaft of the motor M3, and the number of rotations of the motor M3 is converted into the number of pulses such that the figured number of pulses is used to control turning-on and turning-off of the motor M3.

Now the productivity of a copying machine is described.

The ratio of the speed of single copying (making a single copy from an original document) of a plurality of documents using an ADF to the speed of multiple copying (making a plurality of copies from an original document) is referred to as the copy productivity of the ADF. Accordingly, single copying using an ADF with 100% copy productivity has the same copying speed as multiple copying. Table 1 shows conditions of a copying machine to attain each copying speed. As the conditions, a scanning speed of the optical system, a copying time which the copying machine takes for making a single copy, a scanning time which the optical system takes for scanning an original document, a returning time which the optical system takes for returning to its home position are provided.

TABLE 1

| | | | |
|---|---|---|---|
| copying speed (cpm) | 60 | 45 | 25 |
| scanning speed (mm/sec) | 340 | 270 | 150 |
| copying time (sec) | 1.0 | 1.33 | 2.4 |
| scanning time (sec) | 0.62 | 0.78 | 1.4 |
| returning time (sec) | 0.38 | 0.55 | 1.0 |

cpm: copies per minute

For the present, copying machines are classified into three kinds according to the copying speed. In connection with the kind which has the highest copying speed (60 cpm), the returning time of the optical system is 0.38 sec. In order to attain 100% copy productivity with this kind of copying machine, an ADF which can change original documents within the returning time of 0.38 sec must be combined. The ADF 60 according to the present invention, as described above, is free from mechanical inaccuracy because the register roller pair 90 and the conveyer belt 95 are connected by the motor M3 with no clutches in-between. Further, the motor M3 is controlled by pulses, and the number of pulses is determined in accordance with a conveying distance from the register roller pair 90. Thus, the ADF 60 makes it possible to change documents very quickly and accurately.

On the other hand, a copying machine with a lower copying speed does not have to be combined with an ADF with a high document conveying speed. If the document conveying speed of the ADF is high compared with the copying speed of the copying machine, the ADF generates excess noise and has a short life. In the light of this point, in this embodiment, the document conveying speed of the ADF 60 can be changed in accordance with the copying speed of the copying apparatus body 1. More specifically, a copying speed signal is sent from a control section of the copying apparatus body 1 to a control section of the ADF 60, and the control section of the ADF 60 adjusts the rotating speeds of the motors to the copying speed.

Additionally, the ADF 60 can be so made that the document conveying speed can be set to one of some optional values by use of a dip switch regardless of the copying speed of the apparatus body 1.

Next, the two-in-one mode is described.

In the two-in-one mode, two original documents are placed on the platen glass 29 side by side and copied onto a single copy sheet. FIGS. 18*a* through 18*l* show a process of document feeding in the two-in-one mode.

Figure 18A:
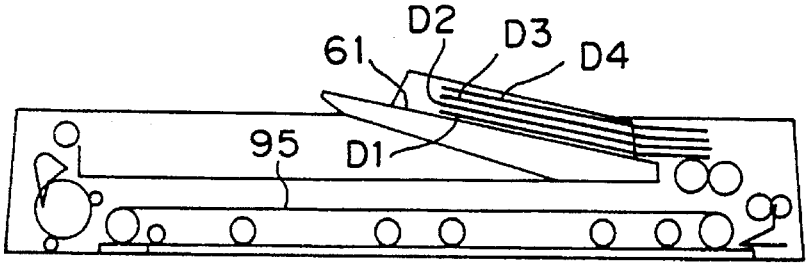
FIGS. 18*a* through 18*l* are views explaining a process of document feeding in a two-in-one mode.
Figure 18B:
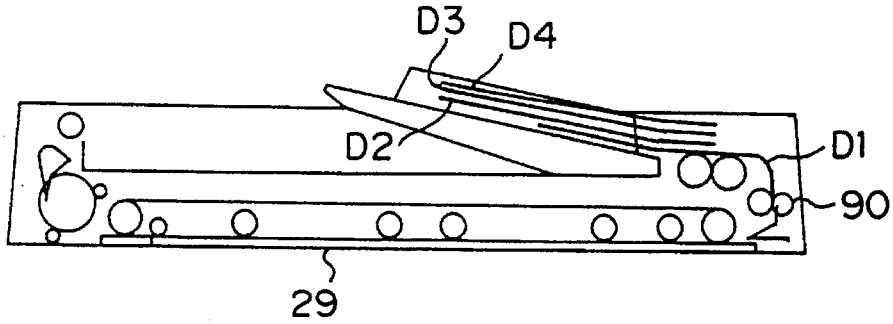
Figure 18C:
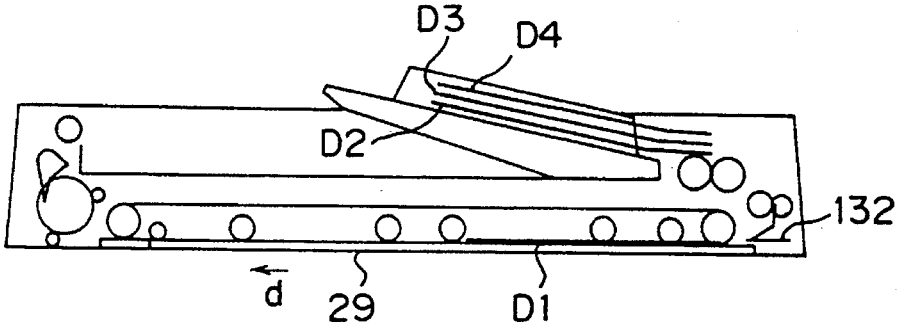
Figure 18D:
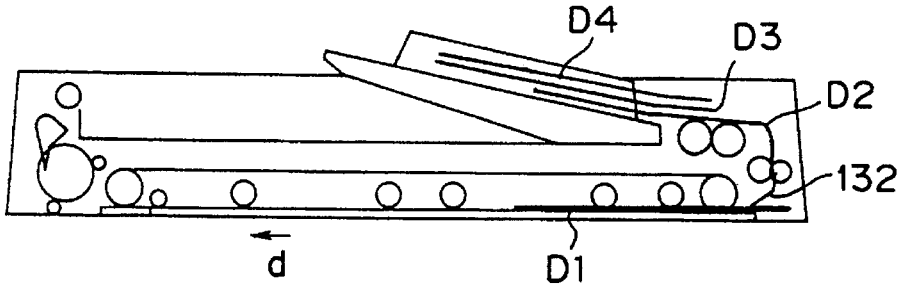
Figure 18E:
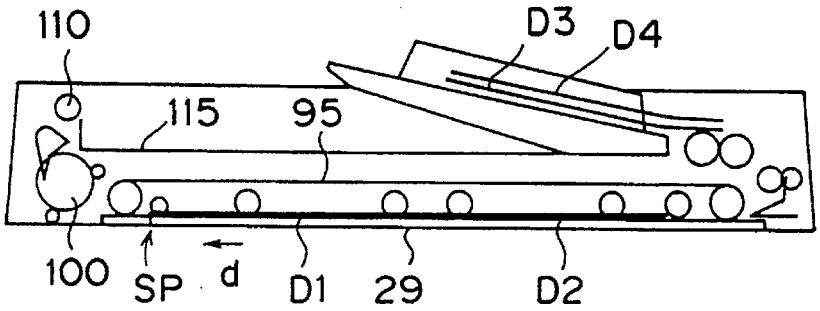
Figure 18F:
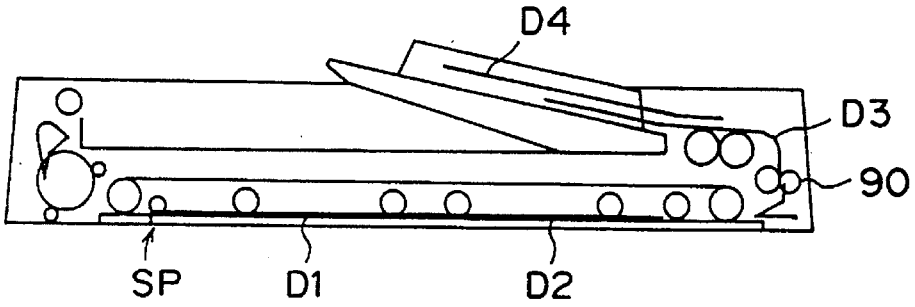
Figure 18G:
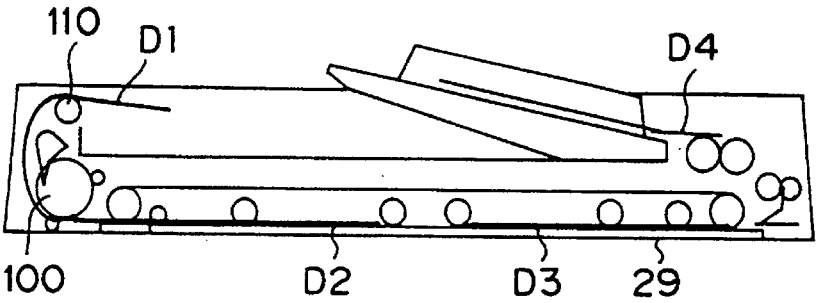
Figure 18H:
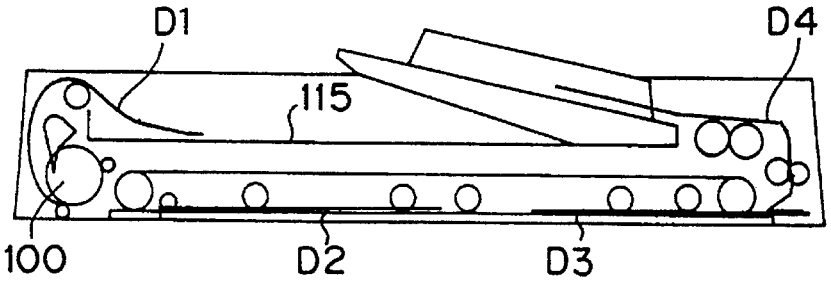
Figure 18I:
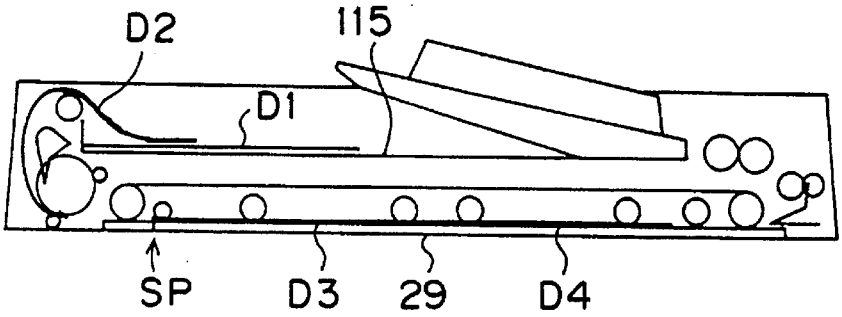
Figure 18J:
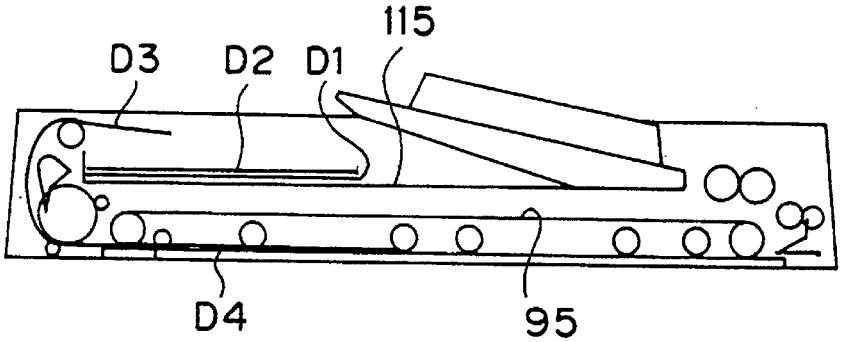
Figure 18K:
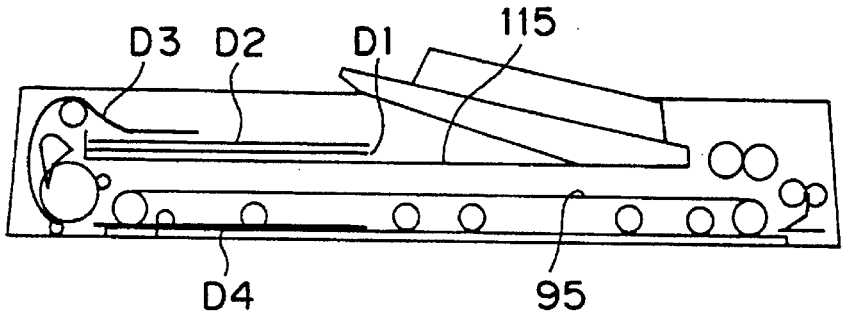
Figure 18L:
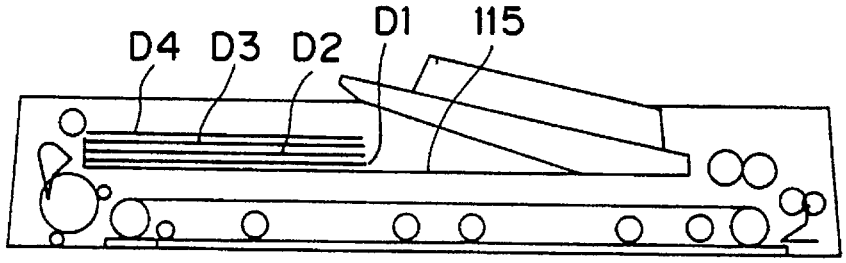

FIG. 18*a* is a state wherein four documents D1, D2, D3 and D4 of the small size are stacked on the tray 61. First, the first document D1 is fed out of the tray 61 and stopped with its leading edge nipped between the register roller pair 90 (see FIG. 18*b*). Next, the main motor M3 is rotated forward, whereby the document D1 is fed onto the platen glass 29. When the trailing edge of the document D1 reaches the platen glass 29 (see FIG. 18*c*), the main motor M3 is reversed to move the document D1 in a direction opposite to arrow d. In other words, the document D1 makes a switchback. Thereby, the trailing edge of the document D1 comes under the guide plate 132 (see FIG. 18*d*). The amount of the switchback corresponds to a distance from the trailing edge of the document D1 stopped on the platen glass 29 to the nipping portion of the register roller pair 90. In order to prevent the document D1 from returning to the register roller pair 90 at that time, a resin film 133 is fitted on the guide plate 132 (see FIG. 2). A specified time after the sensor SE2 detects the first document D1, pre-feeding of the second document D2 is started. Then, immediately after the switchback of the first document D1 is finished, the second document D2 comes and stops with its leading portion nipped between the register roller pair 90 (see FIG. 18*d*).

Next, the main motor M3 is rotated forward to convey the documents D1 and D2 on the platen glass 29, and when the leading edge of the first document D1 comes to the scanning reference point SP, tile main motor M3 is turned off. Thus, the documents D1 and D2 are placed on the platen glass 29 side by side (see FIG. 18*e*). The rotating speed of the motor M3 is decreased immediately before the leading edge of the document D1 reaches the scanning reference point SP. In synchronization with the decrease in the rotating speed of the motor M3, pre-feeding of the third document D3 is started. During scanning of the documents D1 and D2, the document D3 is fed out of the tray 61 and stopped with its leading edge nipped between the register roller pair 90 (see FIG. 18*f*).

After the scanning of the documents D1 and D2, the main motor M3 is rotated forward, and simultaneously the ejection motor M4 is rotated. Thereby, the document D1 is ejected onto the tray 115 by the reversing roller 100 and the ejection roller 110, the document D2 follows the document D1, and the document D3 is fed onto the platen glass 29 (see FIG. 18*g*). When the trailing edge of the document D3 comes onto the platen glass 29, the main motor M3 is reversed, and thereby the document D3 makes a switchback as the document D1 did. At that time, the document D1 is provided with a force by the reversing roller 100 and conveyed toward the tray 115, whereas the document D2 is not under the force of the reversing roller 110 and moves back together with the document D3 (see FIG. 18*h*). Immediately after the switchback of the document D3, the fourth document D4 is fed to the pre-feeding position.

The ejection motor M4 continues rotating, and the main motor M3 is rotated forward. The main motor M3 continues the forward rotation until the leading edge of the document D3 comes to the scanning reference point SP. Thereby, the documents D3 and D4 are placed on the platen glass 29 side by side, and the document D2 is ejected onto the tray 115. When the ejection of the document D2 finishes, the ejection motor M4 is turned off. As mentioned, during the ejection of the documents D1 and D2, the main motor M3 is reversed for the switchback of the document D3, and this makes a space between the documents D1 and D2. The space prevents misalignment and page disorder of documents on the tray 115 which may be caused by a push of the second document D2 to the first document D1.

After scanning of the documents D3 and D4, the main motor M3 is rotated forward, and simultaneously the ejection roller M4 is rotated. When the trailing edge of the document D3 separates from the conveyer belt 95, the main motor M3 is once turned off (see FIG. 18*j*). The main motor M3 is kept off for a time to make a space between the documents D3 and D4 sufficiently to prevent misalignment and page disorder of documents on the tray 115 (see FIG. 18*k*). Then, the main motor M3 is rotated forward, and the document D4 is ejected onto the tray 115 (see FIG. 18*l*).

If a stack of documents to be fed in the two-in-mode or in the pre-step mode contains a document of a size larger than a half of the platen glass 29, a special control is required temporarily during the feeding. The feeding operation of the ADF 60 in such a case is described.

FIGS. 19*a* through 19*k* show a process of document feeding in the two-in-one mode in a case that a document of the large size is present in the stack as a sheet of an odd number from the bottom.

Figure 19A:
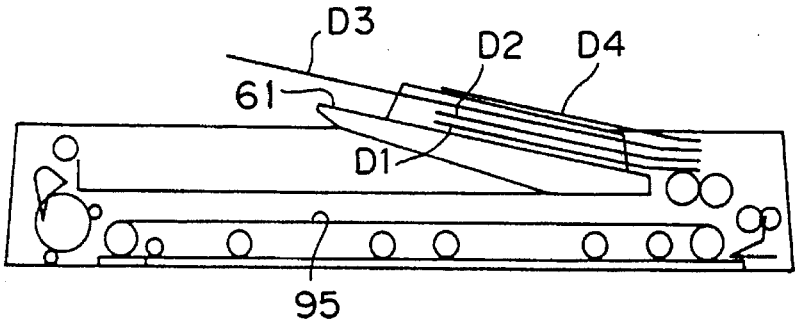
FIGS. 19*a* through 19*k* are views explaining a process of document feeding in the two-in-one mode in a case that a large size document is present in a stack of documents as a sheet of an odd number from the bottom.
Figure 19B:
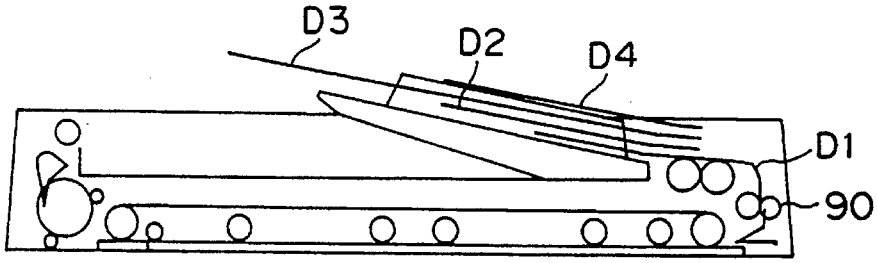
Figure 19C:
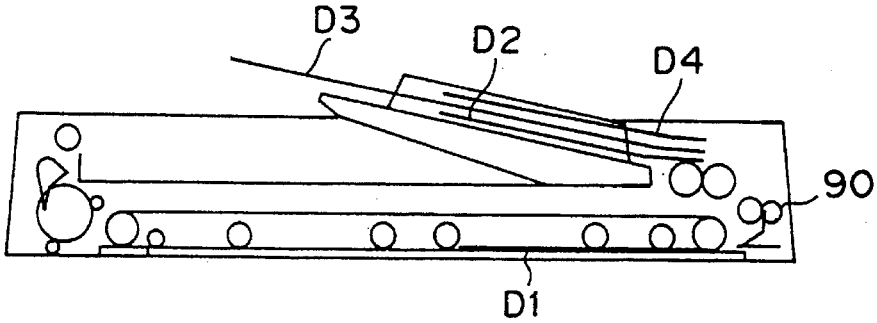
Figure 19D:
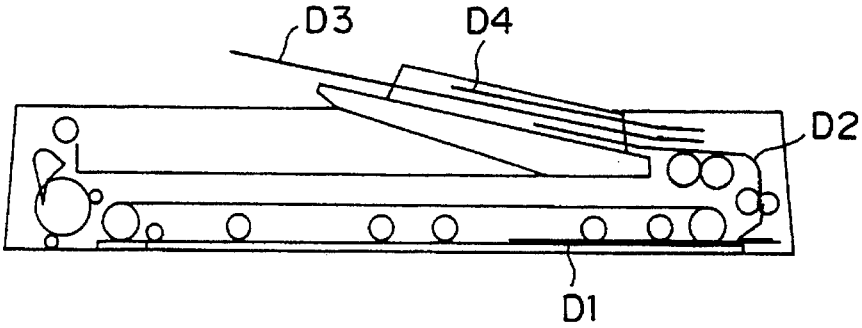
Figure 19E:
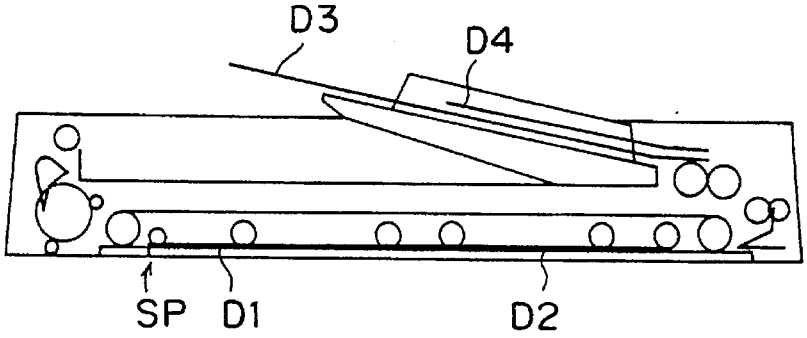
Figure 19F:
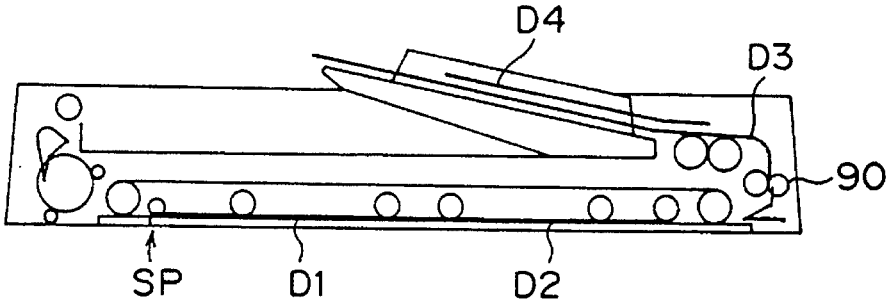
Figure 19G:
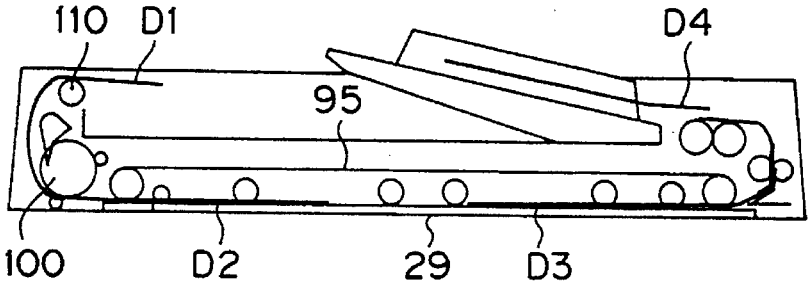
Figure 19H:
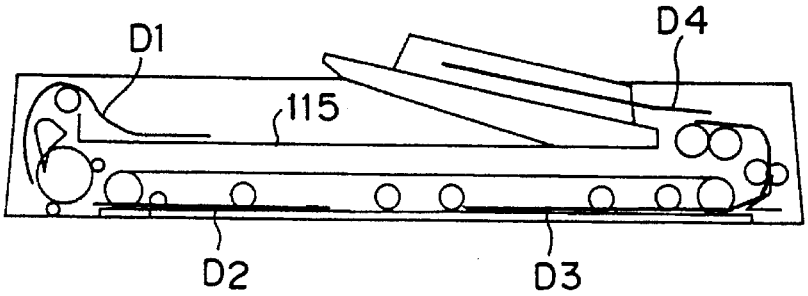
Figure 19I:
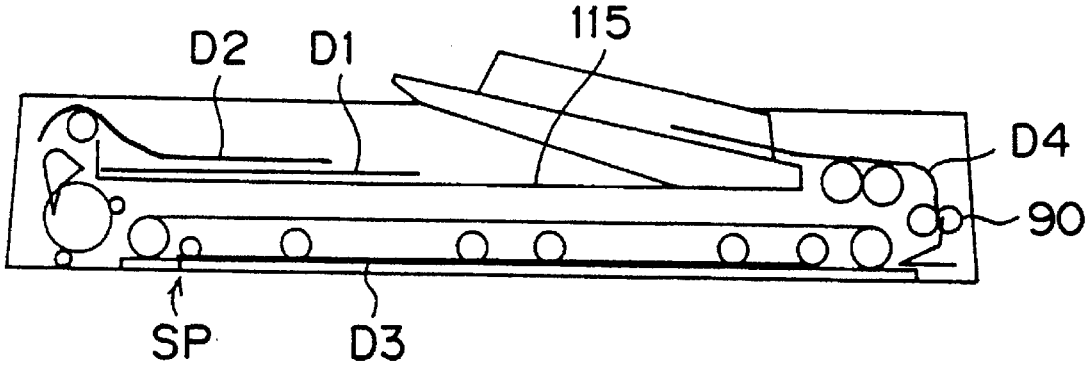
Figure 19J:
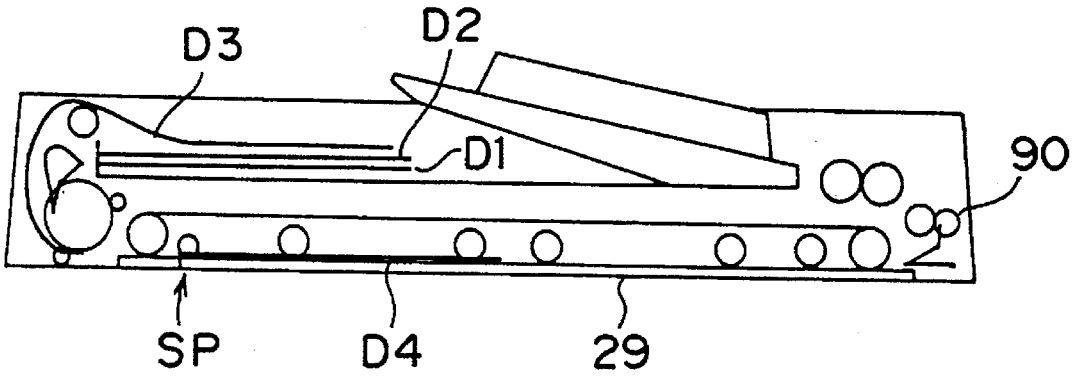
Figure 19K:
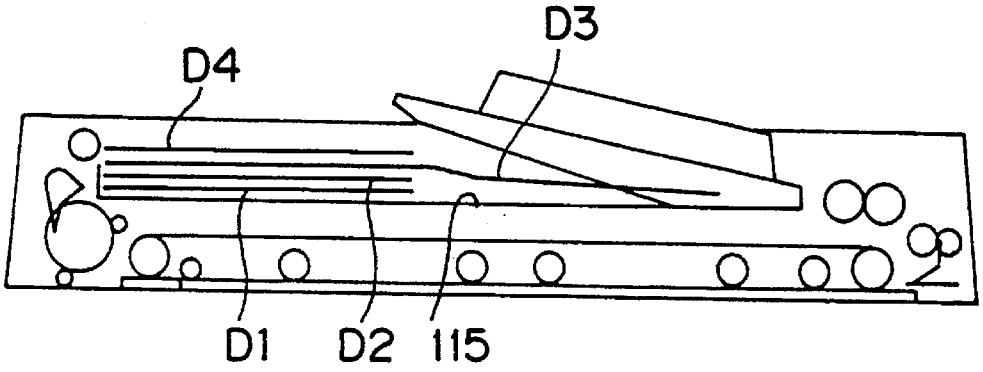

FIG. 19*a* shows a state wherein four documents D1, D2, D3 and D4 are stacked on the tray 61 and the document D3 is of the large size. Pre-feeding of the first document D1 to the register roller pair 90 (see FIG. 19*b*), feeding the document D1 from the register roller pair 90 onto the platen glass 29 (see FIG. 19*c*), switchback of the first document D1 and pre-feeding of the second document D2 (see FIG. 19*d*), positioning the documents D1 and D2 in the scanning position (see FIG. 19*e*), and pre-feeding of the third document D3 (see FIG. 19*f*) are carried out in the same manner as the above-described ordinary case (see FIG. 18*a* through 18*e*). After scanning of the documents D1 and D2, the main motor M3 and the ejection motor M4 are rotated. Thereby, while the document D1 is being ejected by the reversing roller 100 and the ejection roller 110, the third document D3 is fed onto the platen glass 29. At that time, it is detected by the sensor SE2 and the timer that the document D3 is of the large size. In this case, the main motor M3 is turned off when the trailing edge of the document D1 separates from the conveyer belt 95 (see FIG. 19*g*), whereas the ejection motor M4 continues rotating. This makes a space between the documents D1 and D2. Thereafter, the main motor M3 is rotated again (see FIG. 19*h*). With this rotation of the main motor M3, the document D2 is ejected onto the tray 115 following the document D1 with the space (the rotating speed of the main motor M3 may be temporarily decreased), and the document D3 is conveyed on the platen glass 29. When the leading edge of the document D3 comes to the scanning reference point SP, the main motor M3 is turned off (see FIG. 19*i*). Thus, the document D3 of the large size is conveyed to the scanning position without making a switchback, and during the conveyance of the document D3, the fourth document D4 is fed to the register roller pair 90. In this way, because the third document D3 is of the large size, the pre-feeding of the fourth document D4 is delayed.

After scanning of the third document D3, the main motor M3 and the ejection motor M4 are rotated. Thereby, the document D3 is ejected onto the tray 115, and the document D4 is conveyed onto the platen glass 29. When the leading edge of the document D4 comes to the scanning reference point SP, the main motor M3 is turned off (see FIG. 19*j*). After scanning of the document D4, the main motor M3 and the ejection motor M4 are rotated, whereby the document D4 is ejected onto the tray 115 (see FIG. 19*k*).

FIGS. 20*a* through 20*i* show a process of document feeding in the two-in-one mode in a case that a document of the large size is present in the stack as a sheet of an even number from the bottom.

Figure 20A:
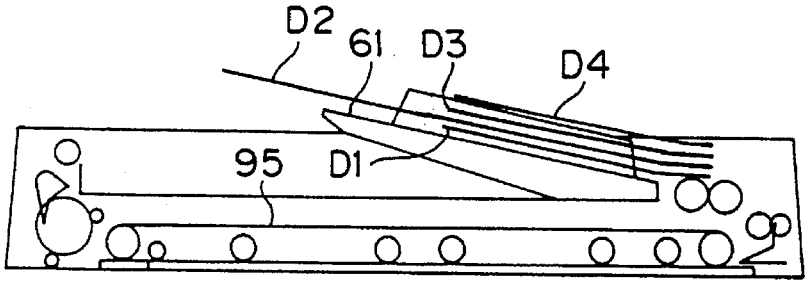
FIGS. 20*a* through 20*i* are views explaining a process of document feeding in the two-in-one mode in a case that a large size document is present in a stack of documents as a sheet of an even number from the bottom.
Figure 20B:
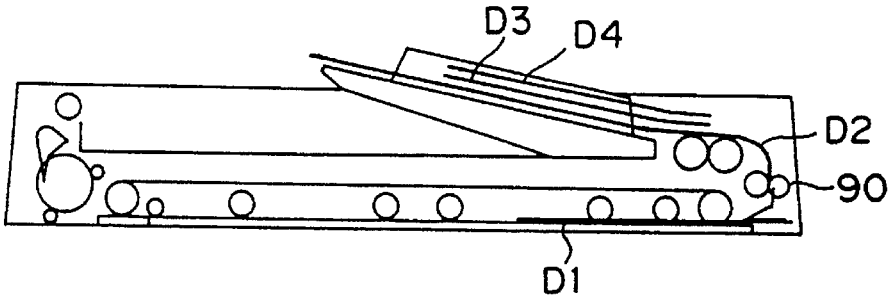

FIG. 20*a* shows a state wherein four documents D1, D2, D3 and D4 are stacked on the tray 61 and the second document D2 is of the large size. As shown in FIG. 20*b*, pre-feeding of the first document D1, feeding of the document D1 from the register roller pair 90 onto the platen glass 29, switchback of the document D1 and pre-feeding of the second document D2 are carried out in the same manner as the ordinary case (see FIGS. 18*a* through 18*e*). Thereafter, the main motor M3 is rotated forward to convey the documents D1 and D2 with no space in-between. When the leading edge of the document D1 comes to the scanning reference point SP, the main motor M3 is turned off. During the conveyance of the document D2, it is detected by the sensor SE2 and the timer that the document D2 is of the large size, and accordingly pre-feeding of the third document D3 is temporarily inhibited (see FIG. 20*c*). Additionally, in this case, detection of sheet jamming is not carried out.

Figure 20C:
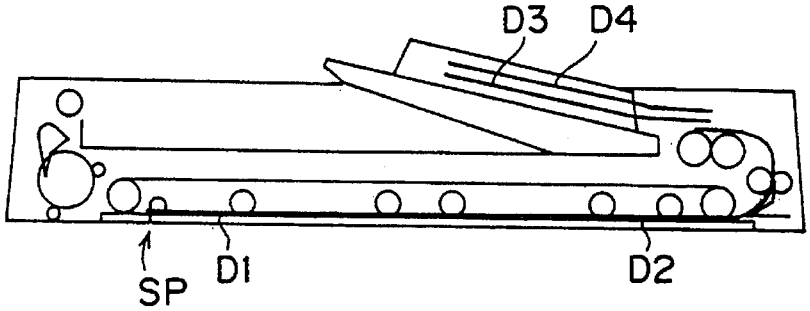
Figure 20D:
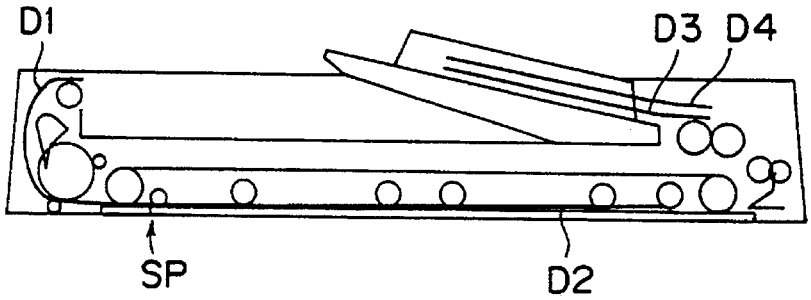
Figure 20E:
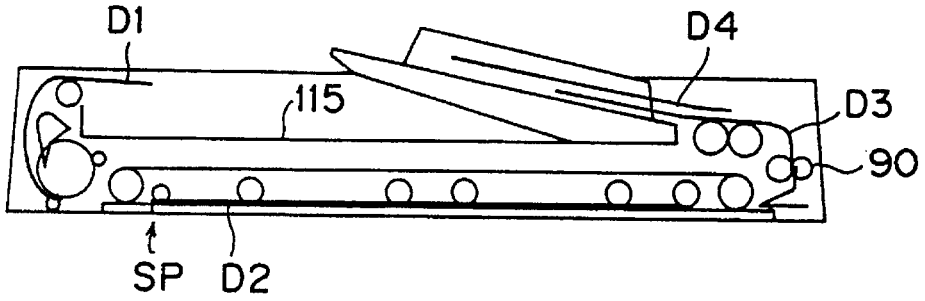
Figure 20F:
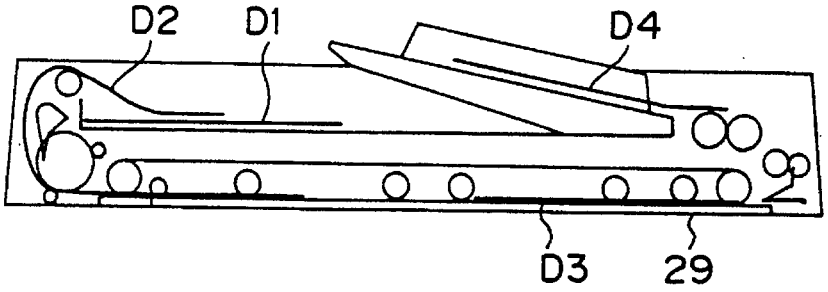
Figure 20G:
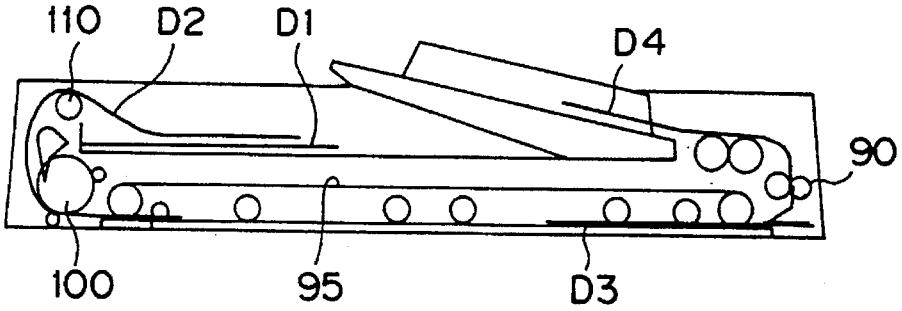

In the state of FIG. 20*c*, only the document D1 is subjected to copying operation. Specifically, the optical system 20 is controlled such that the scanning length corresponds to the length of the document D1. Alternatively, not changing the scanning length, an image of the second document D2 reproduced on the photosensitive drum 10 is erased by the sub eraser 13.

After the scanning of the document D1, the main motor M3 and the ejection motor M4 are rotated. When the leading edge of the document D2 comes to the scanning reference point SP, the main motor M3 is turned off (see FIG. 20*d*). By this moment, pre-feeding of the third document D3 is started, and the document D3 is stopped with its leading edge nipped between the register roller pair 90 (see FIG. 20*e*). Meanwhile, when the document D1 is ejected onto the tray 115, the ejection motor M4 is turned off.

After scanning of the document D2, the main motor M3 and the ejection motor M4 are rotated. When the trailing edge of the document D3 reaches the platen glass 29, the main motor M3 is reversed (see FIG. 20*f*). Thereby, the document D3 makes a switchback, and simultaneously the fourth document D4 is fed to the register roller pair 90 (see FIG. 20*g*). Meanwhile, the document D2 is ejected by the reversing roller 100 and the ejection roller 110, and the ejection is continued even after the main motor M3 is reversed because the force of the reversing roller 100 is larger than that of the conveyer belt 95.

Figure 20H:
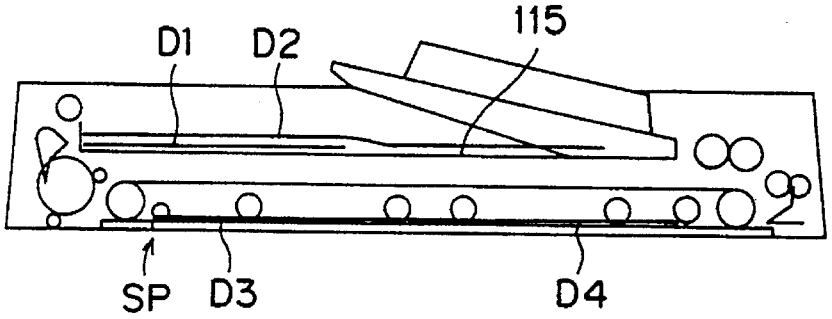

On the completion of the switchback of the document D3 and the pre-feeding of the document D4, the main motor M3 is rotated forward, and when the leading edge of the document D3 comes to the scanning reference point SP, the main motor M3 is turned off (see FIG. 20*h*). By this moment, the document D2 is ejected onto the tray 115.

Figure 20I:
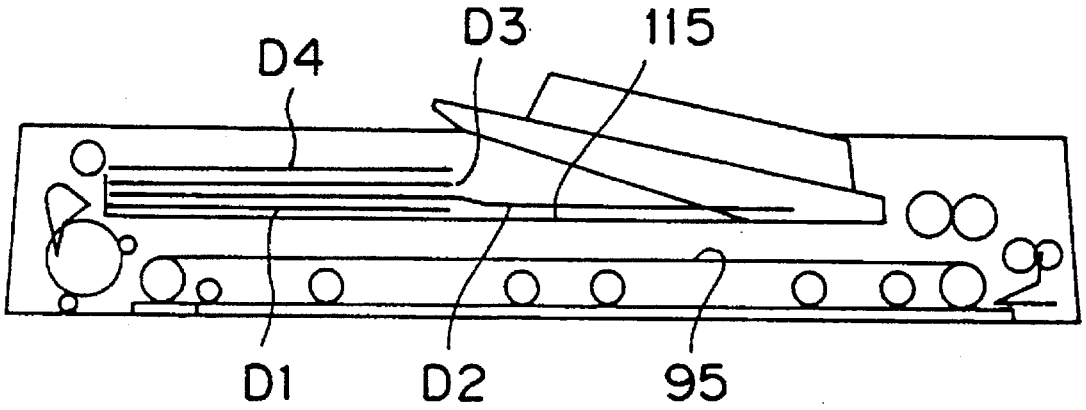

After scanning of the documents D3 and D4, the main motor M3 and the ejection motor M4 are rotated, whereby the documents D3 and D4 are ejected onto the tray 115 (see FIG. 20*i*). During the ejection, when the trailing edge of the document D3 separates from the conveyer belt 95, the main motor M3 is once turned off. Thereby, a space is made between the documents D3 and D4, and this prevents disorder of documents on the tray 115.

FIGS. 21*a* through 21*h* show a process of document feeding in the pre-step mode in a case that a document of the large size is present in the stack of documents.

Figure 21A:
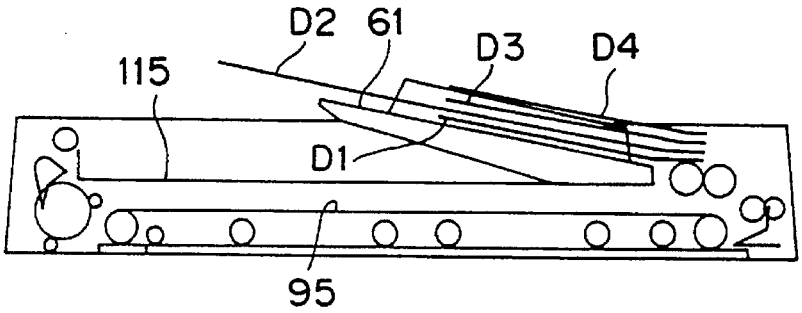
FIGS. 21*a* through 21*h* are views explaining a process of document feeding in the pre-step mode in a case that a large size document is present in a stack of documents.

FIG. 21*a* shows a state wherein four documents D1, D2, D3 and D4 are stacked on the tray 61 and the second document D2 is of the large size.

Figure 21B:
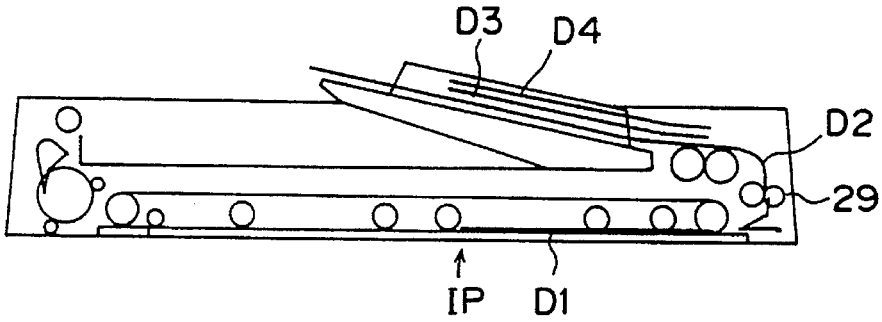
Figure 21C:
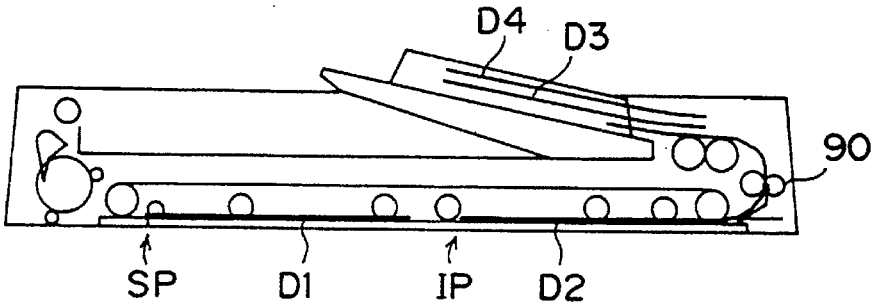
Figure 21D:
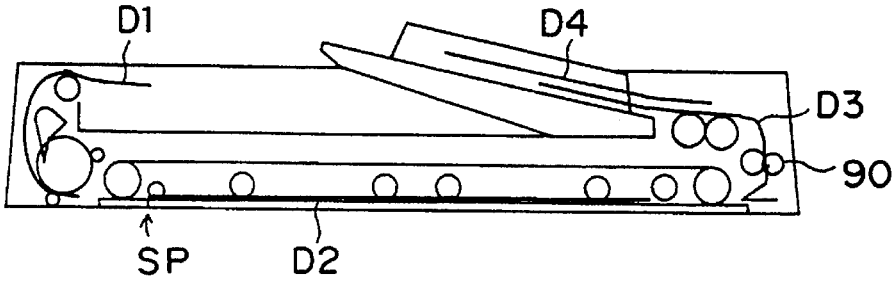
Figure 21E:
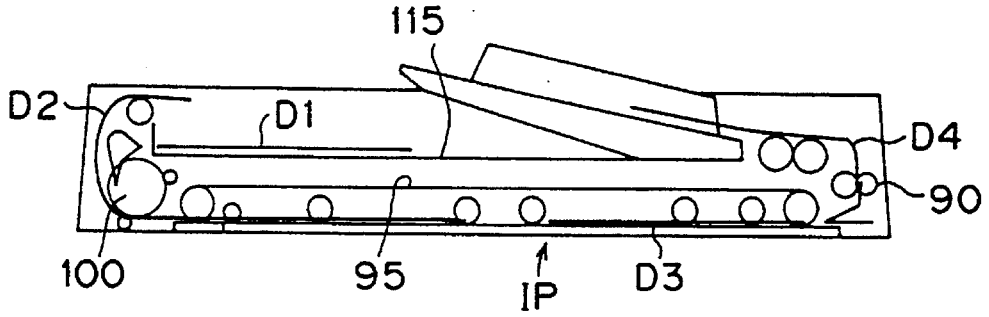

As shown in FIG. 21*b*, pre-feeding of the first document D1, conveyance of the document D1 to the pre-step position and pre-feeding of the second document D2 are carried out in the same manner as the above-described ordinary case (see FIGS. 17*a* through 17*d*). Then, the main motor M3 is rotated forward by the number of pulses P02, whereby the document D1 is placed in the scanning position. Simultaneously, the document D2 is conveyed to the pre-step position where its leading edge is at the intermediate reference point IP. Since the document D2 is of the large size, the document D2 is still nipped between the register roller pair 90. Accordingly, it is detected by the sensor SE2 and the timer that the document D2 is of the large size, and pre-feeding of the third document D3 is temporarily inhibited (see FIG. 21*c*). Also, detection of sheet jamming is not carried out. In this state, the document D1 is scanned. After the scanning, the main motor M3 is rotated forward by the number of pulses P02, and also the ejection motor M4 is rotated. Thereby, the document D1 is ejected onto the tray 115, and the document D2 is conveyed to the scanning position (see FIG. 21*d*). Meanwhile, the third document D3 is fed to the register roller pair 90 (pre-feeding position).

In this state, the document D2 is subjected to copying operation. Because the document D2 is of the large size, the copying is carried out in a book division copying mode. The book division copying mode is a mode wherein a large sized document is divided into two regions, former region A and latter region B, and images of the regions A and B are copied separately. After the copying, the main motor M3 is rotated forward by the number of pulses P02, and the ejection motor M4 is rotated. Thereby, the document D3 is conveyed to the pre-step position (see FIG. 21*e*). Meanwhile, the document D2 is provided with a force toward the tray 115 by the reversing roller 110 even after the motor M3 is turned off. Further, the document D4 is fed to the pre-feeding position.

Figure 21F:
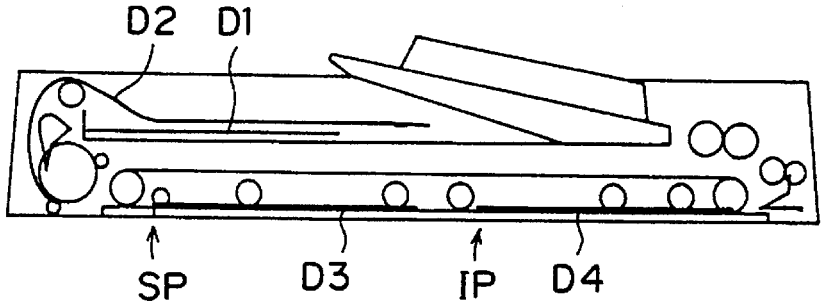
Figure 21G:
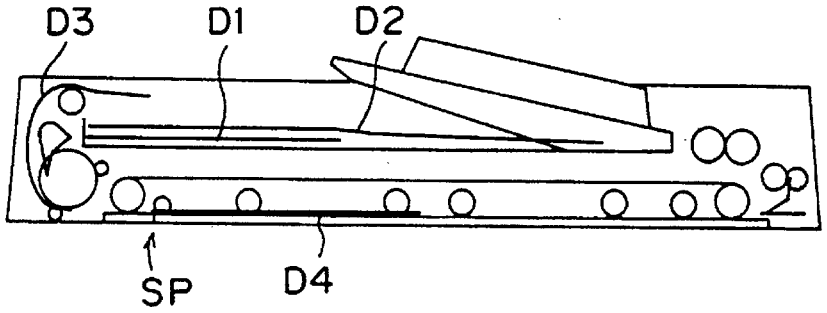
Figure 21H:
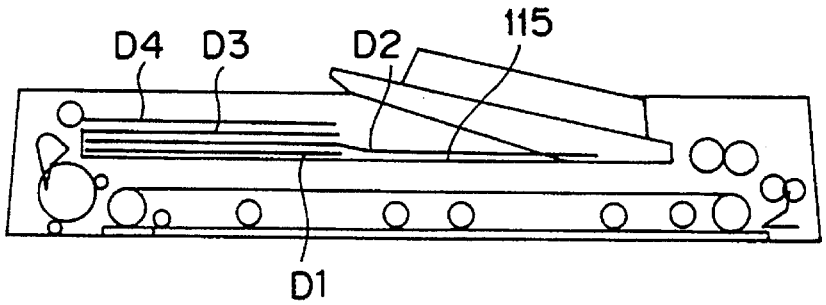

Next, the main motor M3 is rotated forward by the number of pulses P02, whereby the document D3 and the document D4 are conveyed to the scanning position and to the pre-step position respectively (see FIG. 21*f*). The ejection of the document D2 is continued, and on the completion of the ejection, the ejection motor M4 is turned off. Meanwhile, the document D3 is scanned. After the scanning, the main motor M3 is rotated forward by the number of pulses P02, and the ejection motor M4 is rotated. Thereby, the document D3 is ejected onto the tray 115, and the document D4 is conveyed to the scanning position (see FIG. 21*g*). After scanning of the document D4, the main motor M3 and the ejection motor M4 are rotated, whereby the document D4 is ejected onto the tray 115 (see FIG. 21*h*).

As mentioned, when the document D2 of the large size is set to the scanning position (see FIG. 21*d*), book division copying is carried out. However, it is also possible to convey the document D2 by a half of its length after copying of the former half region such that the middle of the document D2 will be positioned at the scanning reference point SP and that the latter half region will be copied.

The ADF 60 which has been described above is a first embodiment wherein the register roller pair 90 and the conveyer belt 95 are driven by the main motor M3 and the reversing roller 100 and the ejection roller 110 are driven by the ejection motor M4. In the following, a second embodiment wherein the reversing roller 100 and the ejection roller 110 are also driven by the main motor M3 is described.

Figure 22:
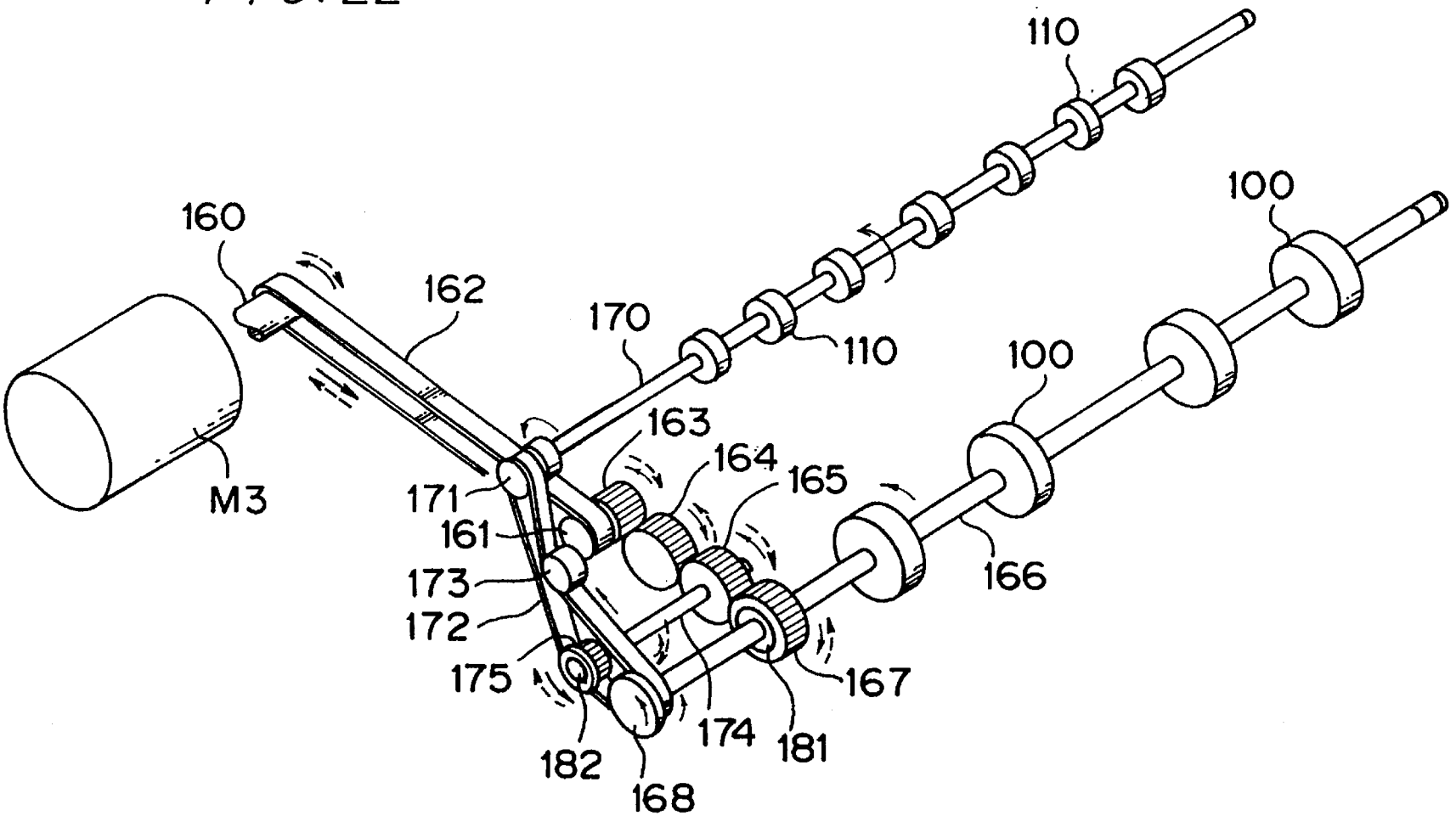
FIG. 22 is a perspective view of a driving mechanism of a reversing roller and an ejection roller according to a second embodiment in which a main motor is also used as an ejection motor.

FIG. 22 shows a driving mechanism of the second embodiment. A pulley 160 is fixed to the output shaft of the main motor M3, and a timing belt 162 is stretched between the pulley 161 and a pulley 161. A gear 163 is fixed to the shaft of the pulley 161, and a gear 167 is fitted to the shaft 166 of the reversing roller 100. Between the gears 163 and 167, gears 164 and 165 are provided. At an end of the shaft 166, a pulley 168 is fixed. At an end of the shaft 170 of the ejection roller 110, a pulley 171 is fixed, and at an end of the shaft of the gear 165, a pulley 175 is fitted. A timing belt 172 is stretched among the pulleys 168, 171 and 175. The timing belt 172 is provided with a tension by a roller 173.

Further, one-way clutches 181 and 182 are provided between the gear 167 and the shaft 166 and between the pulley 175 and the shaft 174. The one-way clutch 181 does not transmit rotation of the gear 167 in a direction indicated with a solid arrow but transmits rotation of the gear 167 in a direction indicated with a dashed arrow to the shaft 166. The one-way clutch 182 transmits rotation of the shaft 174 in a direction indicated with a solid arrow to the pulley 175 but does not transmit rotation of the shaft 174 in a direction indicated with a dashed arrow.

The one-way clutches 181 and 182 are provided to maintain forward rotation of the reversing roller 100 and the ejection roller 110 while the main motor M3 is rotated in reverse so as to reverse the conveyer belt 95 for a switchback of a document. In the structure, the reversing roller 100 and the ejection roller 110 always rotate forward, that is, in the document ejecting direction, whether the main motor M3 is rotated forward or in reverse.

More specifically, while the main motor M3 is rotated forward, the members rotate in directions indicated with solid arrows. At that time, as mentioned, the one-way clutch does not transmit the rotation of the gear 167 in the direction indicated with the solid arrow to the shaft 166. On the other hand, the rotation of the gear 165 in the direction of the solid arrow is transmitted to the pulley 175 via the shaft and the one-way clutch 182. Further, the rotation of the pulley 175 is transmitted to the timing belt 172. With the rotation of the timing belt 172 in a direction indicated with a solid arrow, the reversing roller 100 is rotated forward via the pulley 168 and the shaft 166, and the ejection roller 110 is rotated forward via the pulley 171 and the shaft 170.

While the main motor M3 is reversed, the pulleys 160 and 161, the timing belt 162, and the gears 163, 164, 165 and 167 rotate in directions with dashed arrows. The shaft 175 of the gear 165 is also rotated in a direction indicated with a dashed arrow, but the rotation is not transmitted to the pulley 175 because of the one-way clutch 182. On the other hand, the rotation of the gear 167 in the direction indicated with the dashed arrow is transmitted to the shaft 166 via the one-way clutch 181, and thereby the reversing roller 100 continues rotating forward. In this state, the pulley 175 rotates following the timing belt 172. However, since the one-way clutch 182 is off, the shaft 174 and the pulley 175 idle with respect to each other and rotate in the opposite direction.

FIGS. 23*a* through 23*l* show a process of document feeding in the two-in-one mode according to the second embodiment.

Figure 23A:
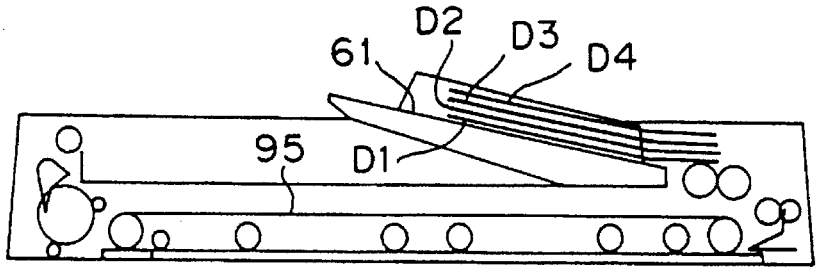
FIGS. 23*a* through 23*l* are views explaining a process of document feeding in the two-in-one mode in the second embodiment.
Figure 23B:
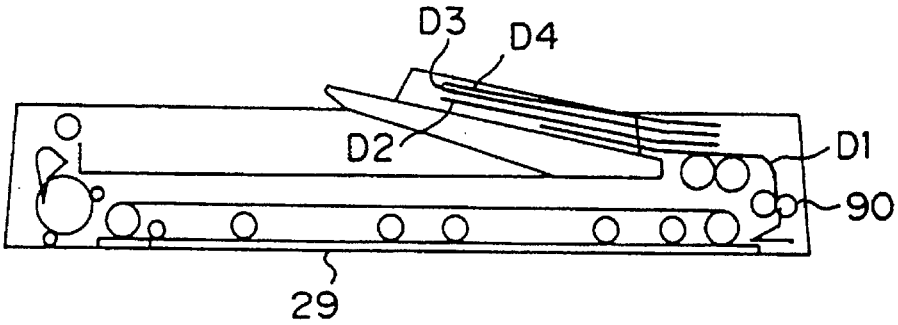
Figure 23C:
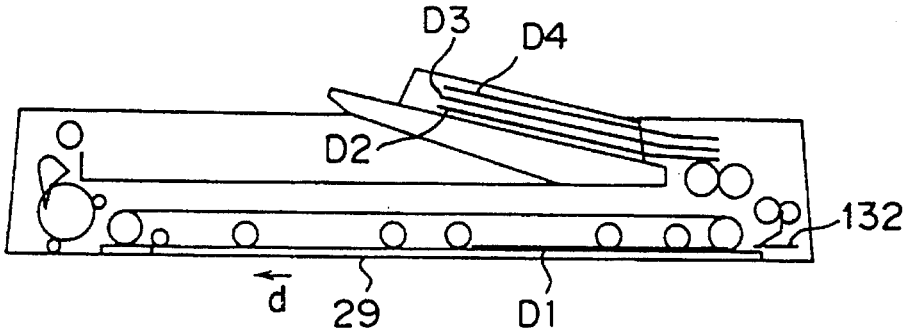
Figure 23D:
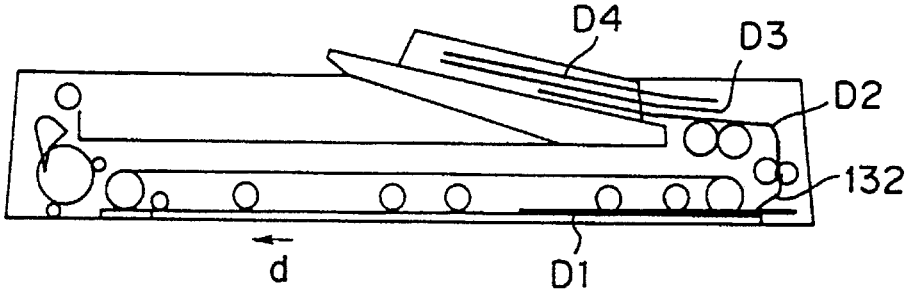
Figure 23E:
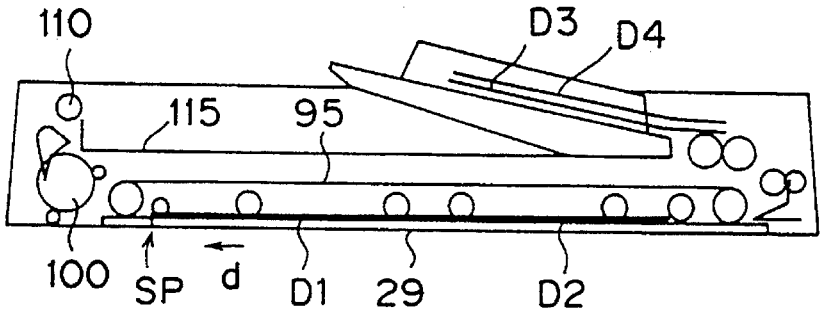
Figure 23F:
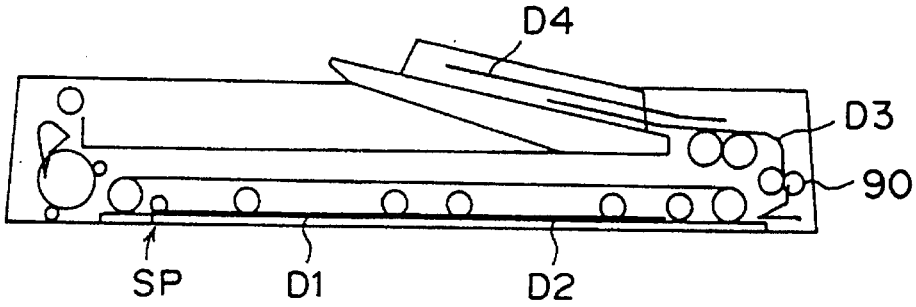
Figure 23G:
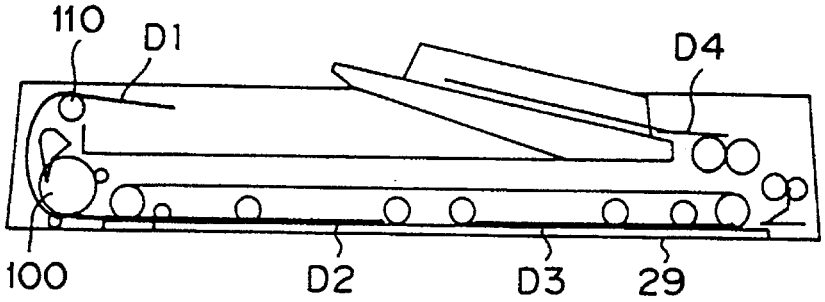
Figure 23H:
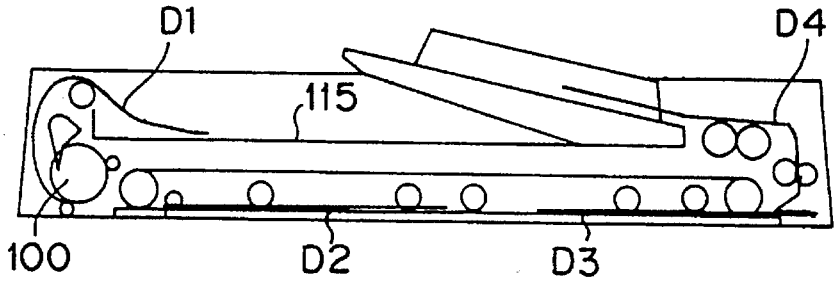
Figure 23I:
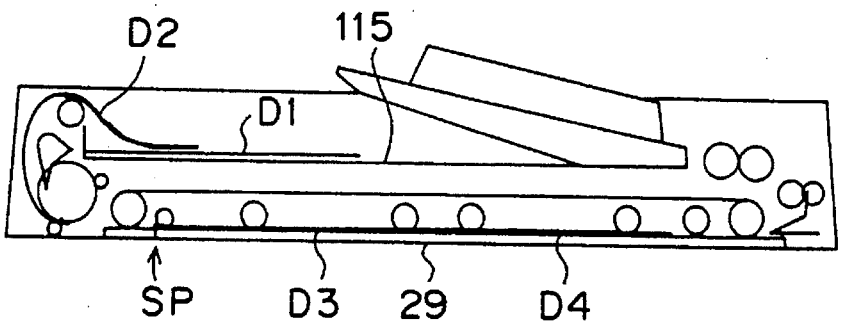
Figure 23J:
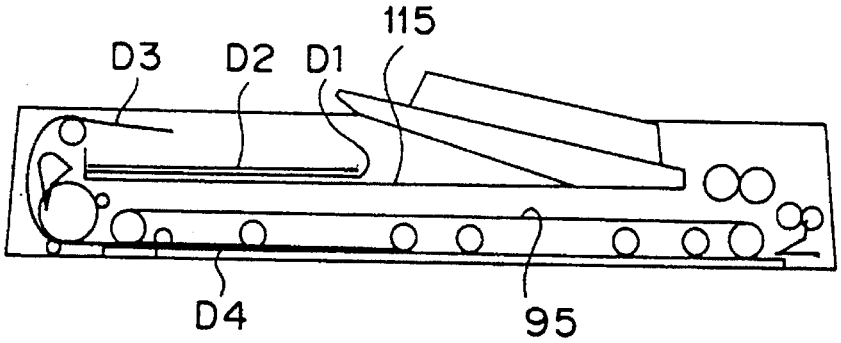
Figure 23K:
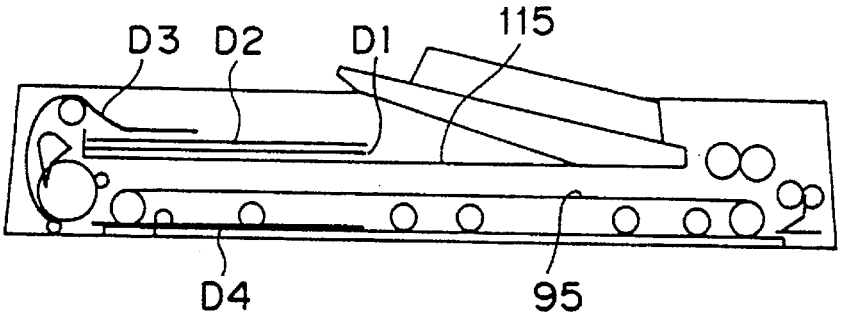
Figure 23L:
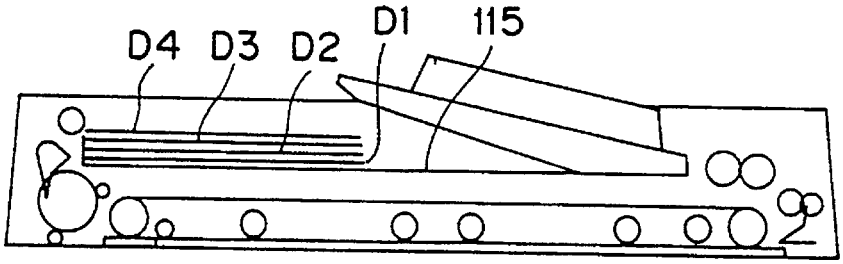

Document feeding in the two-in-one mode according to the second embodiment is basically the same as that according to the first embodiment described referring to FIGS. 18*a* through 18*l*. The distinctive point is that on/off control of the ejection motor M4 is not required. As shown in FIG. 23*h*, even when the main motor M3 is reversed for a switchback of a third document D3, the reversing roller 100 and the ejection roller 110 maintain their forward rotations because of the clutches 181 and 182, and thereby a first document D1 is ejected. However, a second document D2 moves backward together with the third document D3, which makes a space between the documents D1 and D2. This prevents disorder of documents on the tray 115. Likewise, in ejecting the documents D3 and D4, a space is made between the documents D3 and D4 as follows (see FIG. 23*k*). The main motor M3 is reversed when the trailing edge of the document D3 separates from the conveyer belt 95, and after keeping the reverse rotation for a specified time, the main motor M3 is switched to forward rotation.

FIGS. 24*a* through 24*k* show a process of document feeding in the two-in-one mode according to the second embodiment in a case that a document of the large size is present in the stack as a sheet of an odd number from the bottom.

Document feeding in this case is basically the same as the document feeding described referring to FIGS. 19*a* through 19*k*. The distinctive point is ejection of the documents.

Figure 24A:
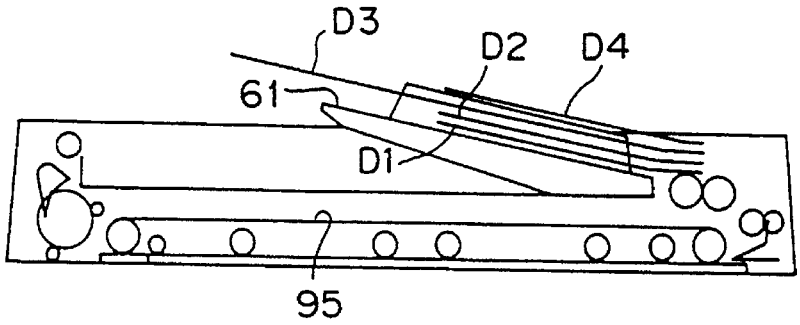
FIGS. 24*a* through 24*k* are views explaining a process of document feeding in the two-in-one mode in the second embodiment in a case that a large size document is present in a stack of documents.
Figure 24B:
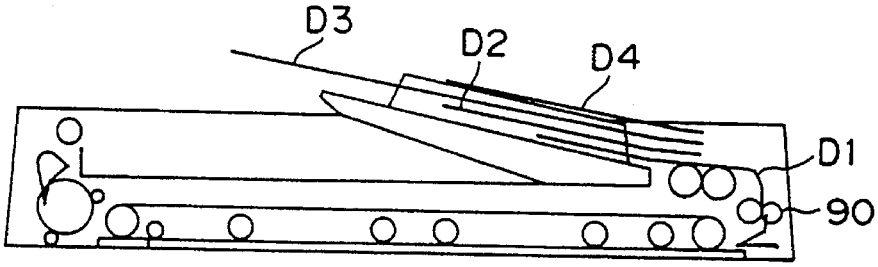
Figure 24C:
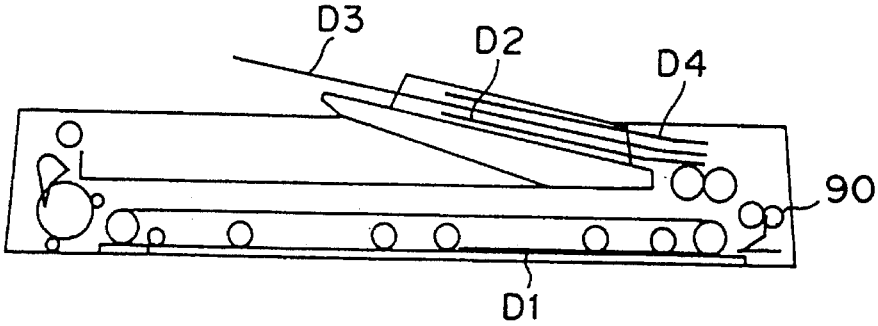
Figure 24D:
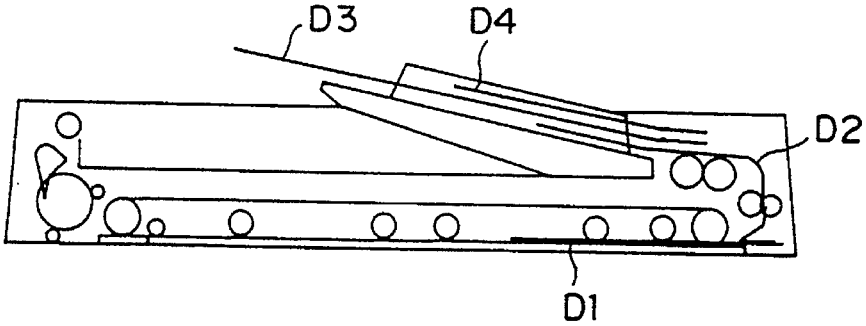
Figure 24E:
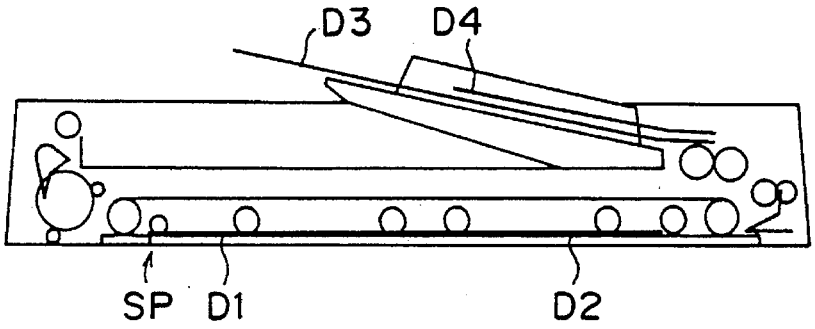
Figure 24F:
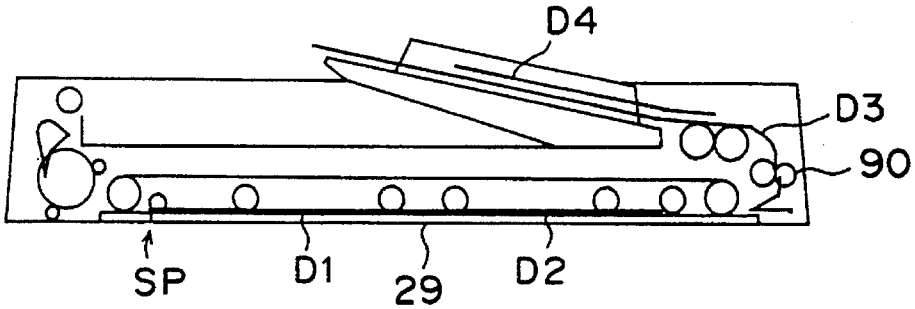
Figure 24G:
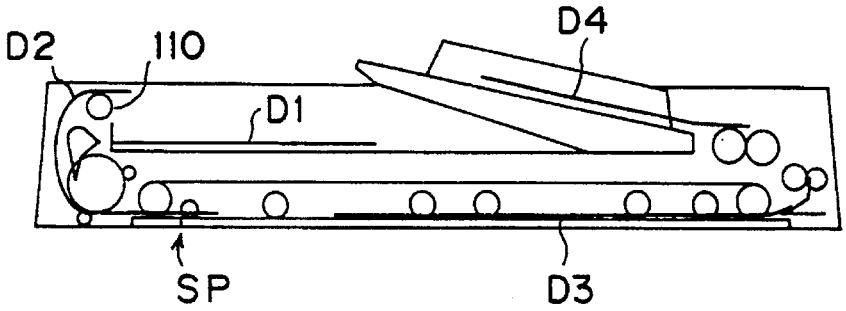
Figure 24H:
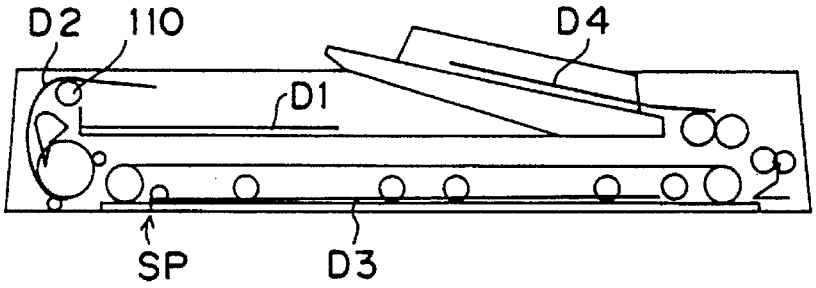

A first document D1 and a second document D2 are set on the platen glass 29 side by side as shown in FIG. 24*f*, and in this state, the documents D1 and D2 are scanned. After the scanning, the main motor M3 is rotated forward to eject the documents D1 and D2 and to convey a third document D3, which is of the large size, to the scanning position. However, when the leading edge of the document D2 passes slightly over the ejection roller 110, the main motor M3 is once turned off (see FIG. 24*g*). After a time enough that the document D1 is certainly ejected onto the tray 115, the main motor M3 is rotated forward. With this arrangement, a push of the document D2 to the document D1 can be avoided, and accordingly disorder of documents on the tray 115 can be prevented. When the leading edge of the third document D3 comes to the scanning reference point SP, the main motor M3 is turned off (see FIG. 24*h*). In this moment, the document D2 is still in contact with the ejection roller 110, but the document D2 is stopped in this state.

Figure 24I:
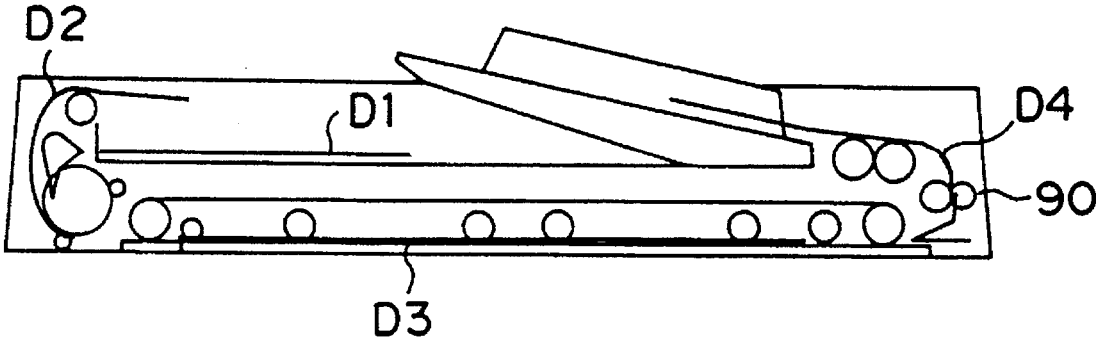
Figure 24J:
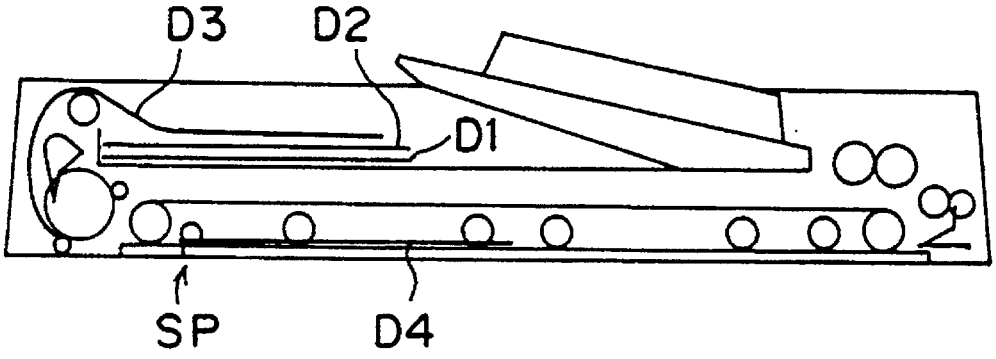
Figure 24K:
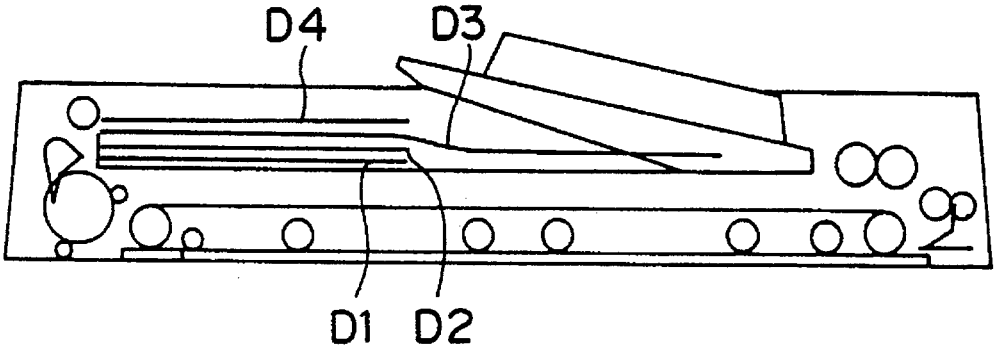

The document D3 is scanned, and in the meantime, a fourth document D4 is fed to the register roller pair 90 (see FIG. 24*i*). After the scanning, the main motor M3 is rotated forward, whereby the document D2 is completely ejected onto the tray 115. When the leading edge of the fourth document D4 comes to the scanning reference point SP, the main motor M3 is turned off (see FIG. 24*j*). In this moment, ejection of the document D3 has not finished, but the document D3 is stopped in the state, and the document D4 is scanned. Thereafter, the main motor M3 is rotated forward. Thereby, the document D3 is completely ejected onto the tray 115, and the document D4 is ejected.

Document feeding in the two-in-one mode according to the second embodiment in a case that a document of the large size is present in the stack as a sheet of an even number from the bottom is not shown in the drawings. Document feeding in this case is basically the same as the document feeding described referring to FIGS. 20*a* through 20*i*. The following is the distinctive point. When the leading edge of a second document, which is of the large size, comes to the scanning reference point SP (see FIG. 20*e*), the main motor M3 is turned off, and accordingly a first document D1 is once stopped in the middle of ejection.

Next, a count mode is described.

The count mode is a mode wherein before copying by use of the ADF 60, the ADF 60 conveys all the original documents stacked on the tray 61 only to count the documents.

The count mode is beneficial in the following cases. Because the ADF 60 starts document feeding with the last page, if an odd number of documents are to be copied in the two-in-one mode, page 1 will be copied on a half of a copy sheet. In order to avoid this trouble, the ADF 60 counts documents beforehand. If the number of documents is an odd number, the first fed document, that is, the last page is placed on the platen glass 29 alone and copied on a half of a copy sheet, and the successive documents are handled in the two-in-one mode as described above. Additionally, in the duplex copying and the composite copying, the same trouble can be avoided by counting documents beforehand.

Because the counting is not accompanied with copying, preferably the counting is carried out as speedily as possible. However, as described above, the ADF 60 once stops each document with its leading edge positioned at the scanning reference point SP. If the ADF 60 operates in this manner in the count mode, intervals among documents are unnecessarily large, and the counting takes a time.

Therefore, in the count mode, the ADF 60 stops each document when the trailing edge of the document comes to a stop reference point X (see FIG. 15) on the platen glass 29, not when the leading edge of the document comes to the scanning reference point SP. In other words, the intervals among documents in the count mode are a distance between the stop reference point X and the nipping portion of the register roller pair 90, and the counting is carried out speedily. The arrival of the trailing edge at the point X can be judged from the number of pulses driving the main motor M3 after the sensor SE2 detects the trailing edge.

The stop reference point X may be set to any place as long as it is downstream of the nipping portion of the register roller pair 90. Only if the stop reference point X is set upstream of a point where the trailing edge of a document is when the leading edge of the document is at the scanning reference point SP, the counting is carried out more speedily than document feeding accompanied with copying. Closer to the nipping portion of the register roller pair 90 the stop reference point X is, more speedily the counting is carried out.

Further, preferably, the conveying speed of the ADF 60 in the count mode is higher than that in copying operation.

In any copying mode as well as in the count mode, preferably, the conveying speed is raised during motions of the ADF 60 which lower the copying efficiency. The motions of the ADF 60 which lower the copying efficiency are turning-over of a duplex document by use of the reversing roller 100, conveyance of a first-fed document to the scanning position and ejection of a last-fed document onto the tray 115.

Next, a control circuit and a control procedure of the ADF 60 is described.

First, the first embodiment provided with the ejection motor M4 is described. Later, the main point of the second embodiment in which the ejection motor M4 is omitted will be described.

Figure 25:
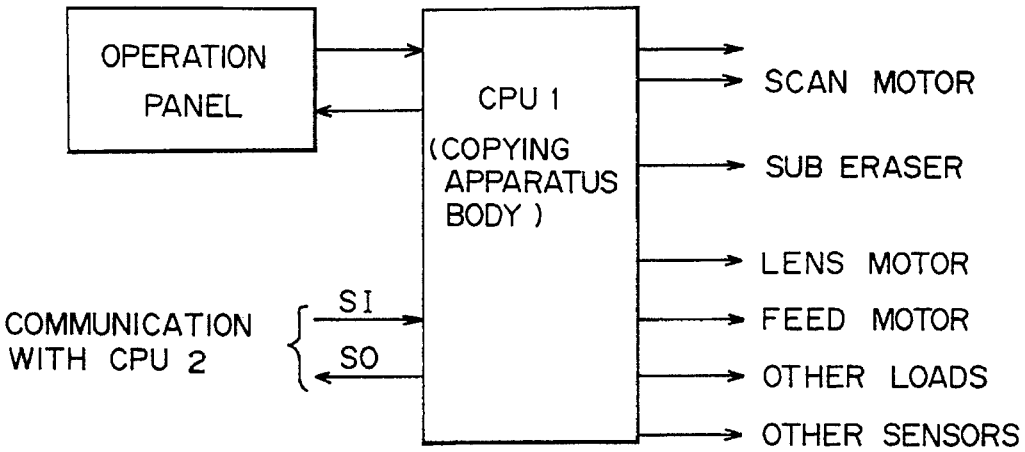
FIG. 25 is a block diagram of a control circuit for the copying apparatus body.

The control procedure is carried out by a CPU1 (see FIG. 25) which controls the copying apparatus body 1 and a CPU2 (see FIG. 26) which controls the ADF 60. The CPU1 and the CPU2 communicate with each other when it is necessary.

In the following description, "on-edge" means the moment when a switch, a sensor, a signal or the like is switching from an off state to an on state, and "off-edge" means the moment when a switch, a sensor, a signal or the like is switching from an on state to an off state. The sensors SE1, SE2, SE3, SE10, SE11 and SE12 are turned on when their optical axes are interrupted and are turned off when their optical axes are released from the interruption. Regarding flags, "1" means an on state, and "0" means an off state.

Figure 27:
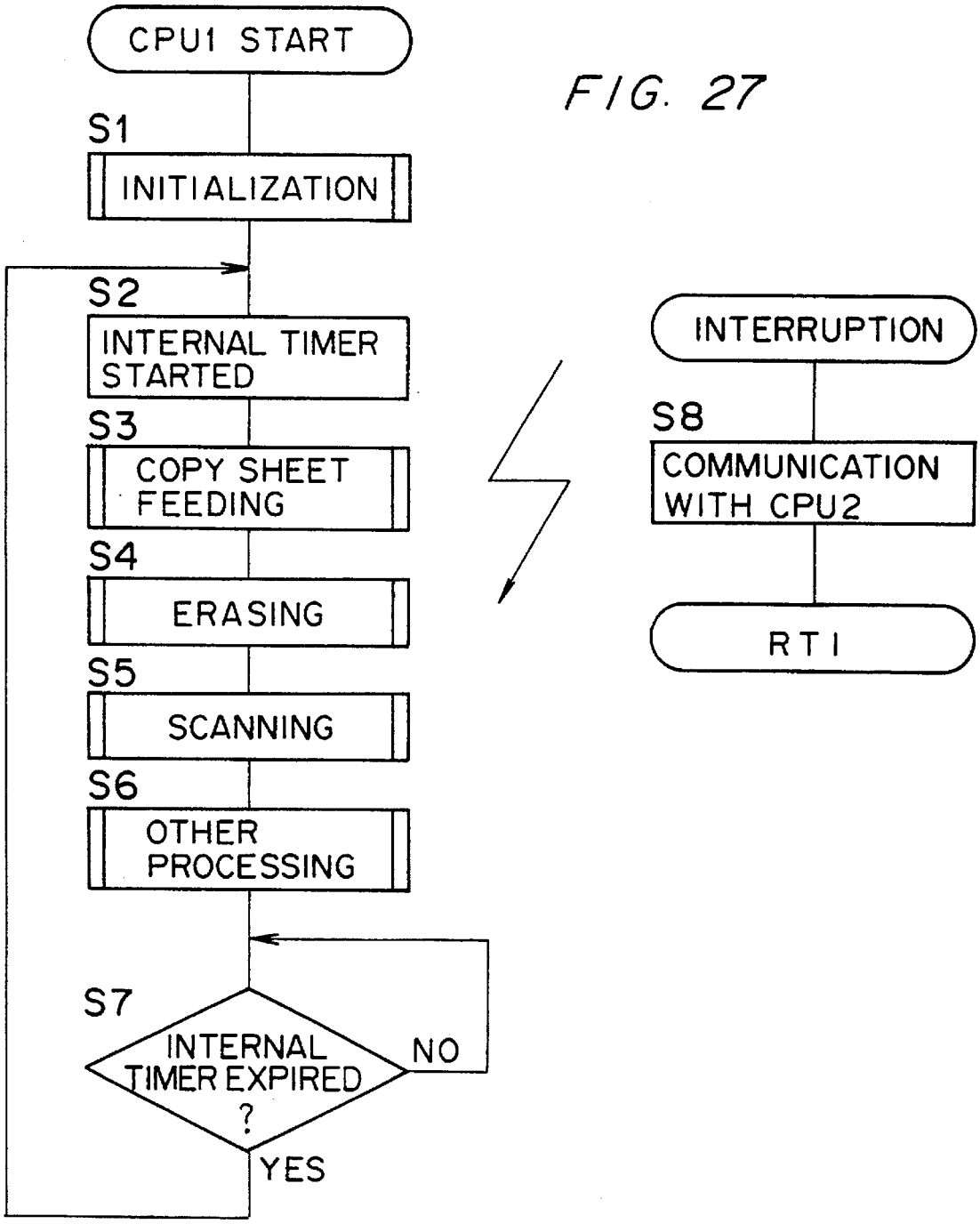
FIG. 27 is a flowchart showing a main routine of a CPU1 which controls the copying apparatus body.

FIG. 27 shows a main routine of the CPU1 controlling the copying apparatus body 1.

When supply of power is started, the CPU1 is reset, and a program starts. First, at step S1, a RAM is cleared, registers are reset, and elements and members are initialized. At step S2, an internal timer is started. The internal timer is to determine a time for one cycle of the main routine, and the value is set at step S1. The internal timer is also a reference of timers used in subroutines.

Subsequently, subroutines are called at steps S3 through S6 for necessary processing. On the expiration of the internal timer, the processing returns to step S2. The subroutine called at step S3 is for feeding a copy sheet to the timing roller pair 38. The subroutine called at step S4 is for erasing charge on the photosensitive drum 10. The subroutine called at step S5 is for operating the optical system 20 to form an electrostatic latent image on the photosensitive drum 10. The subroutine called at step S6 is for other processing, namely, driving of the photosensitive drum 10 and the nearby elements, transport of the copy sheet, fixing of a copy image, detection of sheet jamming, etc.

The CPU1 is connected with the CPU2 by a serial transmission line, and communication between the CPU1 and CPU2 is carried out by interrupt handling at step S8.

Figure 28:
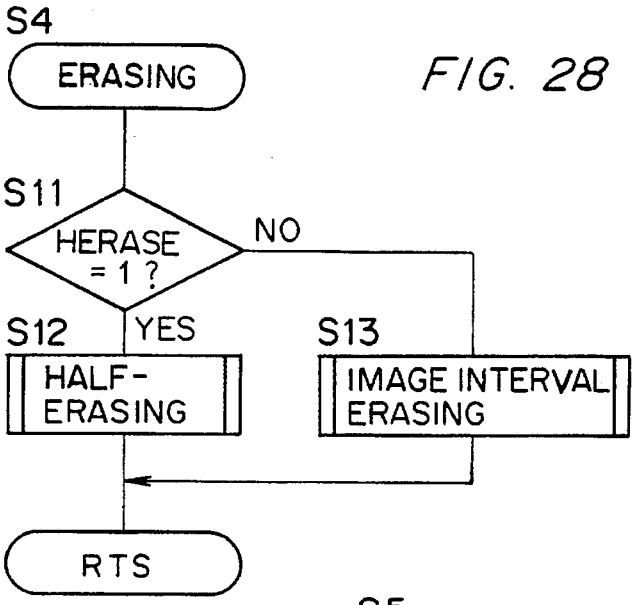
FIG. 28 is a flowchart showing an erasing subroutine of the CPU1.

FIG. 28 shows the charge erasing subroutine carried out at step S4.

First at step S11, a flag HERASE is checked. The flag HERASE is set to "1" if in the two-in-one mode, the latter document of a pair of documents is of the large size and this information is transmitted from the CPU2 to the CPU1. Accordingly, if the flag HERASE is judged to be "1" at step S11, charge on the latter half of a scanning area is erased. If the flag HERASE is judged to be "0", charge on the interval between images is erased. Further, as mentioned, if the optical system 20 is so made that it scans only a former half of the usual scanning area in a case that the latter document is of the large size, the half-erasing at step S12 is not necessary.

Figure 29:
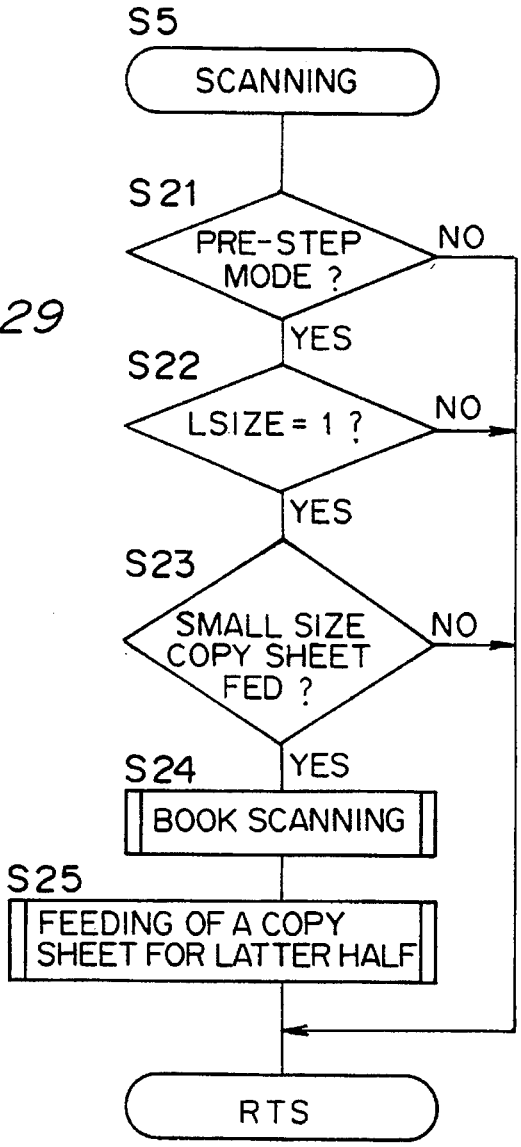
FIG. 29 is a flowchart showing a scanning subroutine of the CPU1.

FIG. 29 shows the scanning subroutine by use of the optical system 20 carried out at step S5.

It is judged at step S21 whether the pre-step mode is selected. A flag LSIZE is checked at step S22. It is judged at step S23 whether a copy sheet of the small size has been fed. The flag LSIZE is set to "1" when a document of the large size is set in the scanning position, and this information is transmitted from the CPU2 to the CPU1. If all results at steps S21, S22 and S23 are "YES", book scanning is carried out at step S24. The book scanning means scanning by use of the optical system 20 for the book division copying mentioned in connection with the pre-step mode. At step S25, another copy sheet for receiving a copy image of the latter part of the original image is fed into the copy sheet path.

Next, the CPU2 controlling the ADF 60 is described. First, counters used for the control, and pulse and timers used for the control of the main motor M3 are described.

A counter DCNT1 is used for feeding of a copy sheet into the copying apparatus body 1. The value of the counter DCNT1 is transmitted to the CPU1 by interrupt handling. When one or more documents are placed on the tray 61, that is, when the empty sensor SE1 is turned on, the counter DCNT1 is set to "1". Then, if the sensor SE1 is on at the time of off-edge of the register sensor SE2, the counter DCNT1 gains an increment. At the time of on-edge of a flag DCHG requesting a change of documents, the counter DCNT1 has a decrement. The copying apparatus body 1 is controlled such that a number of copy sheets corresponding to a multiplier of the value of the counter DCNT1 by a number of copy sets to be made will be fed.

A counter DCNT2 is to count documents in the document conveying path of the ADF 60. The counter DCNT2 gains an increment at the time of on-edge of the register sensor SE2 and has a decrement when each document has been ejected.

A counter DCNT3 is to count documents being ejected for a change of documents in the pre-step mode and in the two-in-one mode. The number of documents set on the platen glass 29 is inputted in the counter DCNT3, and when each document is ejected, the counter DCNT3 has a decrement.

A counter GCNT is to count documents in copying. The counter GCNT gains an increment at the time of off-edge of the register sensor SE2. On the completion of copying, the counter GCNT is reset.

A counter PLSCNT1 is to count pulses after the main motor M3 is turned on. The counter PLSCNT1 gains increments while the motor M3 is rotated forward, and has decrements while the motor M3 is rotated in reverse.

A counter PLSCNT2 is to count pulses driving the main motor M3 after the register sensor SE2 is turned off. The counter PLSCNT2 gains increments while the motor M3 is rotated forward, and has decrements while the motor M3 is rotated in reverse.

A counter SIZCNT1 is to detect the size of a document. The value of the counter PLSCNT1 at the time of turning-off of the register sensor SE2 is stored in the counter SIZCNT1.

Pulse P01 is the number of pulses from turning-on of the main motor M3 for forward rotation to a decrease in the rotating speed of the motor M3 in a case of feeding a document of the small size in the pre-step mode. On the completion of the pulse P01, pre-feeding of the next document is started.

Pulse P02 is the number of pulses from turning-on of the main motor M3 for forward rotation to turning-off of the motor M3 in a case of feeding a document of the small size in the pre-step mode. The pulse P02 attains the conveying distance L/2.

Pulse P03 is the number of pulses from turning-on of the main motor M3 for forward rotation to a decrease in the rotating speed of the motor M3 in a case of feeding a document of the large size in the pre-step mode. On the completion of the pulse P03, pre-feeding of the next document is started.

Pulse P04 is the number of pulses from turning-on of the main motor M3 for forward rotation to turning-off of the main motor M3 in a case of feeding a document of the large size in the pre-step mode. The pulse P04 attains the conveying distance L.

Pulse P05 is the number of pulses from turning-on of the main motor M3 to a decrease in the rotating speed of the motor M3 in a case of feeding a document of the large size after scanning of two small size documents in the two-in-one mode.

Pulse P06 is the number of pulses from turning-on of the main motor M3 to turning-off of the main motor M3 in a case of feeding a document of the large size after scanning of two small size documents in the two-in-one mode. The turning-off of the main motor M3 is to make a space between the two small size documents. The pulse P06 attains the conveying distance corresponding to the length of an A4 laterally-fed document plus α or the distance L/2.

Pulse P07 is the number of pulses from turning-off the register sensor SE2 to turning-on of the main motor M3 for reverse rotation in a case of feeding a document of the small size in the two-in-one mode.

Pulse P08 is the number of pulses for a switchback of a document of the small size in the two-in-one mode.

Pulse P09 is the number of pulses from turning-off of the register sensor SE2 to turning-off of the main motor M3 in the count mode.

A timer T101 is to time turning-on of the feed motor M2 after turning-off of the pick-up motor M1.

A timer T102 is to time turning-on of the feed motor M2 after turning-on of the register sensor SE2.

A timer T201 is to time turning-off of the scale solenoid SL1 after turning-off of the main motor M3.

A timer T202 is to time turning-on of the pick-up motor M1 after turning-off of the register sensor SE2 in the two-in-one mode.

A timer T301 is to time turning-off of the ejection motor M4 after turning-off of the ejection sensor SE3.

A timer T401 is provided in the second embodiment. The timer T401 is to time turning-off of the main motor M3 after turning-on of the motor M3 for ejection of the last two documents in the two-in-one mode.

A timer T501 is provided in the second embodiment. The timer T501 is to time turning-off of the main motor M3 after turning-on of the motor M3 for reverse rotation for a switchback of a document in the two-in-one mode.

Figure 30:
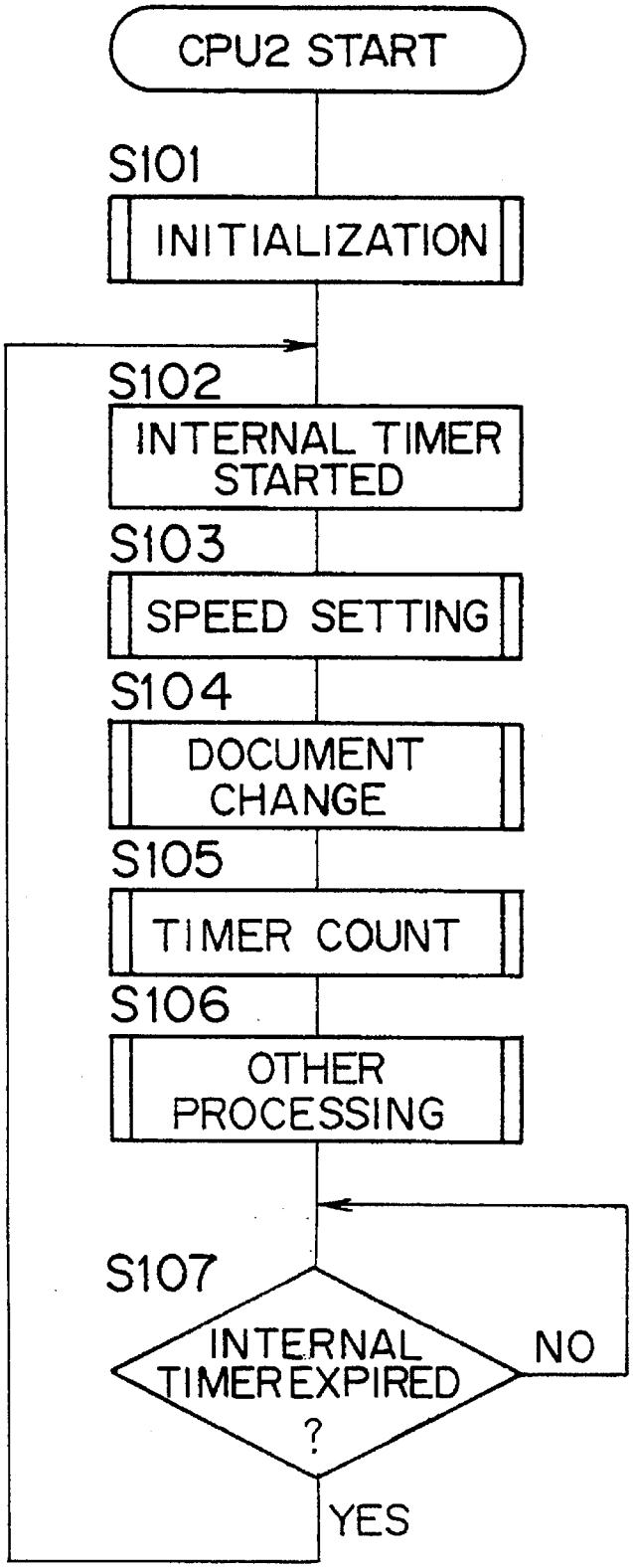
FIG. 30 is a flowchart showing a main routine of a CPU2 which controls the ADF.

FIG. 30 shows a main routine of the CPU2 controlling the ADF 60.

When supply of power is started, the CPU2 is reset, and the program starts. At step S101, a RAM is cleared, registers are reset, and elements and members are initialized. At step S102, an internal timer is started. The internal timer is to determine a time for one cycle of the main routine, and the value is set at step S101. The internal timer is also a reference of timers used in subroutines.

Subsequently, subroutines are called at steps S103 through S106 for necessary processing. On the expiration of the internal timer, the processing returns to step S102. The subroutine called at step S103 is for setting the document conveying speed of the ADF 60. The subroutine called at step S104 is for changing documents on the platen glass 29. The subroutine called at step S105 is for counting timers. The subroutine called at step S106 is for other processing, namely, A/D conversion, input, output, detection of sheet jamming, etc.

Figure 31A:
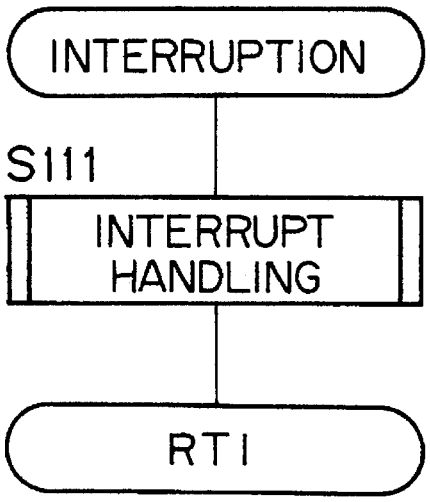
FIGS. 31*a* through 31*c* are flowcharts showing interruption handling of the CPU2.
Figure 31B:
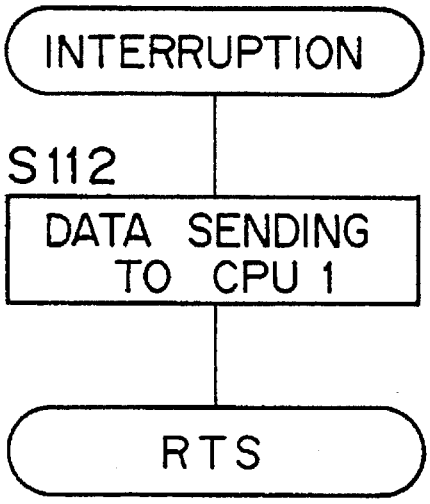
Figure 31C:
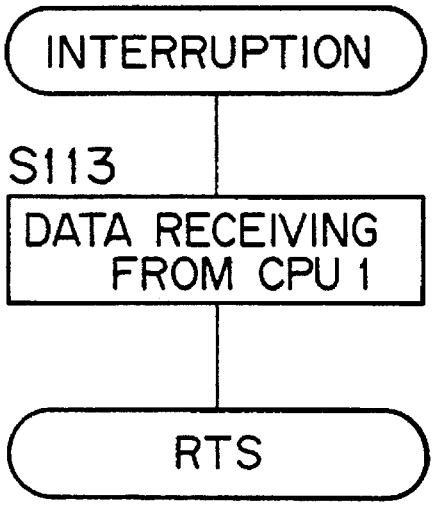

As shown in FIGS. 31*a*, 31*b* and 31*c*, interrupt procedures carried out separately from the main routine are provided. Interrupt handling at step S111 is to control the main motor M3. Interrupt handling at step S112 is to transmit data to the CPU1, and interrupt handling at step S113 is to receive data from the CPU1.

Figure 32:
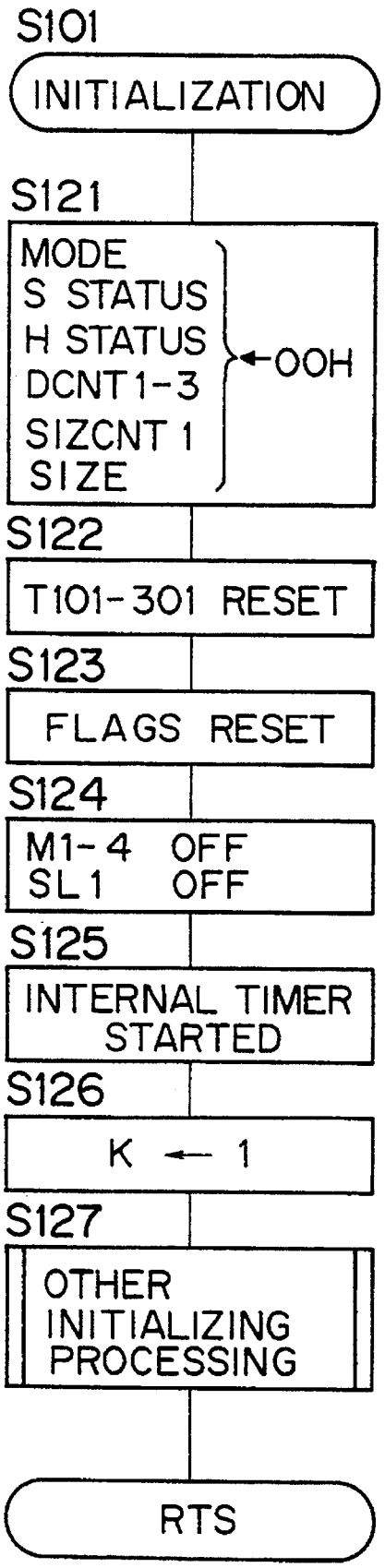
FIG. 32 is a flowchart showing a subroutine of the CPU2 for initialization.

FIG. 32 shows a subroutine for initialization carried out at step S101.

At step S121, the RAM and the counters are cleared. The timers T101, T102, T202 and T301 are reset at step S122. The flags are reset at step S123. The motors M1, M2, M3 and M4, and the scale solenoid SL1 are turned off at step S124. A specified value is set in the internal timer at step S125. A pre-feed status K is set to "1" at step S126. At step S127, other initialization is carried out.

Figure 33:
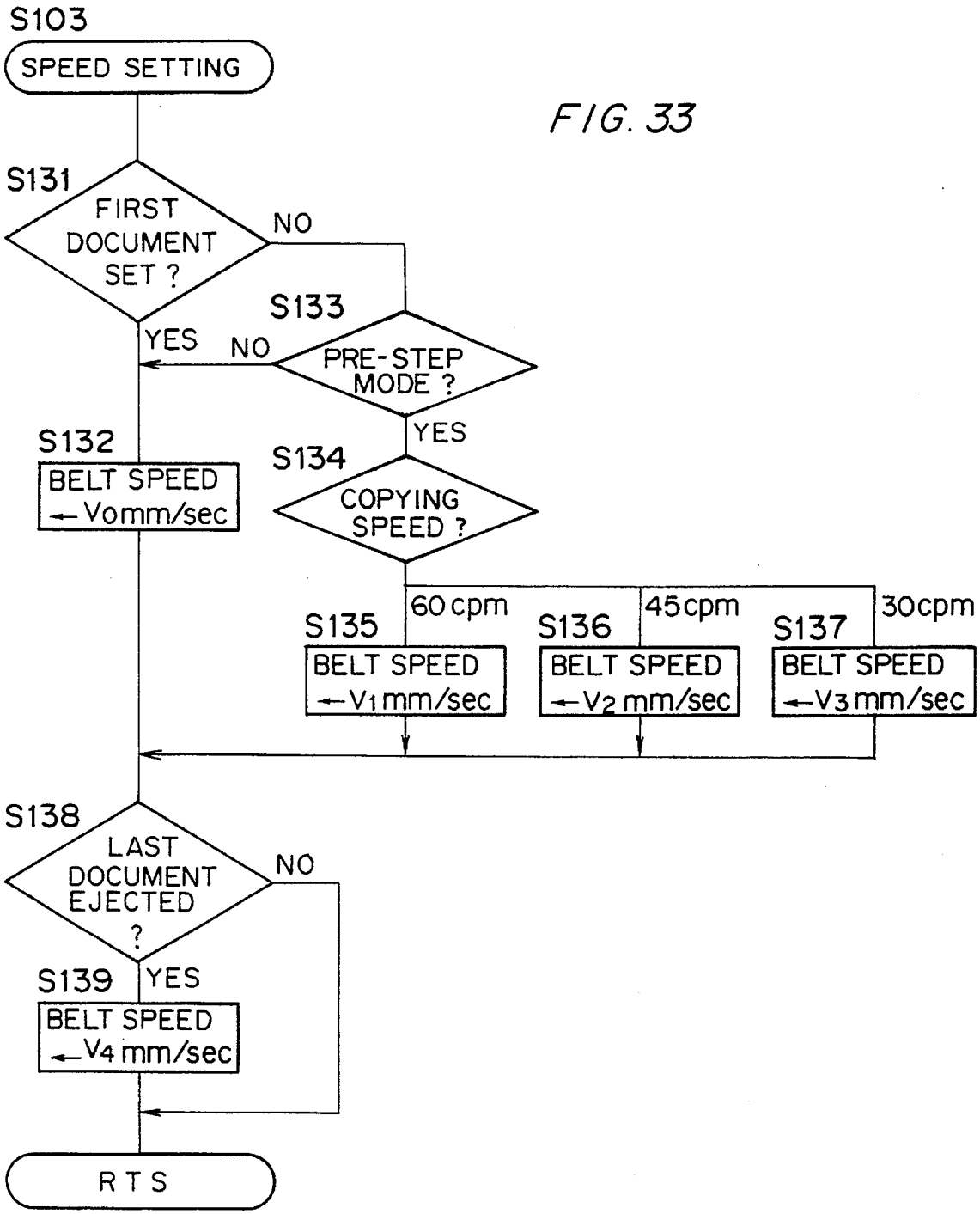
FIG. 33 is a flowchart showing a subroutine of the CPU2 for setting the speed of the conveyer belt.

FIG. 33 shows the speed setting subroutine carried out at step S103.

In this subroutine, the document conveying speed (speed of the conveyer belt 95) is set to either one of five speeds $V_0$, $V_1$, $V_2$, $V_3$, $V_4$ and $V_5$. The speeds $V_1$, $V_2$ and $V_3$ are suitable speeds for the respective three kinds into which copying machines are classified in accordance with the copying speed as described above.

The speed $V_1$ is to attain 100% copy productivity in copying A4 laterally-fed documents in a combination of the ADF 60 with a copying machine whose copying speed is 60 cpm. In other words, the speed $V_1$ is to complete changing documents of this size within the returning time of the optical system 20 in the copying machine of this kind. Now bringing specific values, this is described in more detail. The scanning length to scan an A4 laterally-fed document is 210 mm. Supposing that the system speed of the copying machine is 300 mm/sec, the returning time of the optical system 20 is calculated as follows:

$$(60\ \text{sec}/60\ \text{cpm})-(210\ \text{mm}/300\ \text{mm/sec})=0.3\ \text{sec}$$

Supposing that the distance between the nipping portion of the register roller pair 90 and the scanning reference point SP is L (see FIG. 15), the document conveying distance which is required for a document change in the pre-step mode is L/2, and the time required for the document change is $L/2V_1$.

Therefore, the speed $V_1$ shall meet the following conditions:

$$L/2V_1 \leqq 0.3$$

$$V_1 \geqq L/(2\times 0.3)$$

The speed $V_2$ is a suitable speed for a copying machine whose copying speed is 45 cpm. The speed $V_3$ is a suitable speed for a copying machine whose copying speed is 30 cpm. A relation $V_1>V_2>V_3$ exists among the three speeds.

The speed $V_0$ is a speed when a first document is conveyed to the scanning position. In order not to lower the copy productivity, the speed $V_0$ is higher than the speed $V_1$. In the modes other than the pre-step mode, the speed of the conveyer belt 95 is set to $V_0$.

The speed $V_4$ is a speed when a last document is ejected, and the speed $V_4$ is equal to the speed $V_0$.

Now, the speed setting subroutine is described.

First, it is judged at step S131 whether a first document has been set in the scanning position. If the first document has been set, the speed of the conveyer belt 95 is set to $V_0$ at step S132. If the first document has not been set in the scanning position, it is judged at step S133 whether the pre-step mode is selected. If the pre-step mode is not selected, the processing goes to step S132. If the pre-step mode is selected, the copying speed is checked at step S134. The copying speed is figured out from copying speed data transmitted from the CPU1. If the copying speed is 60 cpm, the speed of the conveyer belt 95 is set to $V_1$ at step S135. If the copying speed is 45 cpm, the speed of the conveyer belt 95 is set to $V_2$ at step S136. If the copying speed is 30 cpm, the speed of the conveyer belt 95 is set to $V_3$ at step S137.

Next, it is judged at step S138 whether a last document is to be ejected. If the result is "YES", the speed of the conveyer belt 95 is set to $V_4$ at step S139.

Further, the ADF 60 may be so made that speed setting of the conveyer belt 95 is made by use of a dip switch provided in the ADF 60 as well as automatically made in accordance with the copying speed data transmitted from the CPU1. It is also possible to provide copying speed data detecting means in a contact portion between the ADF 60 and the copying apparatus body 1. More specifically, a magnet indicating the copying speed is provided on an upper frame of the copying apparatus body 1, and a sensor for detecting the magnet is provided in the ADF 60. The CPU2 reads the copying speed of the copying apparatus body 1 from a signal sent from the sensor and sets the speed of the conveyer belt 95 accordingly.

Figure 34:
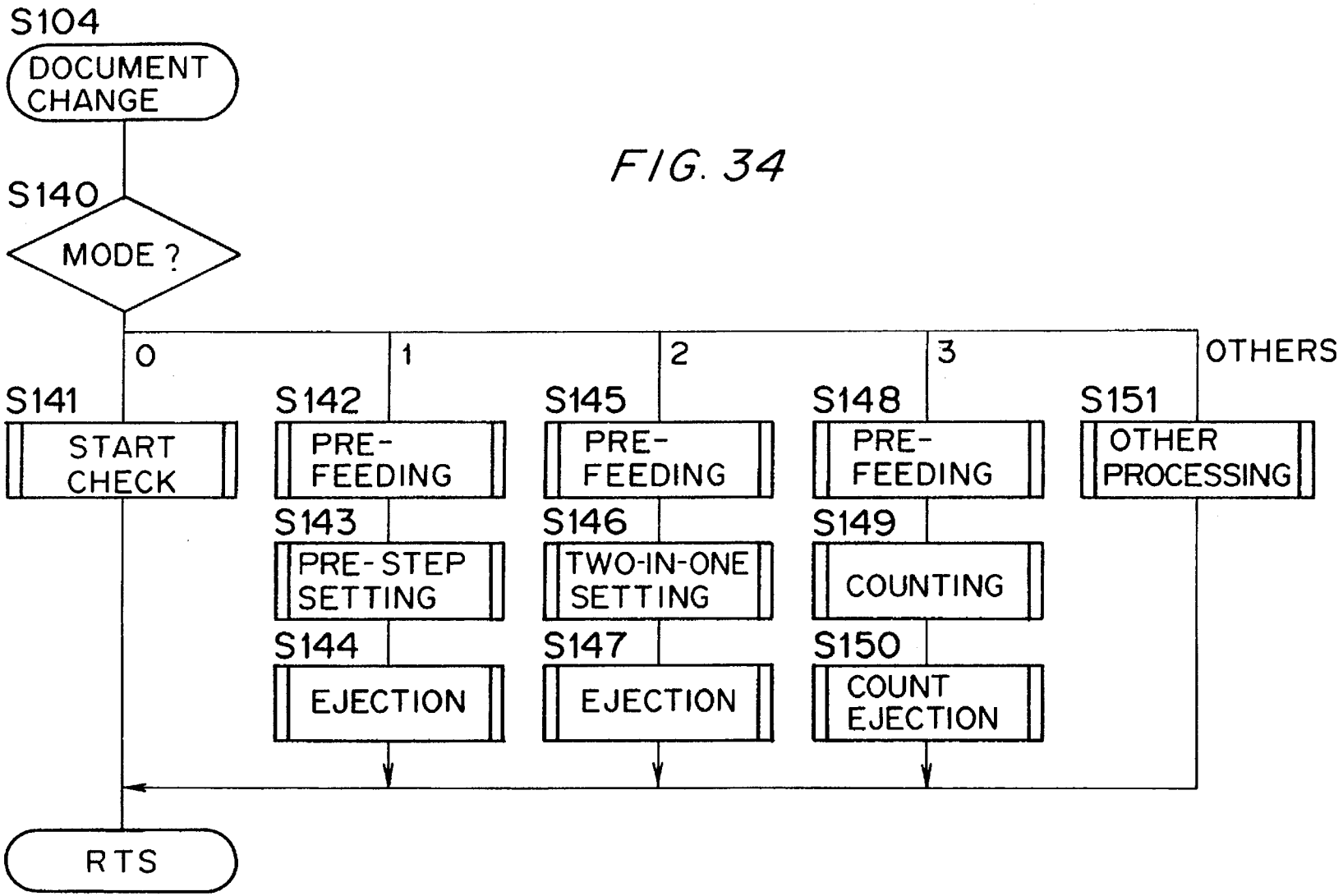
FIG. 34 is a flowchart showing a subroutine of the CPU2 for a document change.

FIG. 34 shows the document change subroutine carried out at step S104.

In this subroutine, the processing proceeds in accordance with the value of a counter MODE which is checked at step S140. The counter MODE is set to a specified value corresponding to a selected document feeding mode (see FIG. 35, steps S167 through S170).

If the counter MODE is "0" at step S140, start check is carried out at step S141. If the counter MODE is "1", pre-feeding, pre-step setting and ejection are carried out at steps S142, S143 and S144. If the counter MODE is "2", prefeeding, two-in-one setting, and ejection are carried out at steps S145, S146 and S147. If the counter MODE is "3", prefeeding, counting and count ejection are carried out at steps S148, S149 and S150. If the counter MODE is at any other value indicating any other mode such as the duplex mode, the processing is made at step S151.

Figure 35:
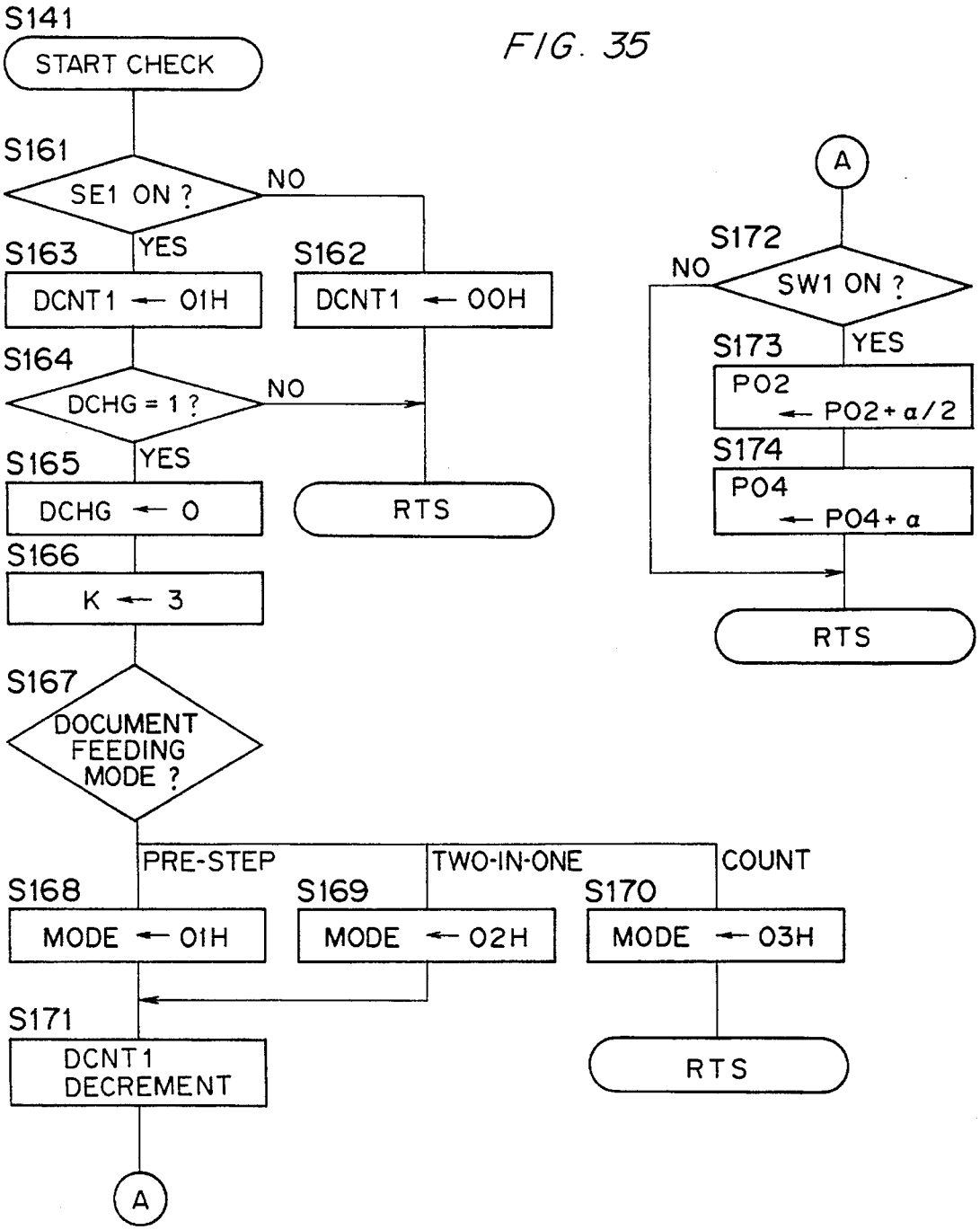
FIG. 35 is a flowchart showing a subroutine of the CPU2 for start check.
Figure 36C:
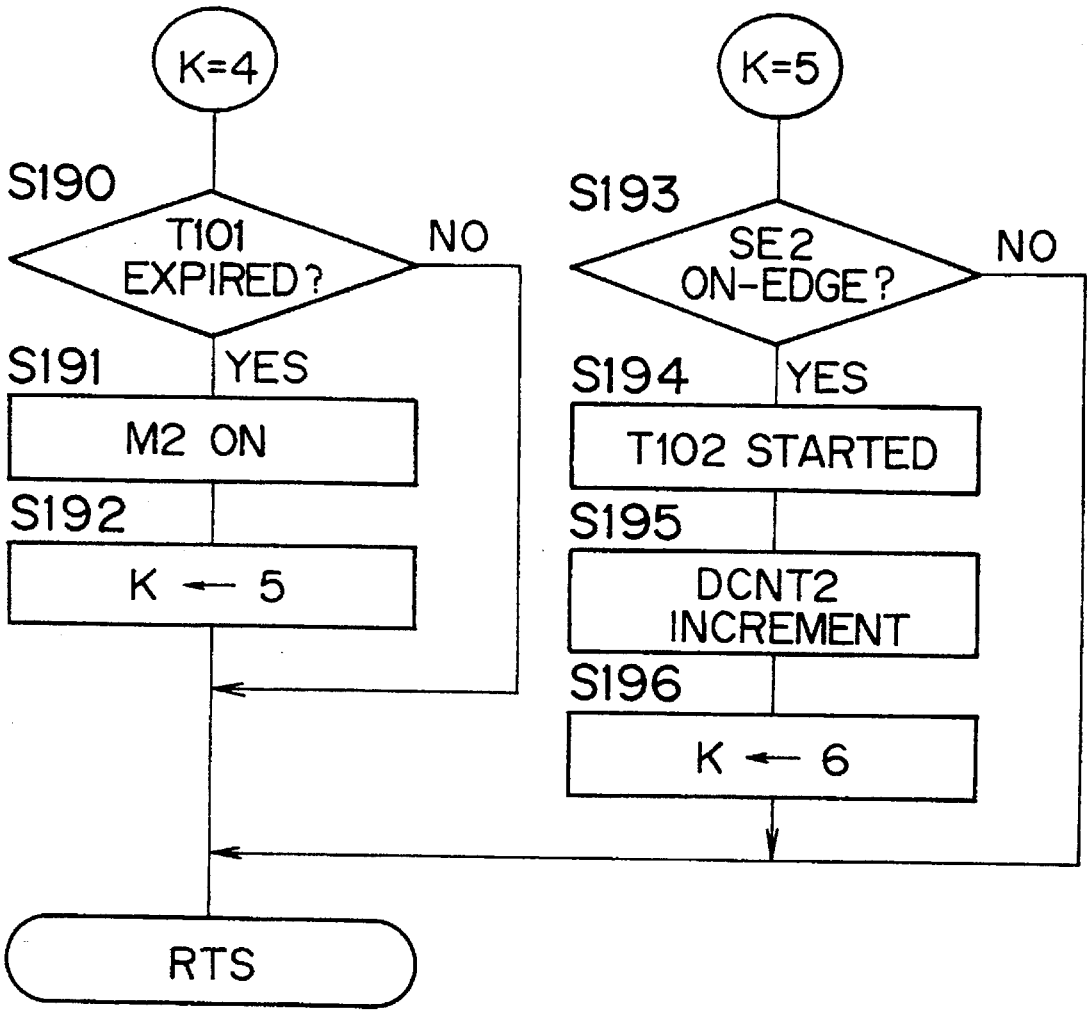
Figure 36D:
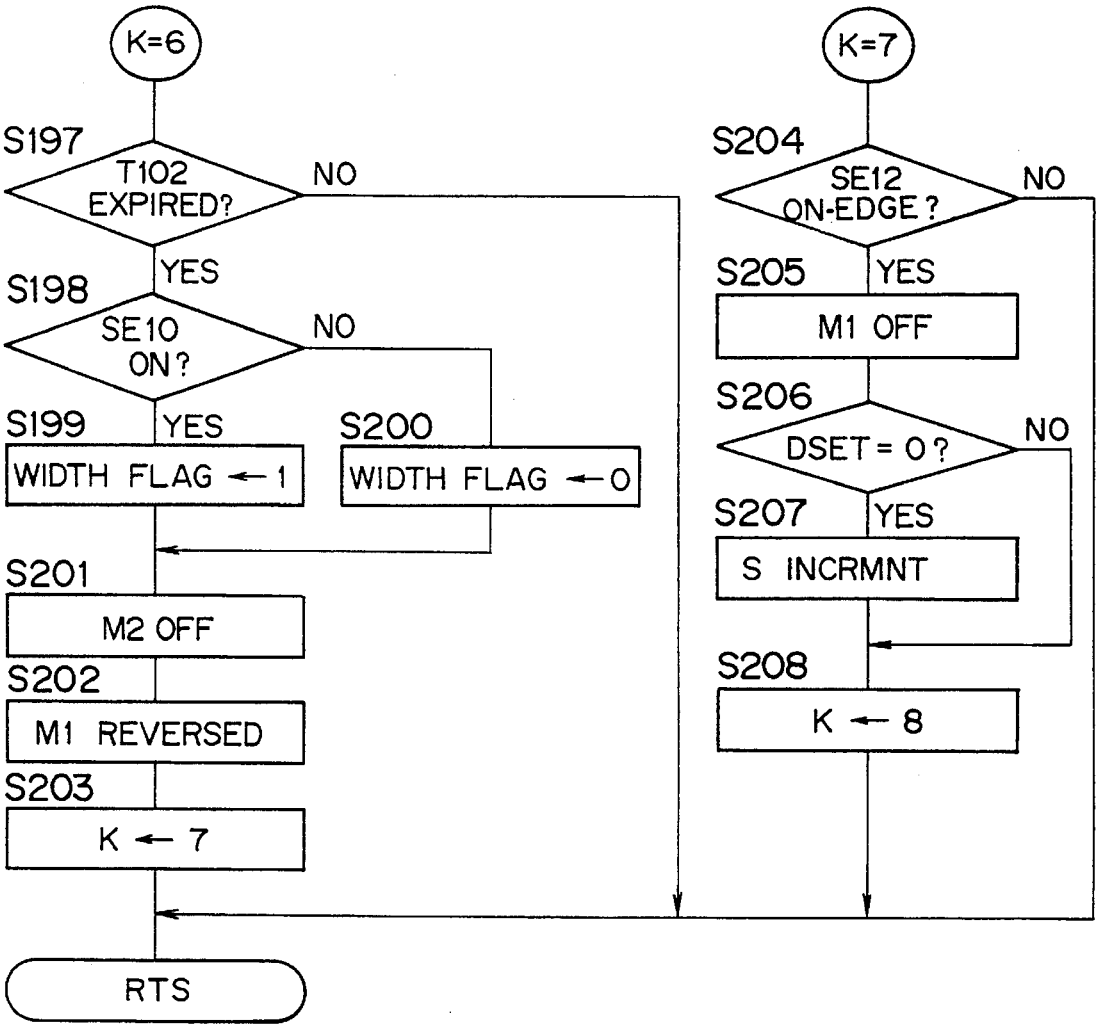
Figure 37A:
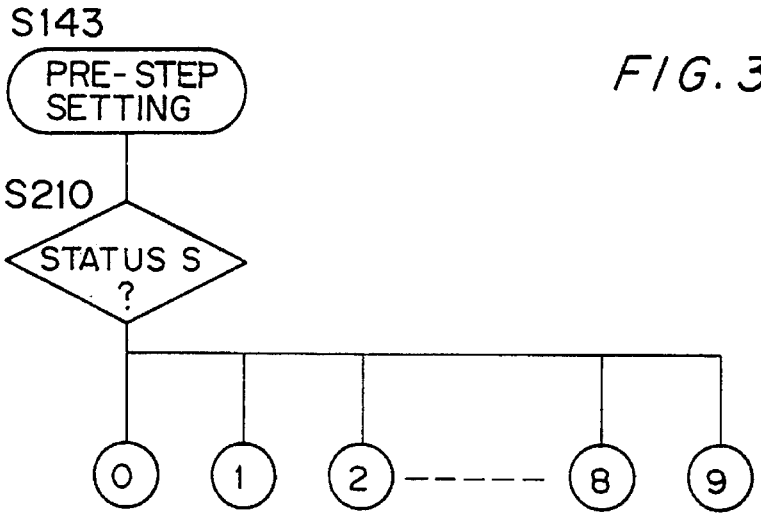
FIGS. 37*a* through 37*g* are flowcharts showing a subroutine of the CPU2 for setting documents on the platen glass in the pre-step mode.
Figure 37B:
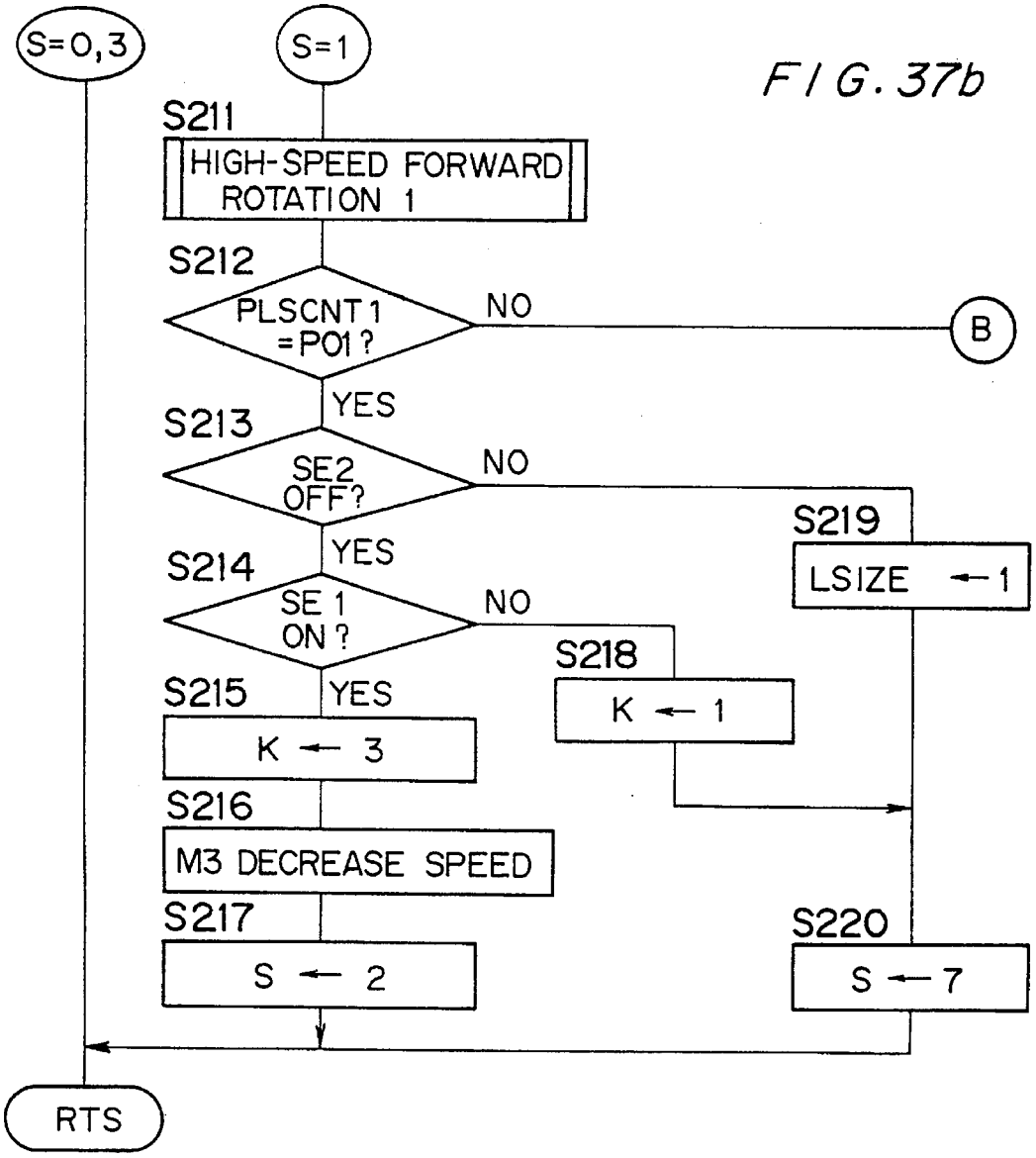
Figure 37C:
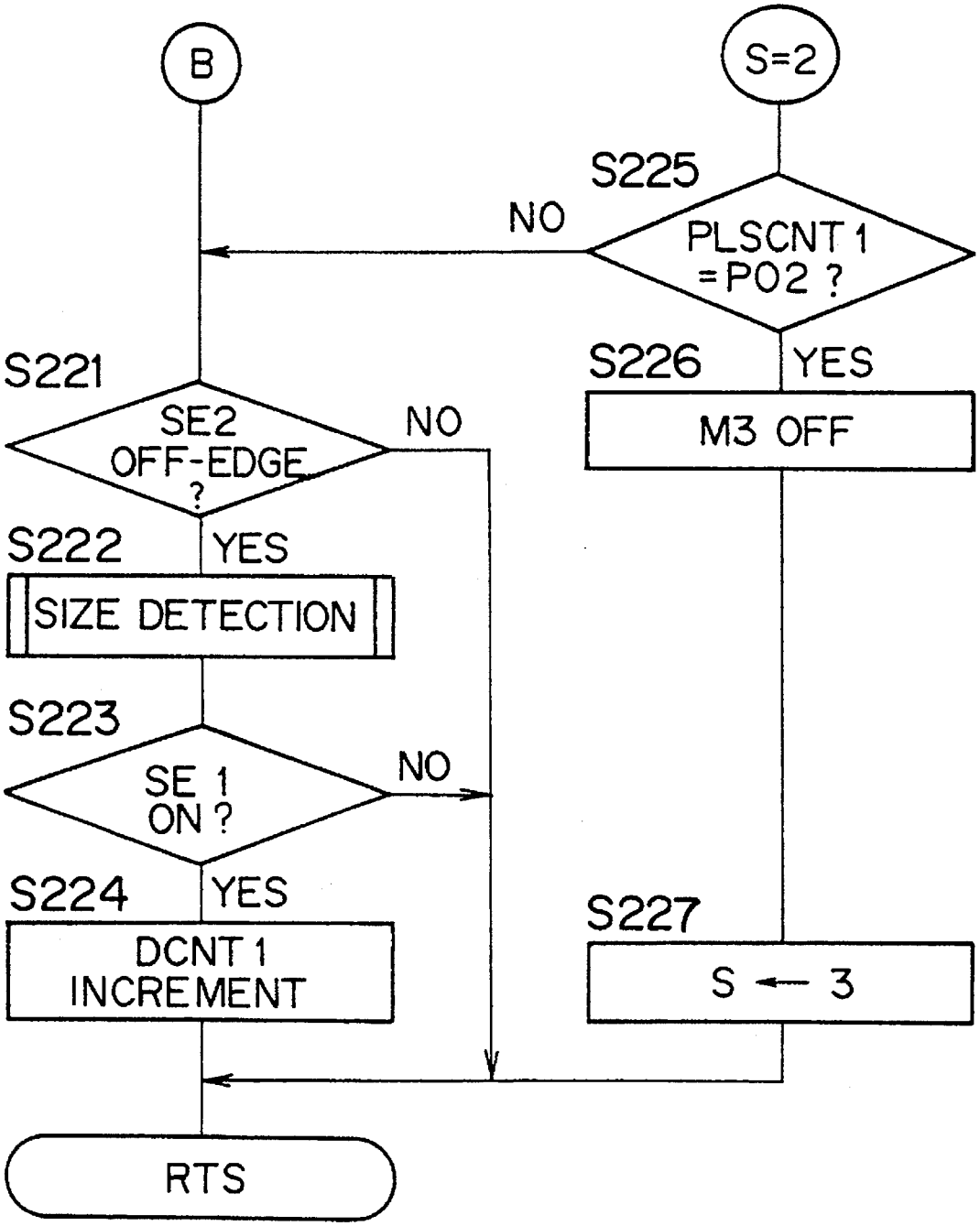
Figure 37D:
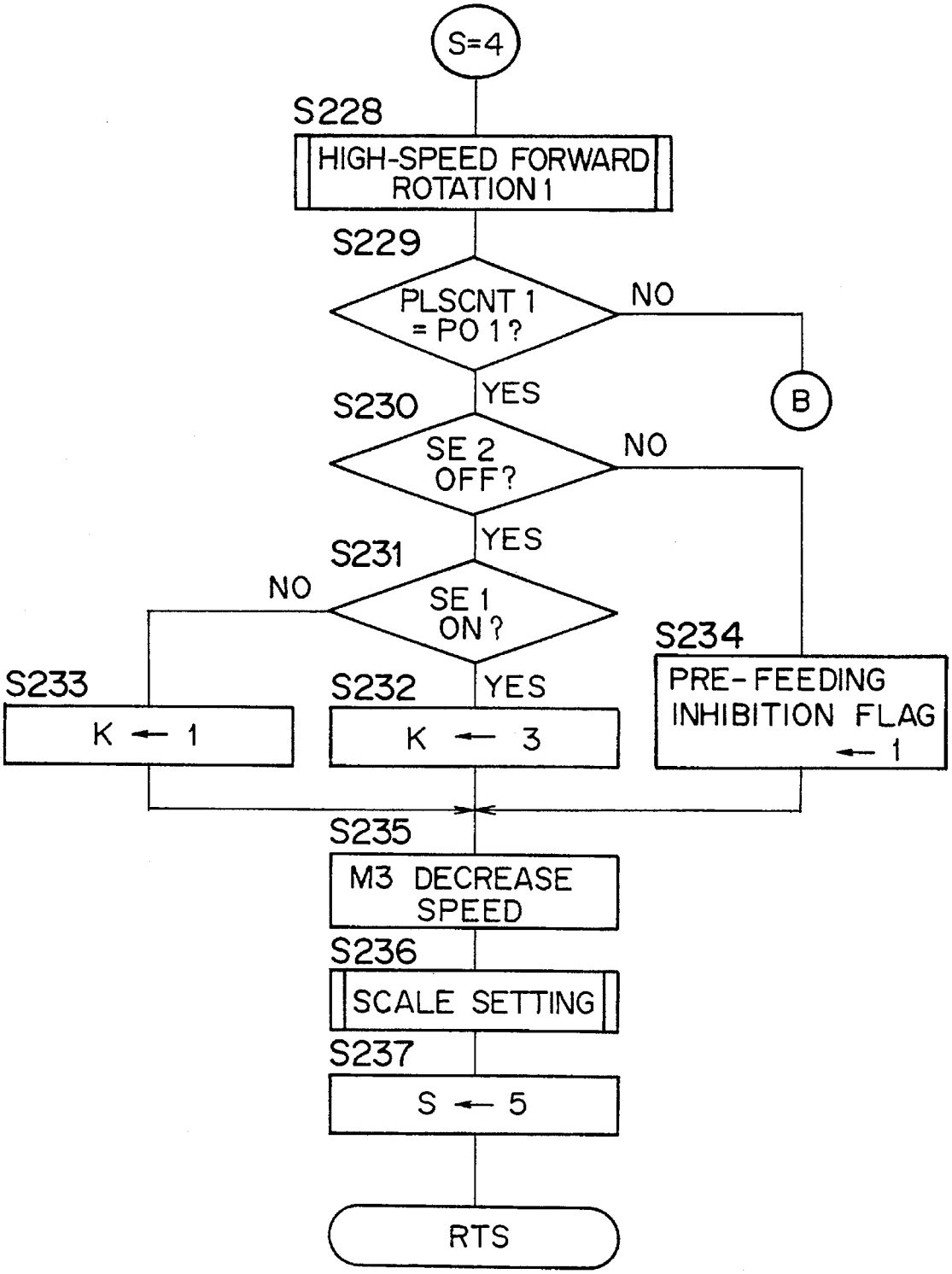
Figure 37E:
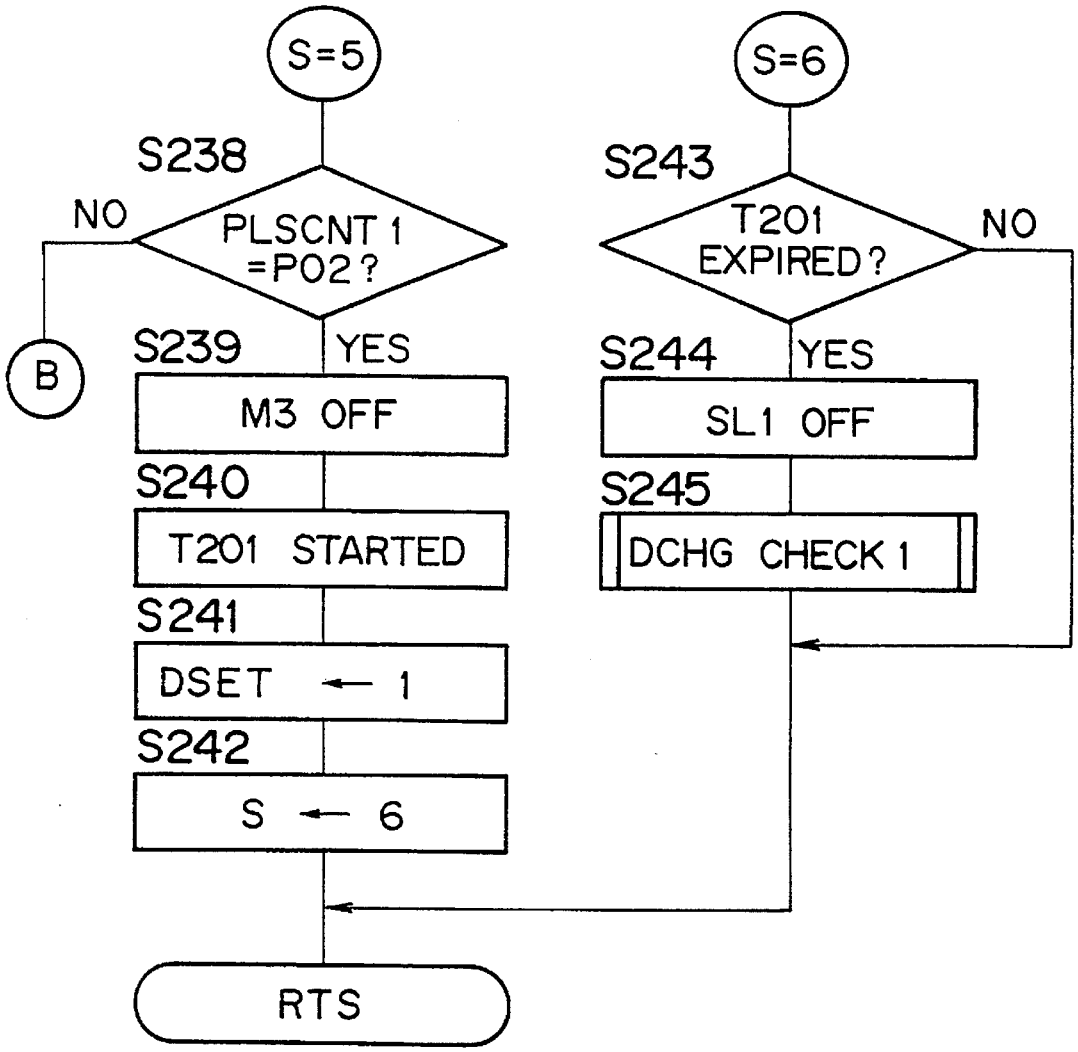
Figure 37F:
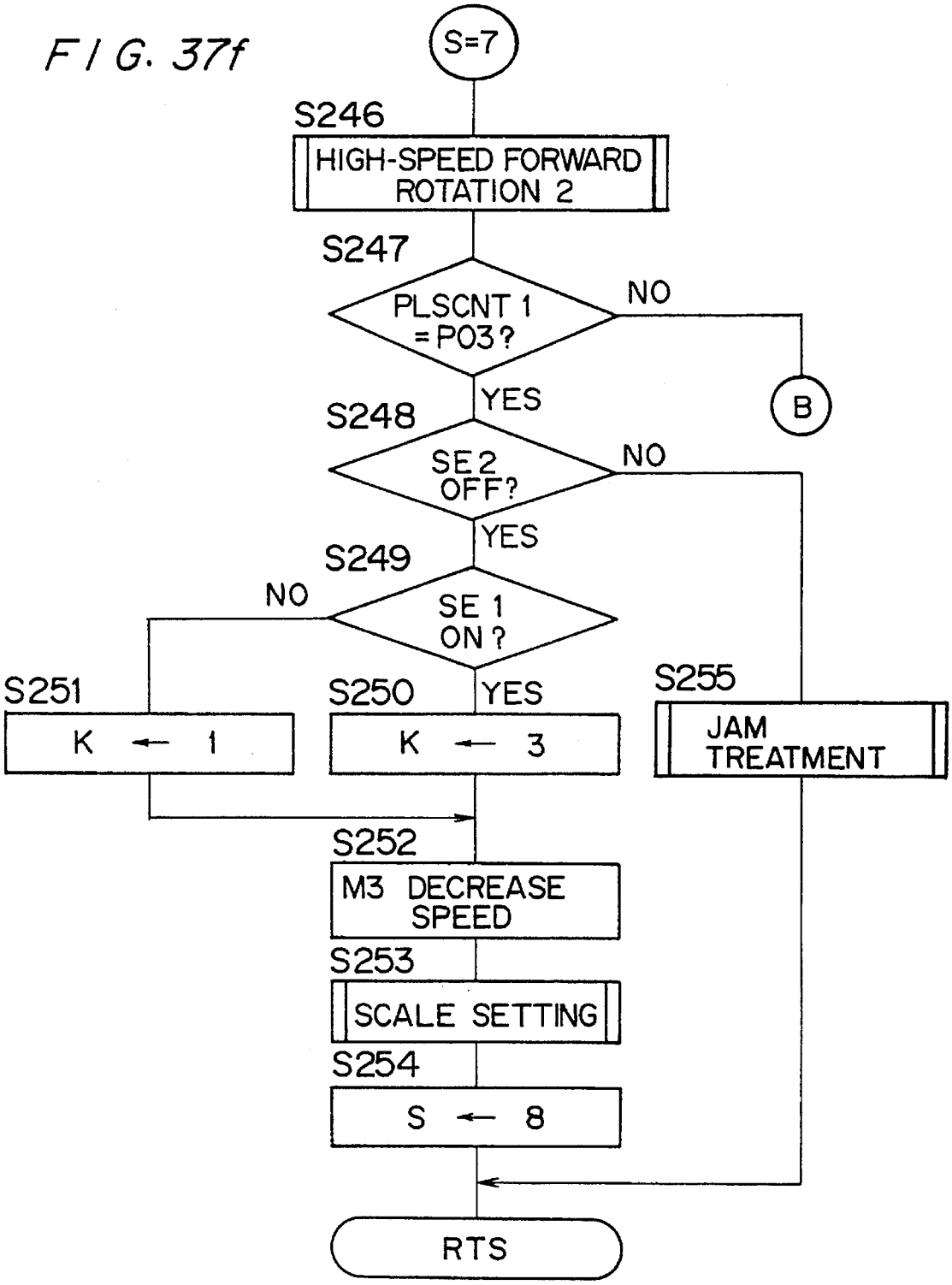
Figure 37G:
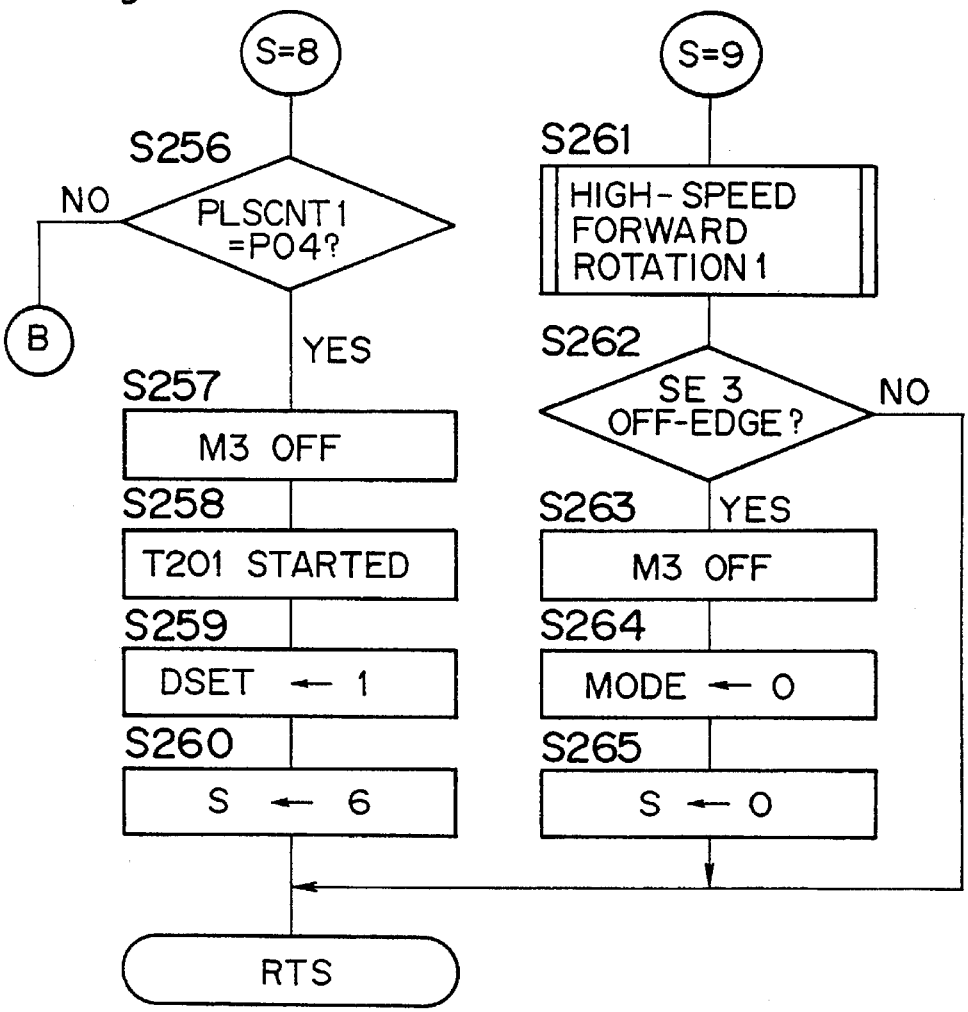

FIG. 35 shows a subroutine for the start check carried out at step S141.

As mentioned, this subroutine is carried out when the counter MODE is "0", that is, while the ADF 60 is standing by.

First, the empty sensor SE1 is checked at step S161. If the sensor SE1 is off, which means that no documents are on the tray 61, the counter DCNT1 is reset to "0" at step S162. When the sensor SE1 is turned on, which means that documents have been placed on the tray 61, the counter DCNT1 is set to "1" at step S163, and a flag DCHG is checked at step S164. The flag DCHG, when it is "1", commands a change of documents, and this command is sent from the CPU1. The flag DCHG is set to "1" when the print key is turned on or when scanning for making a set number of copies has been finished. If the flag DCHG is "0" at step S164, the processing returns to the main routine. If the flag DCHG is "1", the flag DCHG is reset to "0" at step S165, and the pre-feed status K is set to "3" at step S166. The status K is used in a subroutine for the pre-feeding, and one-by-one document feeding is started by setting the status K to "3".

Next, the document feeding mode is checked at step S167. In the pre-step mode, the counter MODE is set to "1" at step S168. In the two-in-one mode, the counter MODE is set to "2" at step S169. In the count mode, the counter MODE is set to "3" at step S170. The other document feeding modes are not described here.

In the count mode, this subroutine is immediately terminated. In the pre-step mode or in the two-in-one mode, the counter DCNT1 has a decrement at step S171, and the dip switch SW1 is checked at step S172. The dip switch SW1 is to set the scale mode as the document stopping mode. If the dip switch SW1 is on at step S172, the pulse P02 is replaced by P02+$\alpha/2$ at step S173, and the pulse P04 is replaced by P04+$\alpha$ at step S174 (see FIG. 16). In the pulse control mode, these amendments to the pulse P02 and to the pulse P04 are not necessary.

FIGS. 36*a* through 36*d* show the pre-feeding subroutine carried out at steps S142, S145 and S148.

In this subroutine, the processing proceeds in accordance with the value of the pre-feed status K checked at step S180.

If the status K is "1" (see step S126 in the initialization subroutine), the leading edge regulation plate 63 and the pressing plate 70 are returned to their home positions as follows. The pick-up motor M1 is rotated forward at step S181, and the cam sensor SE11 is checked at step S182. As shown in FIG. 7, the home position of the leading edge regulation plate 63 is the regulating position (upper position), and the home position of the pressing plate 70 is the retreating position (upper position). The pick-up motor M1, which is connected to the cam shaft 147, is rotated forward. Then, when the edge 148*a* of the disk 148 comes to the optical axis of the sensor SE11, both the leading edge regulation plate 63 and the pressing plate 70 come to the respective home positions. Accordingly, when on-edge of the cam sensor SE11 is confirmed at step S182, the pick-up motor M1 is turned off at step S183. Then, the status K is set to "2" at step S184.

While the status K is "2", nothing is handled in this subroutine.

If the status K is "3" (see step S166 in the start check subroutine), the leading edge regulation plate 63 and the pressing plate 70 are moved to the retreating position and the pressing position respectively. The pick-up motor M1 is rotated forward at step S185, and the cam sensor SE11 is checked at step S186. With the forward rotation of the pick-up motor M1, the disks 148 and 149 rotate together counterclockwise in FIG. 7. When the disks 148 and 149 rotate by 250 degrees from the state shown in FIGS. 7 and 8, the edge 148*b* of the disk 148 comes to the optical axis of the sensor SE11, and accordingly the sensor SE11 is turned off. In this moment, as shown in FIG. 10, the pressing plate 70 comes down to the pressing position to press the leading portion of the stack of documents against the pick-up roller 65, whereas the leading edge regulation plate 63 is kept in the retreating position. Accordingly, when off-edge of the sensor SE11 is confirmed at step S186, the pick-up motor M1 is turned off at step S187, and the timer T101 is started at step S188. Then, the status K is set to "4" at step S189.

If the status K is "4", the timer T101 is checked at step S190. On the expiration of the timer T101, the feed motor M2 is turned on at step S191. Thereby, the pick-up roller 65 and the separation roller 75 are rotated, and a document at the bottom of the stack is fed out of the tray 61. Then, the status K is set to "5" at step S192.

If the status K is "5", the register sensor SE2 is checked at step S193. When on-edge of the sensor SE2 is confirmed, that is, when the sensor SE2 detects the leading edge of the fed document, the timer T102 is started at step S194, and the counter DCNT2 gains an increment at step S195. Then, the status K is set to "6" at step S196.

If the status K is "6", the timer T102 is checked at step S197. On the expiration of the timer T102, the width sensor SE10 is checked at step S198. The sensor SE10 is to detect the width of the fed document. If the sensor SE10 is on, a width flag is set to "1" at step S199. If the sensor SE10 is off, the width flag is reset to "0" at step S200. Subsequently, the feed motor M2 is turned off at step S201, and the pick-up motor M1 is reversed. Thereby, the cams 145 and 146 start rotating clockwise from the state shown in FIG. 10. Then, the status K is set to "7" at step S203.

If the status K is "7", the pressing plate 70 is moved up to the retreating position.

When the cams 145 and 146 rotate clockwise by 160 degrees (see FIG. 9), the pressing plate 70 is moved up to the retreating position, whereas the leading edge regulation plate 63 is kept in the retreating position. In this moment, the edge 149*a* of the disk 149 comes to the optical axis of the cam sensor SE12, and the sensor SE12 is turned on. Accordingly, when on-edge of the sensor SE12 is confirmed at step S204, the pick-up motor M1 is turned off at step S205. Subsequently, a flag DSET is checked at step S206. The flag DSET is set to "1" when a document is set in the scanning position (see steps S241 and S259 in a pre-step setting subroutine, and steps S361 in a two-in-one setting subroutine). If the flag DSET is "0", a set status S gains an increment at step S207. Then, the status K is set to "8" at step S208.

The pre-feeding subroutine is thus completed. While the status K is "8", nothing is handled in this subroutine.

FIGS. 37*a* through 37*g* show the pre-step setting subroutine for setting documents on the platen glass 29 in the pre-step mode carried out at step S143.

In this subroutine, the processing proceeds in accordance with the value of the set status S checked at step S210.

While the status S is "0", nothing is handled in this subroutine.

If the status S is "1", that is, when the pre-feeding is completed (see step S207), the main motor M3 is turned on for high-speed forward rotation at step S211. Thereby, the pre-fed document is conveyed from the register roller pair 90 onto the platen glass 29. Then, the counter PLSCNT1 is checked at step S212. When the counter PLSCNT1 has counted the pulse P01, the register sensor SE2 is checked at step S213 and the empty sensor SE1 is checked at step S214. The pulse P01 is for the small document size. If the register sensor SE2 and the empty sensor SE1 are off and on respectively, that is, if the pre-fed document is of the small size and a document is on the tray 61, the pre-feed status K is set to "3" at step S215. Then, the rotating speed of the main motor M3 is decreased at step S216, and the status S is set to "2" at step S217.

On the other hand, if the register sensor SE2 is on, which means that the pre-fed document is of the large size, the flag LSIZE is set to "1" at step S219. Then, the status S is set to "7" at step S220. If the empty sensor SE1 is off, which means that no documents are on the tray 61 any more, the status K is set to "1" at step S218, and the status S is set to "7" at step S220.

While the counter PLSCNT1 is counting the pulse P01 ("NO" at step S212), when off-edge of the register sensor SE2 is confirmed at step S221, the size of the document is detected at step S222. Further, the empty sensor SE1 is checked at step S223. If the sensor SE1 is on, which means that there is still a document on the tray 61, the counter DCNT1 gains an increment at step S224.

If the status S is "2", it is judged at step S225 whether the counter PLSCNT1 has counted the pulse P02. The pulse P02 is to convey a document by the distance L/2 (see FIG. 15). When the counter PLSCNT1 has counted the pulse P02, which means that the leading edge of the document has reached the intermediate point IP, the main motor M3 is turned off at step S226, and the status S is set to "3" at step S227. While the counter PLSCNT1 is counting the pulse P02, the processing at the steps S221 through S224 is repeated.

While the status S is "3", nothing is handled in this subroutine.

If the status S is "4", which means pre-feeding of the next document has been completed (see step S207 and step S288 in a DCHG check subroutine 1), the main motor M3 is turned on for high-speed forward rotation at step S228. Thereby, the former document is conveyed to the scanning position, and the latter document is conveyed to the pre-step position. When it is judged at step S229 that the counter PLSCNT1 has counted the pulse P01, the register sensor SE2 is checked at step S230, and the empty sensor SE1 is checked at step S231. If the sensors SE2 and SE1 are off and on respectively, that is, if the latter document is of the small size and there is still a document on the tray 61, the pre-feed status K is set to "3" at step S232, and the rotating speed of the main motor M3 is decreased at step S235. Then, the scale 120 is moved up to protrude over the platen glass 29 if the feeding is in the scale mode (see FIG. 38), and the status S is set to "5" at step S237.

On the other hand, if the register sensor SE2 is on, which means that the latter document is of the large size, a pre-feeding inhibition flag is set to "1" at step S234. Then, the processing at steps S235 through S237 is carried out. If the empty sensor SE1 is off, which means that no documents are on the tray 61, the pre-feed status K is set to "1" at step S233. Then, the processing at steps S235 through S237 is carried out.

While the counter PLSCNT1 is counting the pulse P01 ("NO" at step S229), the processing at steps S221 through S224 is carried out to detect the size of the latter document.

If the status S is "5", it is judged at step S238 whether the counter PLSCNT1 has counted the pulse P02. If the result is "YES", which means that the leading edge of the former document and the leading edge of the latter document have reached the scanning reference point SP and the intermediate point IP respectively, the main motor M3 is turned off at step S239. Subsequently, the timer T201 is started at step S240, and a flag DSET is set to "1" at step S241. Then, the status S is set to "6" at step S242. The state of "1" of the flag DSET indicates that a document is set in the scanning position, and this information is transmitted to the CPU1. Accordingly, at that time, the optical system 20 comes to an operational state in the copying apparatus body 1. While the counter PLSCNT1 is counting the pulse P02, the processing at steps S221 through S224 is carried out.

If the status S is "6", the timer T201 is checked at step S243. When the expiration of the timer T201 is confirmed, the scale solenoid SL1 is turned off at step S244. In the scale mode, the scale 120 is moved down to the retreating position in this moment, and in the pulse control mode, the scale 120 is kept in the retreating position. Next, the counter DCHG is checked at step S245. A subroutine for the checking (DCHG check subroutine 1) will be described later referring to FIG. 39.

If the status S is "7" (see step S292 in the DCHG check subroutine 1), the main motor M3 is turned on for high-speed forward rotation at step S246. Thereby, the document of the large size is conveyed from the intermediate position. Next, it is judged at step S247 whether the counter PLSCNT1 has counted the pulse P03. When the counter PLSCNT1 has counted the pulse P03, the register sensor SE2 and the empty sensor SE1 are checked at steps S248 and S249 respectively. If the register sensor SE2 and the empty sensor SE1 are off and on respectively, the pre-feed status K is set to "3" at step S252 for pre-feeding of the next document. Further, the rotating speed of the main motor M3 is decreased at step S253, and in the scale mode, the scale 120 is moved up to protrude over the platen glass 29 at step S253 (see FIG. 38). Then, the status S is set to "8" at step S254.

On the other hand, if the register sensor SE2 is on, which means that the large size document has not completely passed through the register roller pair 90, sheet jamming is treated at step S255. If the empty sensor SE1 is off, which means that no documents are on the tray 61, the pre-feed status K is set to "1" at step S251, and the processing at steps S252 through S254 is carried out.

While the counter PLSCNT1 is counting the pulse P03 ("NO" at step S247), the processing at steps S221 through S224 is carried out to detect the size of the document.

If the status S is "8", it is judged at step S256 whether the counter PLSCNT1 has counted the pulse P04. If the result is "YES", which means that the leading edge of the large size document has reached the scanning reference point SP, the main motor M3 is turned off at step S257. Subsequently, the timer T201 is started at step S258, and the flag DSET is set to "1" at step S259. Then, the status S is set to "6" at step S260. While the counter PLSCNT1 is counting the pulse P04, the processing at steps S221 through S224 is carried out.

If the status S is "9" (see step S293 in the DCHG check subroutine 1), the main motor M3 is turned on for high-speed forward rotation at step S261. Thereby, the document is ejected from the scanning position. Then, when off-edge of the ejection sensor SE3 is confirmed at step S262, that is, when the trailing edge of the document has separated from the conveyer belt 95, the main motor M3 is turned off at step S263. Subsequently, the counter MODE is reset to "0" at step S264, and the status S is reset to "0" at step S265.

Now detection of sheet jamming in the pre-step mode is described. While the status S is "1", even if the register sensor SE2 is on ("NO" at step S213), sheet jamming treatment is not carried out. However, while the status S is "7", if the register sensor SE2 is still on after conveyance of a document by the pulse P03 ("NO" at step S248), sheet jamming treatment is carried out. The pulse P03 is to convey a document by a distance slightly shorter than the distance L. Accordingly, if the result is "NO" at step S248, the document has a length larger than the distance L (500 m), or the document stops around the register roller pair 90 because of poor sheet transport. In such a case, judgment of sheet jamming is made. While the status S is "4", even if the register sensor SE2 is on ("NO" at step S230), the pre-feeding inhibition flag is set to "1". However, in this case, sheet jamming treatment is not carried out.

With the above arrangement, even if a document of the large size is present in the stack of documents, feeding in the pre-step mode is continued.

Figure 38:
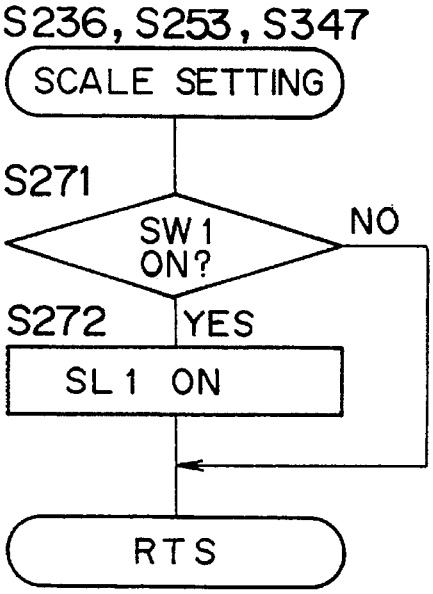
FIG. 38 is a flowchart showing a subroutine of the CPU2 for moving the scale.

FIG. 38 shows a subroutine for moving up the scale 120 carried out at steps S236, S253 and S347.

First, the dip switch SW1 is checked at step S271. If the switch SW1 is on, which means the scale mode is selected, the solenoid SL1 is turned on at step S272 to move up the scale 120. Thereby, the scale 120 comes over the platen glass 29 and functions as a stopper to stop a document with its leading edge positioned at the scanning reference point SP.

Figure 39:
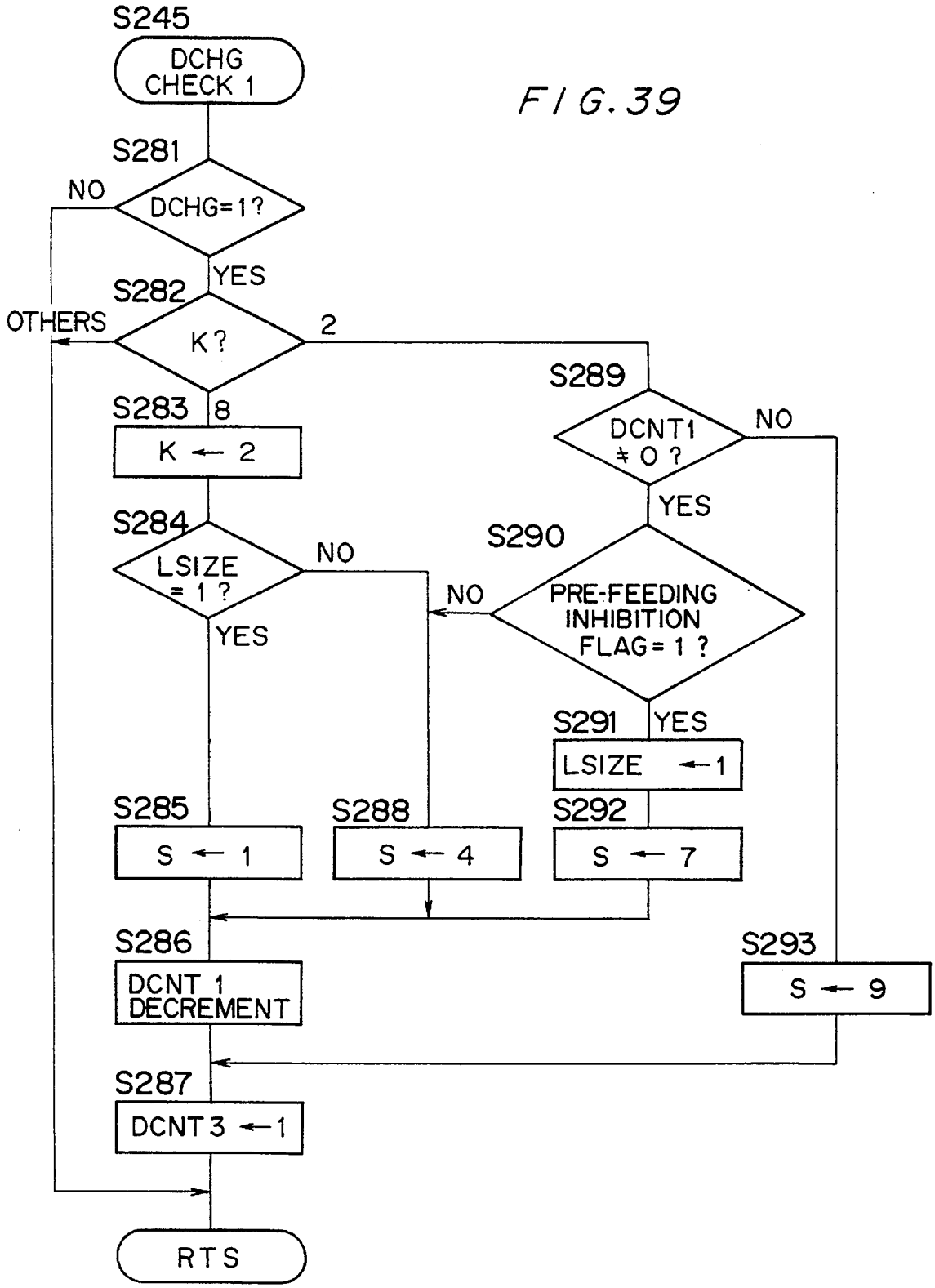
FIG. 39 is a flowchart showing a subroutine of the CPU2 for checking a counter DCHG in the pre-step mode.

FIG. 39 show the DCHG check subroutine 1 carried out at step S245.

The flag DCHG is checked at step S281, and only if the flag DCHG is "1", the following processing is carried out. The flag DCHG is in accordance with the document change command transmitted from the CPU1.

If the flag DCHG is "1", the pre-feed status K is checked at step S282. If the status K is "2" or "8", the following processing is carried out.

If the status K is "8", which means that pre-feeding of the next document is completed, the status K is set to "2" at step S283, and the flag LSIZE is checked at step S284. If the flag LSIZE is "1", which means that the fed document is of the large size, the status S is set to "1" at step S285. The counter DCNT has a decrement at step S286, and the counter DCNT3 for counting documents being ejected is set to "1" at step S287. If the flag LSIZE is "0", which means that the fed document is of the small size, the status S is set to "4" at step S288, and the processing at steps S286 and S287 is carried out.

If the status K is "2", which means that pre-feeding of the next document has not been completed (in the middle of the pre-feeding of the next document or no documents to be pre-fed), the counter DCNT1 is checked at step S289. Unless the counter DCNT1 is "0", the pre-feeding inhibition flag is checked at step S290. If the pre-feeding inhibition flag is "1", the flag LSIZE is set to "1" at step S291, and the status S is set to "1" at step S292. Then, the processing at steps S286 and S287 is carried out. If the pre-feeding inhibition flag is "0", the processing at steps S288, S286 and S287 is carried out. If the counter DCNT is "0", the status S is set to "9" at step S293, and the processing goes to step S287.

Figure 40:
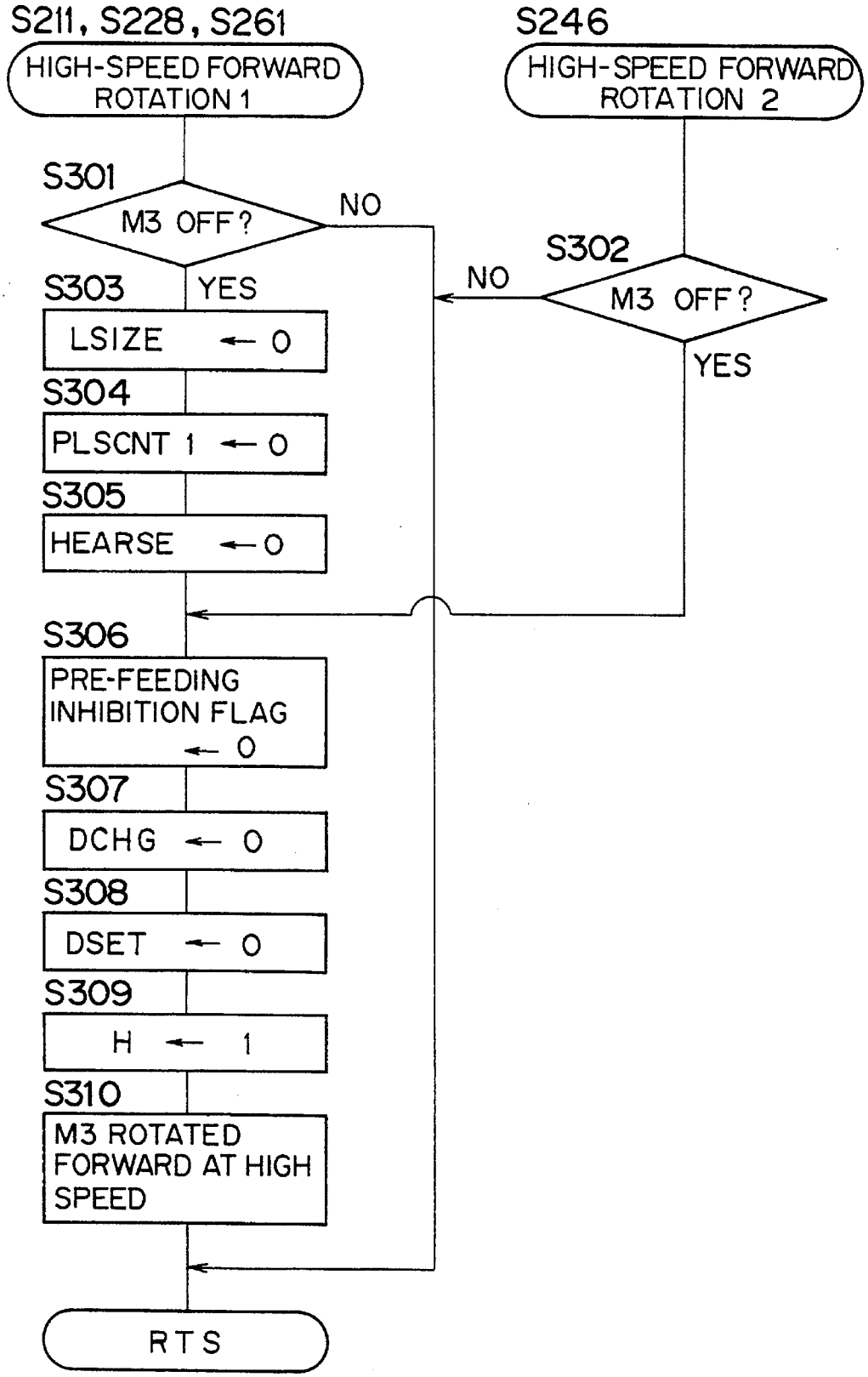
FIG. 40 is a flowchart showing a subroutine of the CPU2 for turning on the main motor for high-speed forward rotation.

FIG. 40 shows a subroutine for high-speed forward rotation of the main motor M3 carried out at steps S211, S228, S261 and S246.

First, the on/off state of the main motor M3 is checked at step S301 or S302. If the main motor M3 is on, this subroutine is immediately finished. If the main motor M3 is judged to be off at step S301, that is, if the set status S is "1", "4" or "9", the flag LSIZE is reset to "0" at step S303. The counter PLSCNT1 is reset to "0" at step S304, and the flag HERASE is reset to "0" at step S305. Subsequently, the pre-feeding inhibition flag, the flag DCHG and the flag DSET are reset to "0" at steps S306, S307 and S308 respectively. Further, an ejection status H is set to "1" at step S309. Then, the main motor M3 is set for high-speed forward rotation at step S310, and interruption is allowed. At each time of interruption, the main motor M3 is driven, and the counters PLSCNT1 and PLSCNT2 perform counting.

If the main motor M3 is judged to be off at step S302, that is, if the set status S is "7", the processing at steps S306 through S310 is carried out.

FIGS. 41*a* through 41*h* shows the two-in-one setting subroutine for setting documents on the platen glass 29 in the two-in-one mode carried out at step S146.

In this subroutine, the processing proceeds in accordance with the value of the set status S checked at step S320.

While the status S is "0", nothing is handled.

If the status S is "1", that is, when pre-feeding of a document is completed (see step S207), the main motor M3 is turned on for high-speed forward rotation at step S321 (see FIG. 40). Thereby, the document is conveyed from the register roller pair 90 onto the platen glass 29. Thereafter, the register sensor SE2 is checked at step S322. On off-edge of the register sensor SE2, that is, when the trailing edge of the document has passed the register sensor SE2, the size of the document is detected at step S323. Then, the empty sensor SE1 is checked at step S324. If the register sensor SE2 is off-edge at step S322 and the empty sensor SE1 is on at step S324, that is, if the fed document is of the small size and there is a document on the tray 61, the timer T202 is started at step S325, and the rotating speed of the main motor M3 is decreased at step S326. Then, the status S is set to "2" at step S327.

If the empty sensor SE1 is off, which means that no documents are on the tray 61, the flag HERASE is set to "1" at step S328. The flag HERASE, when it is "1", commands erasure of the latter half of an electrostatic latent image formed on the photosensitive drum 10 with scanning by the optical system 20 in the two-in-one mode. Subsequently, the counter DCNT3 is checked whether to be "2" at step S329. If the counter DCNT3 is "2", which means that there are two documents on the platen glass 29 to be ejected, the rotating speed of the main motor M3 is decreased at step S330, and the status S is set to "8" at step S3311. Unless the counter DCNT3 is "2", the status S is set to "5" at step S332.

If the register sensor SE2 is not judged to be off-edge at step S322, it is judged at step S333 whether the counter PLSCNT1 has counted the pulse P05. The pulse P05 is to convey a document of the large size. When the counting is finished, the flag LSIZE is set to "1" at step S334, and the processing at steps S329 through S331 or the processing at steps S329 and S332 is carried out.

If the status S is "2", the timer T202 is checked at step S335. On the expiration of the timer T202, the value of the pre-feed status K is checked at step S336. If the status K is "2", the status K is set to "3" at step S337 to start pre-feeding of the next document. If the timer T202 has not been expired or if the status K is not "2" even after the expiration of the timer T202, it is judged at step S338 whether the counter PLSCNT2 has counted the pulse P07. When the counter PLSCNT2 has counted the pulse P07, the main motor M3 is switched to low-speed reverse rotation at step S339. Thereby, the document makes a switchback. Then, the status S is set to "3" at step S340.

Figure 41A:
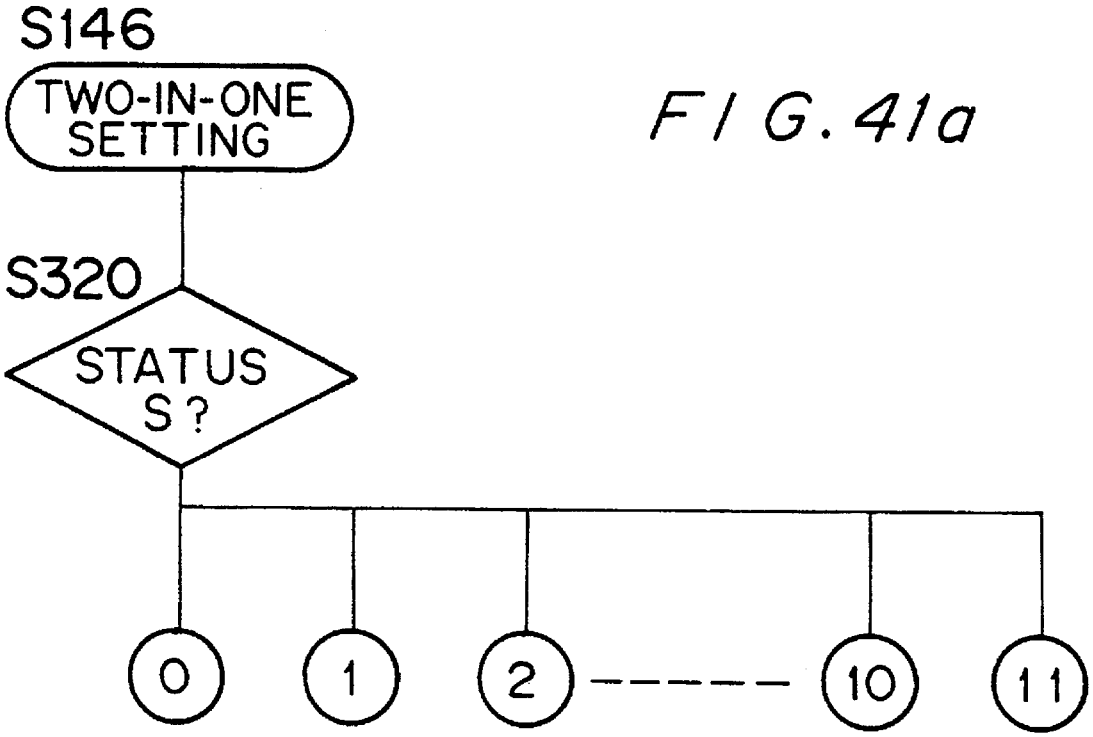
FIGS. 41*a* through 41*h* are flowcharts showing a subroutine of the CPU2 for setting documents on the platen glass in the two-in-one mode.
Figure 41B:
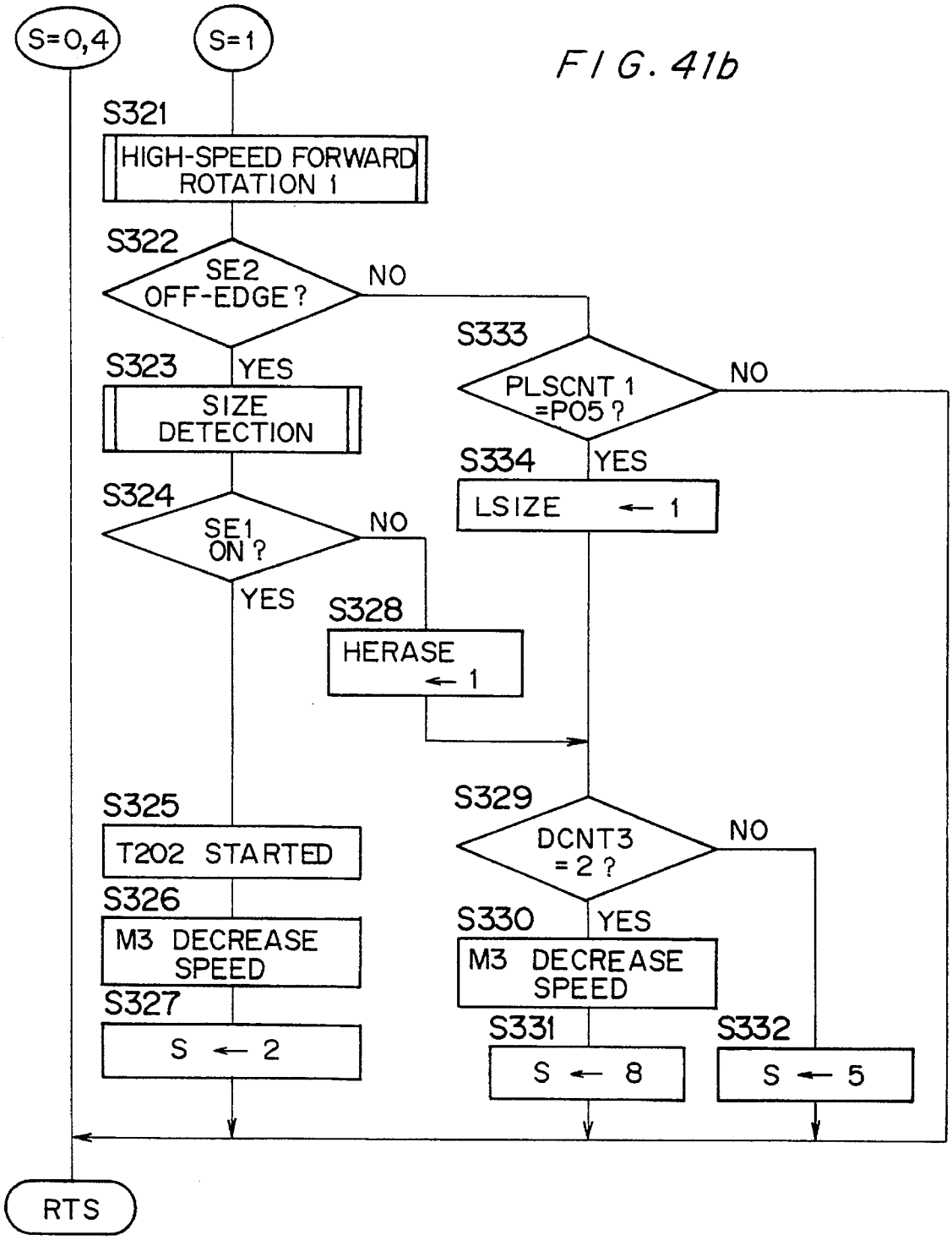
Figure 41C:
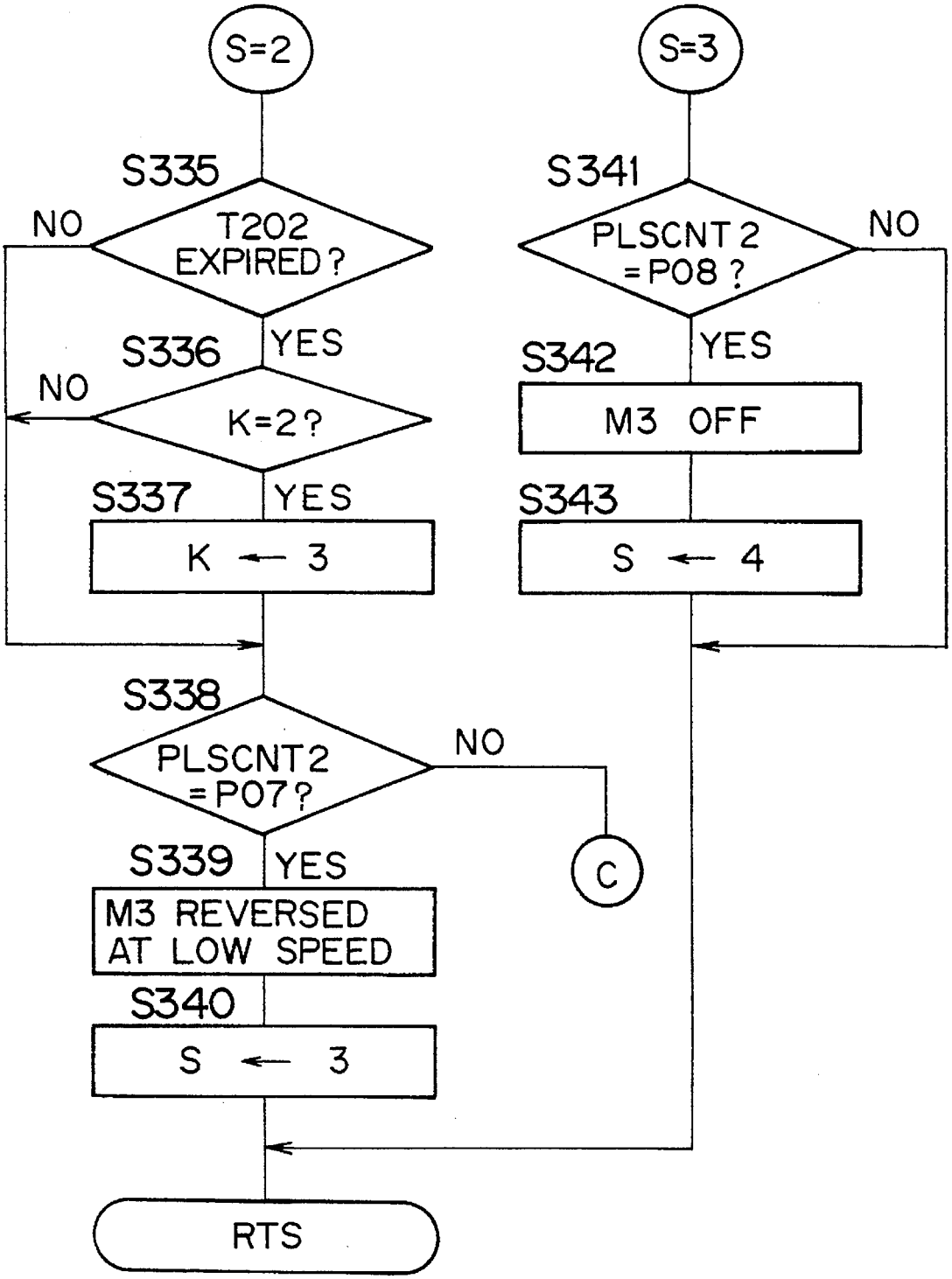
Figure 41D:
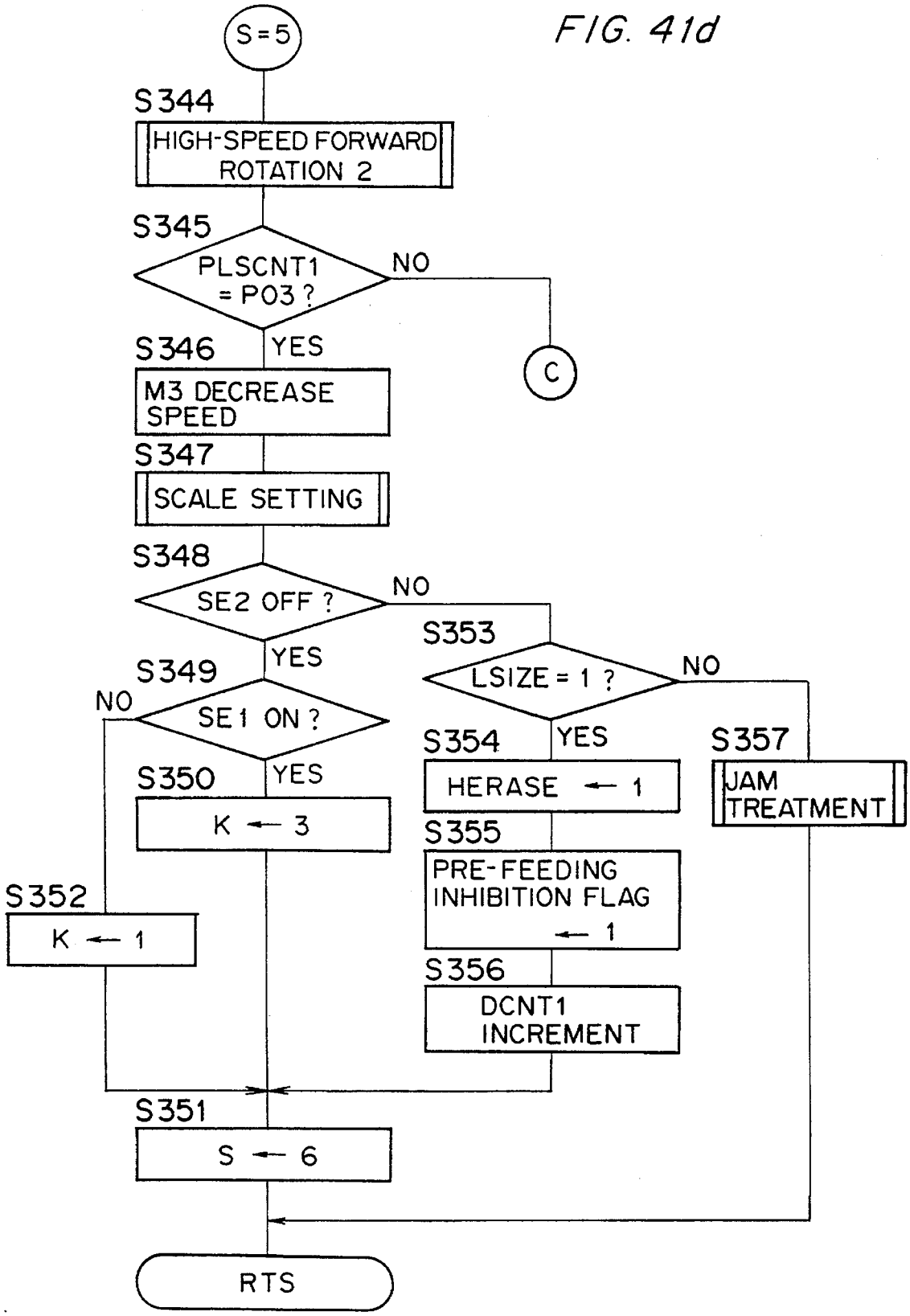
Figure 41E:
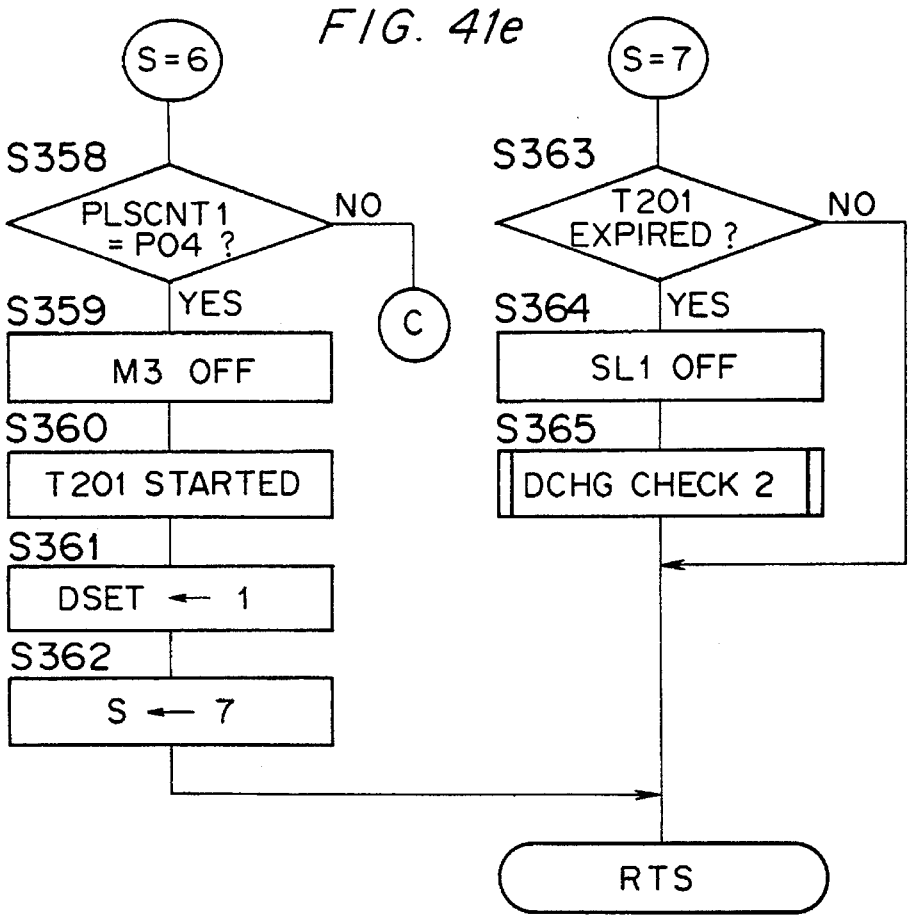
Figure 41F:
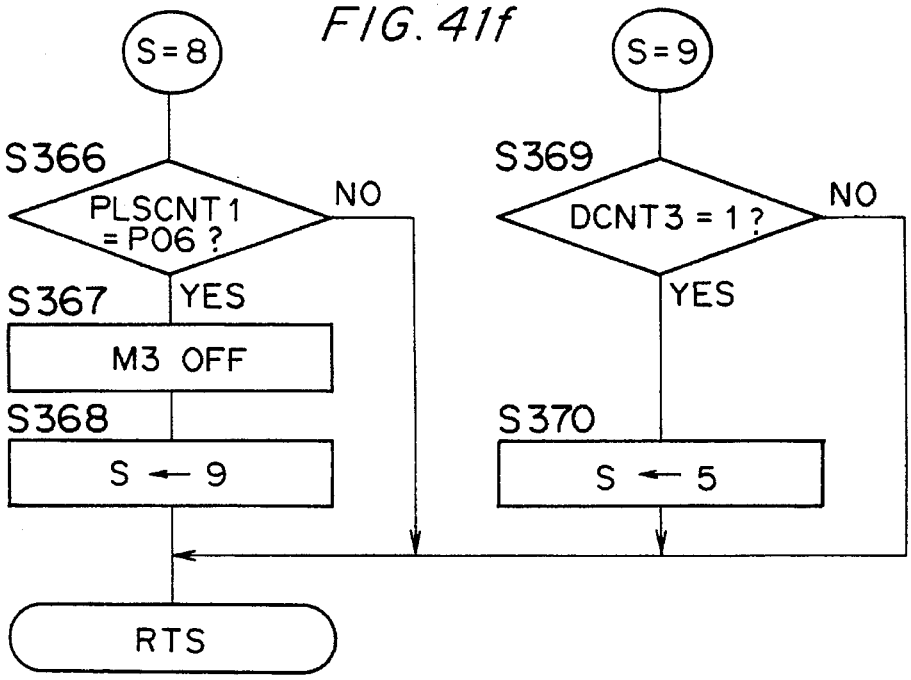
Figure 41G:
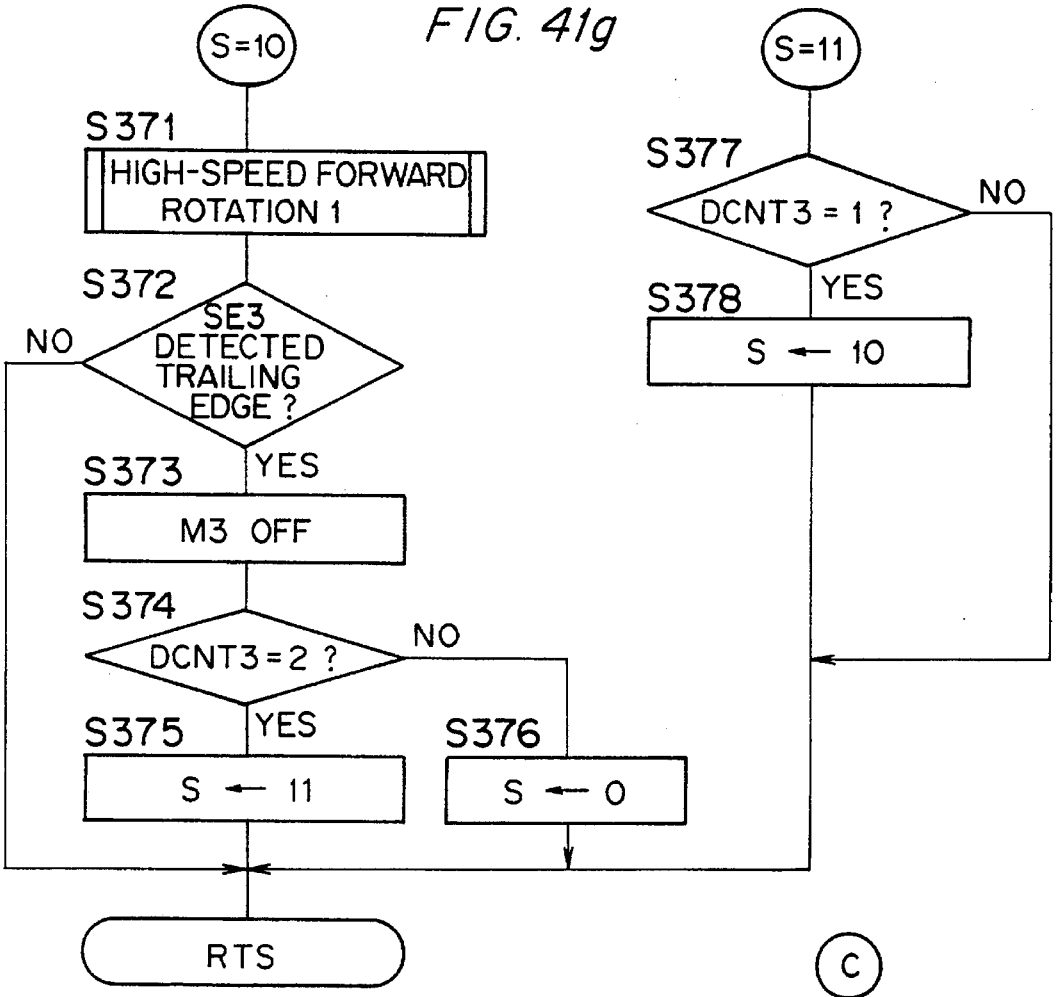
Figure 41H:
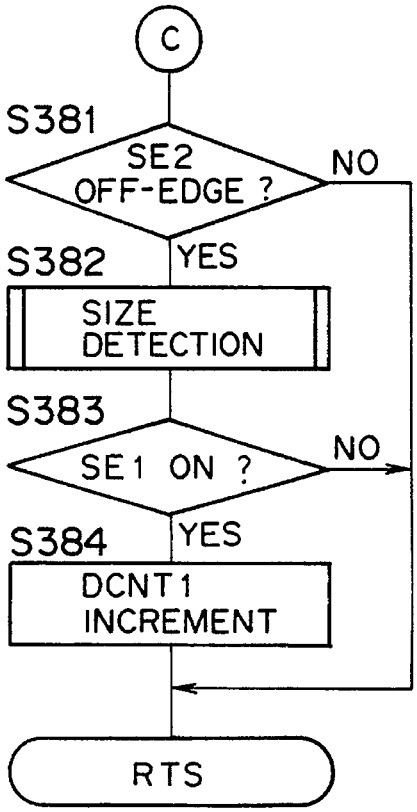

While the counter PLSCNT2 is counting the pulse P07, the processing shown in FIG. 41*h* is carried out. On off-edge of the register sensor SE2, the size of the document fed onto the platen glass 29 is detected at step S382. Subsequently, if the empty sensor SE1 is judged to be on at step S383, which means that there is a document on the tray 61, the counter DCNT1 gains an increment at step S384.

If the status S is "3", it is judged at step S341 whether the counter PLSCNT2 has counted the pulse P08. When the counting is finished, the main motor M3 is turned off at step S342. Thus, the switchback of the document is finished. Then, the status S is set to "4" at step S343.

While the status S is "4", nothing is handled in this subroutine.

If the status S is "5", which means that pre-feeding of the next document is completed (see steps S207, S370 and S412), the main motor M3 is turned on for high-speed forward rotation at step S344 (see FIG. 40). Thereby, the former document which made a switchback and the latter document are conveyed. When it is judged at step S345 that the counter PLSCNT1 has counted the pulse P03, the rotating speed of the main motor M3 is decreased at step S346. In the scale mode, at step S347 the scale 120 is moved up to protrude over the platen glass 29 (see FIG. 38).

Next, the register sensor SE2 and the empty sensor SE1 are checked at steps S348 and S349. If the sensors SE2 and SE1 are off and on respectively, that is, if the latter document is of the small size and there is a document on the tray 61, the pre-feed status K is set to "3" at step S350. Then, the status S is set to "6" at step S351. If the empty sensor SE1 is off, which means that no sheets are on the tray 61, the pre-feed status K is set to "1" at step S352, and the status S is set to "6" at step S351.

On the other hand, if the register sensor SE2 is on, the flag LSIZE is checked at step S353. If the flag LSIZE is "1", which means that the latter document is of the large size, the flag HERASE is set to "1" at step S354 such that only the former document of the small size will be copied. Further, the pre-feeding inhibition flag is set to "1" at step S355, and the counter DCNT1 gains an increment at step S356. Then, the processing goes to step S351. If the flag LSIZE is judged to be "0" at step S353, it can be judged that the latter document, which is of the small size, stops around the register roller pair 90. Therefore sheet jamming treatment is carried out at step S357.

While the counter PLSCNT1 is counting the pulse P03 ("NO" at step S345), the processing at steps S381 through S384 (see FIG. 41*h*) is carried out to detect the size of the latter document.

If the status S is "6", it is judged at step S358 whether the counter PLSCNT1 has counted the pulse P04. If the result is "YES", which means that the leading edge of the former document has reached the scanning reference point SP, the main motor M3 is turned off at step S359. If the latter document is of the large size, at that time, the document stops with its latter half before the register roller pair 90. Subsequently, the timer T201 is started at step S360, and the flag DSET is set to "1" at step S361. Then, the status S is set to "7" at step S362.

If the status S is "7", the timer T201 is checked at step S363. On the expiration of the timer T201, the scale solenoid SL1 is turned off at step S364. Thereby, in the scale mode, the scale 120 is moved down under the platen glass 29, and in the pulse control mode, the scale 120 is kept under the platen glass 29. Further, the counter DCHG is checked at step S365. A subroutine for this processing (DCHG check subroutine 2) will be described referring to FIG. 42.

If the status S is "8", which means that the latter document is of the large size (see step S331), it is judged at step S366 whether the counter PLSCNT1 has counted the pulse P06. When the counting has been finished, the main motor M3 is turned off at step S367. Then, the status S is set to "9" at step S368.

If the status S is "9", the counter DCNT3 is checked at step S369. If the counter DCNT3 is "1", which means only one document has been ejected, the status S is set to "5" at step S370.

If the status S is "10" (see step S413 in the DCHG check subroutine 2), the main motor M3 is turned on for high-speed forward rotation (see FIG. 40) at step S371. Thereby, the document is ejected from the scanning position. Then, when the ejection sensor SE3 detects the trailing edge of the document, that is, when the trailing edge of the document separates from the conveyer belt 95, the main motor M3 is turned off at step S373. Thereby, a space is made between two documents which are successively ejected. Subsequently, the counter DCNT3 is checked at step S374. If the counter DCNT3 is "2", the status S is set to "11" at step S375. If the counter DCNT3 is not "2", which means that only one document must be ejected, the status S is reset to "0" at step S376.

If the status S is "11", the counter DCNT3 is checked at step S377. If the counter DCNT3 is "1", the status S is set to "10" at step S378 for ejection of the latter document. If the counter DCNT3 is not "1", that is, if the counter DCNT3 is "2" (during ejection of the former document), nothing is handled in this subroutine.

Figure 42:
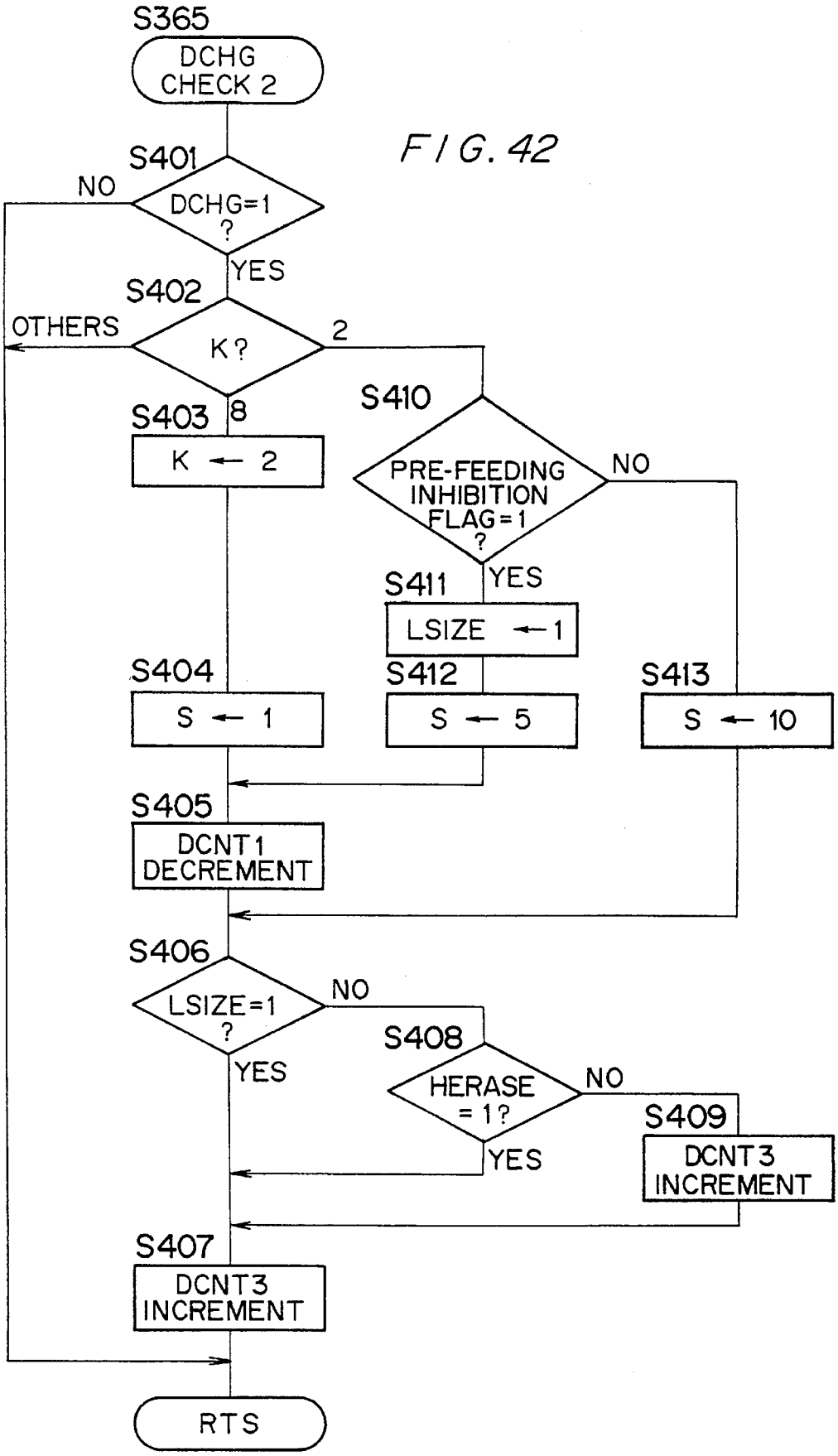
FIG. 42 is a flowchart showing a subroutine of the CPU2 for checking the counter DCHG in the two-in-one mode.

FIG. 42 shows the DCHG check subroutine 2 carried out at step S365.

The flag DCHG is checked at step S401, and only if the flag DCHG is "1", the following processing is carried out.

If the flag DCHG is judged to be "1" at step S401, the pre-feed status K is checked at step S402. Only if the status K is "2" or "8", this subroutine is continued.

If the status K is "8" which means that pre-feeding of the next document is completed, the status K is set to "2" at step S403, and the status S is set to "1" at step S404. Further, the counter DCNT1 has a decrement at step S405, and the flag LSIZE is checked at step S406. If the flag LSIZE is "1", which means that the fed document is of the large size, the counter DCNT3 for counting ejected documents gains an increment at step S407. If the flag LSIZE is "0", which means that the document is of the small size, the flag HERASE is checked at step S408. If the flag HERASE is "1", which means that one small size document is oil the platen glass 29 or that one small size document and one large size document are on the platen glass 29, the processing goes go step S407. If the flag HERASE is "0", the counter DCNT3 gains an increment at step S409, and then the processing goes to step S407.

If the status g is "2", which means pre-feeding of the next document has not started, the pre-feeding inhibition flag is checked at step S410. If the pre-feeding inhibition flag is "1", the flag LSIZE is set to "1" at step S411, and the status S is set to "5" at step S412. Then, the processing at steps S405 through S409 is carried out. If the pre-feeding inhibition flag is "0", the status S is set to "10" at step S413. Then, the processing at steps S406 through S409 is carried out.

Figure 43A:
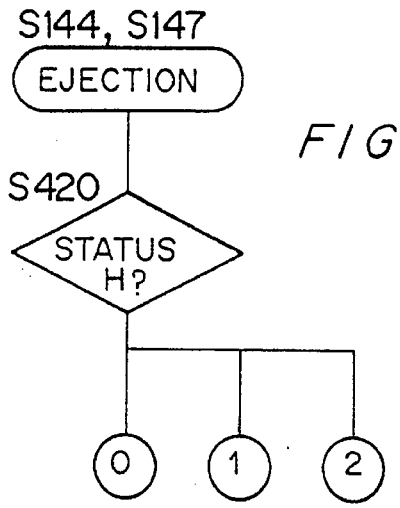
FIGS. 43*a* through 43*c* are flowcharts showing a subroutine of the CPU2 for ejecting documents from the platen glass in the pre-step mode and in the two-in-one mode.
Figure 43B:
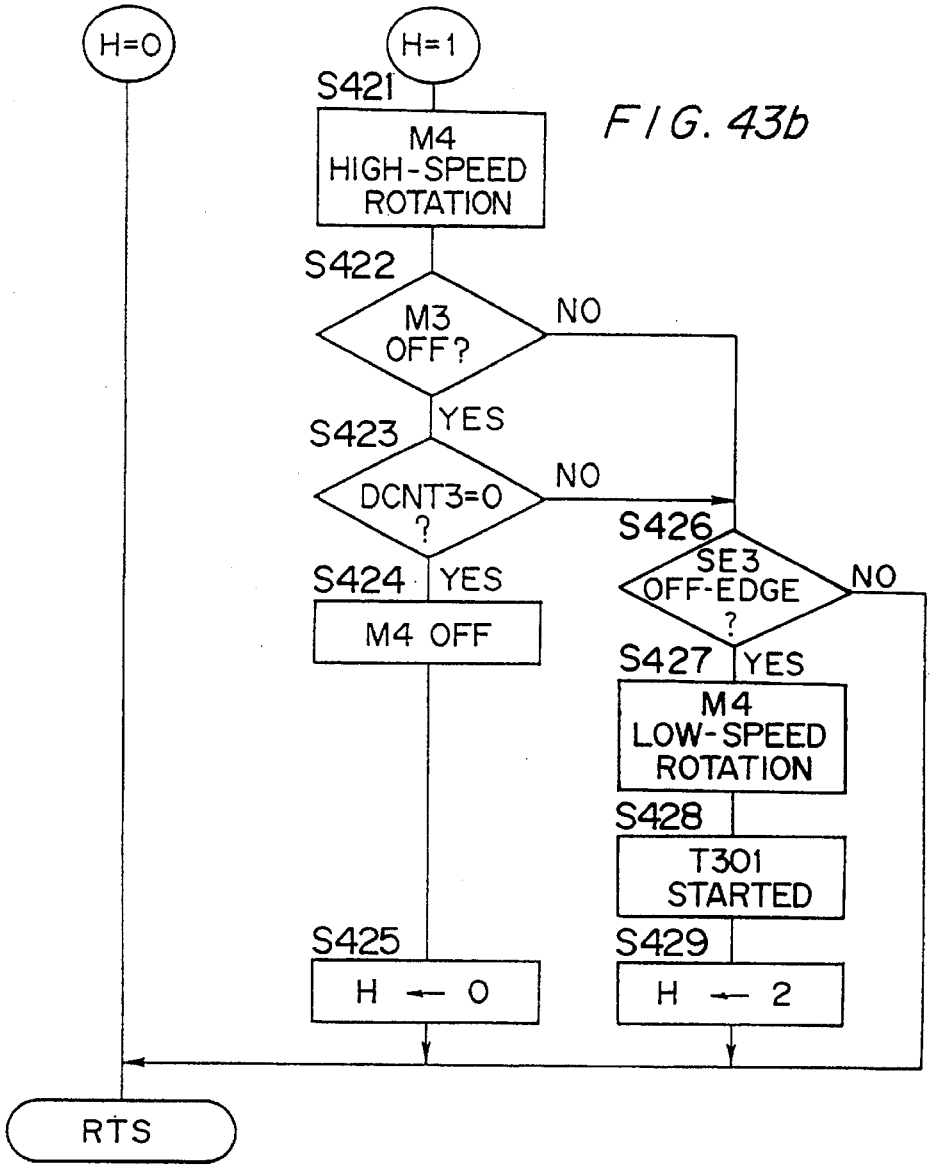
Figure 43C:
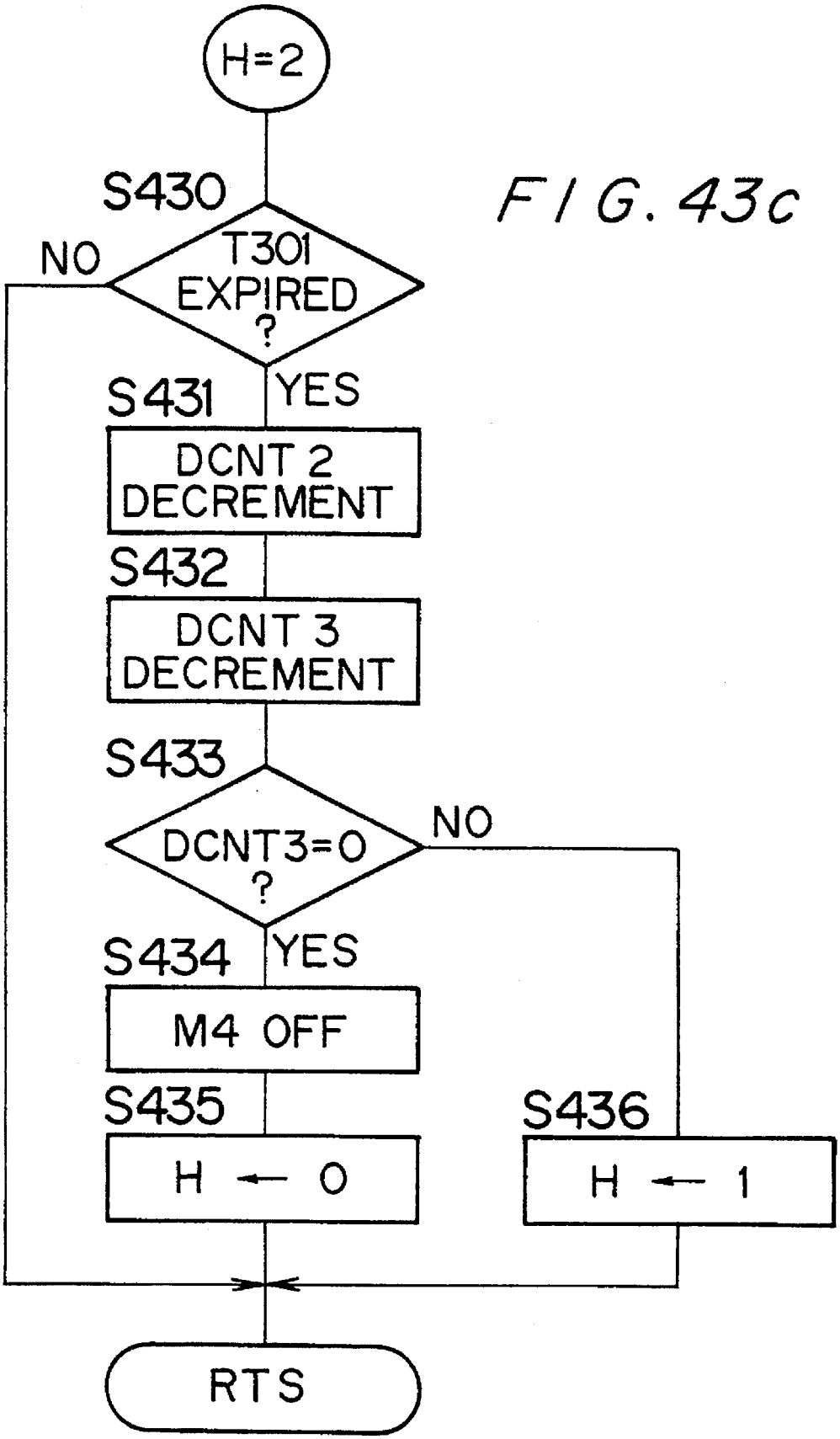

FIGS. 43*a*, 43*b* and 43*c* show a subroutine for the document ejection in the pre-step mode and in the two-in-one mode carried out at steps S144 and S147.

In this subroutine, the processing proceeds in accordance with the value of the ejection status H checked at step S420.

While the status H is "0", nothing is handled in this subroutine.

If the status H is "1" (see step S309 in the main motor driving subroutine), the ejection motor M4 is turned on for high-speed rotation at step S421. The main motor M3 is checked at step S422, and the counter DCNT3 is checked at step S423. If the main motor M3 is off and the counter DCNT3 is "0", which means that there are no documents to be ejected, the ejection motor M4 is turned off at step S424. Then, the status H is reset to "0" at step S425.

If the main motor M3 is on, or if the counter DCNT3 is not "0" even after turning-off of the main motor M3, a document is being ejected. The ejection sensor SE3 is checked at step S426. On off-edge of the sensor SE3, that is, when the trailing edge of the document passed the sensor SE3, the ejection motor M4 is switched to low-speed rotation at step S427, and the timer T301 is started at step S428. Then, the status H is set to "2" at step S429.

If the status H is "2", the timer T301 is checked at step S430. On the expiration of the timer T301, the counter DCNT2 has a decrement at step S431, and the counter DCNT3 has a decrement at step S432. Subsequently, the counter DCNT3 is checked at step S433. If the counter DCNT3 is "0", which means that there are no more documents to be ejected, the ejection motor M4 is turned off at step S434, and the status H is reset to "0" at step S435. The counter DCNT3 is not "0", which means that there is still a document to be ejected, the status H is set to "1" at step S436 to continue the document ejection.

Figure 44A:
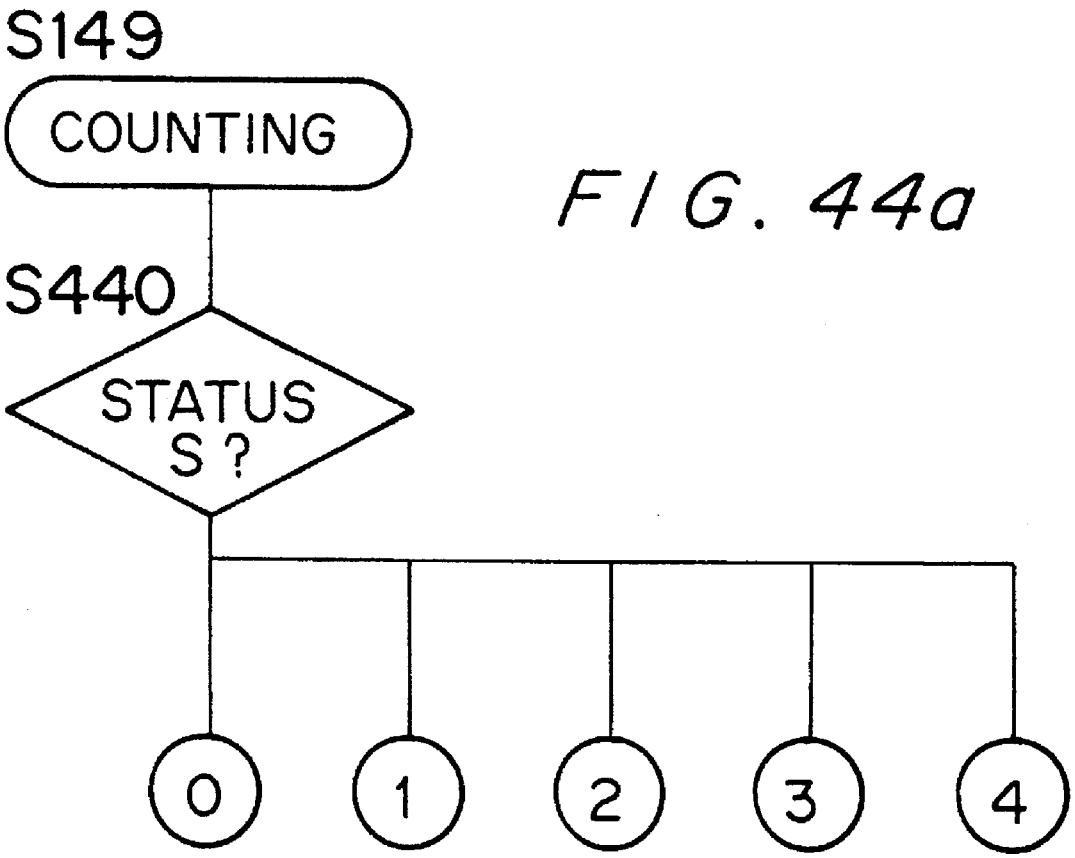
FIGS. 44*a* through 44*c* are flowcharts showing a subroutine of the CPU2 for setting documents on the platen glass in a count mode.
Figure 44B:
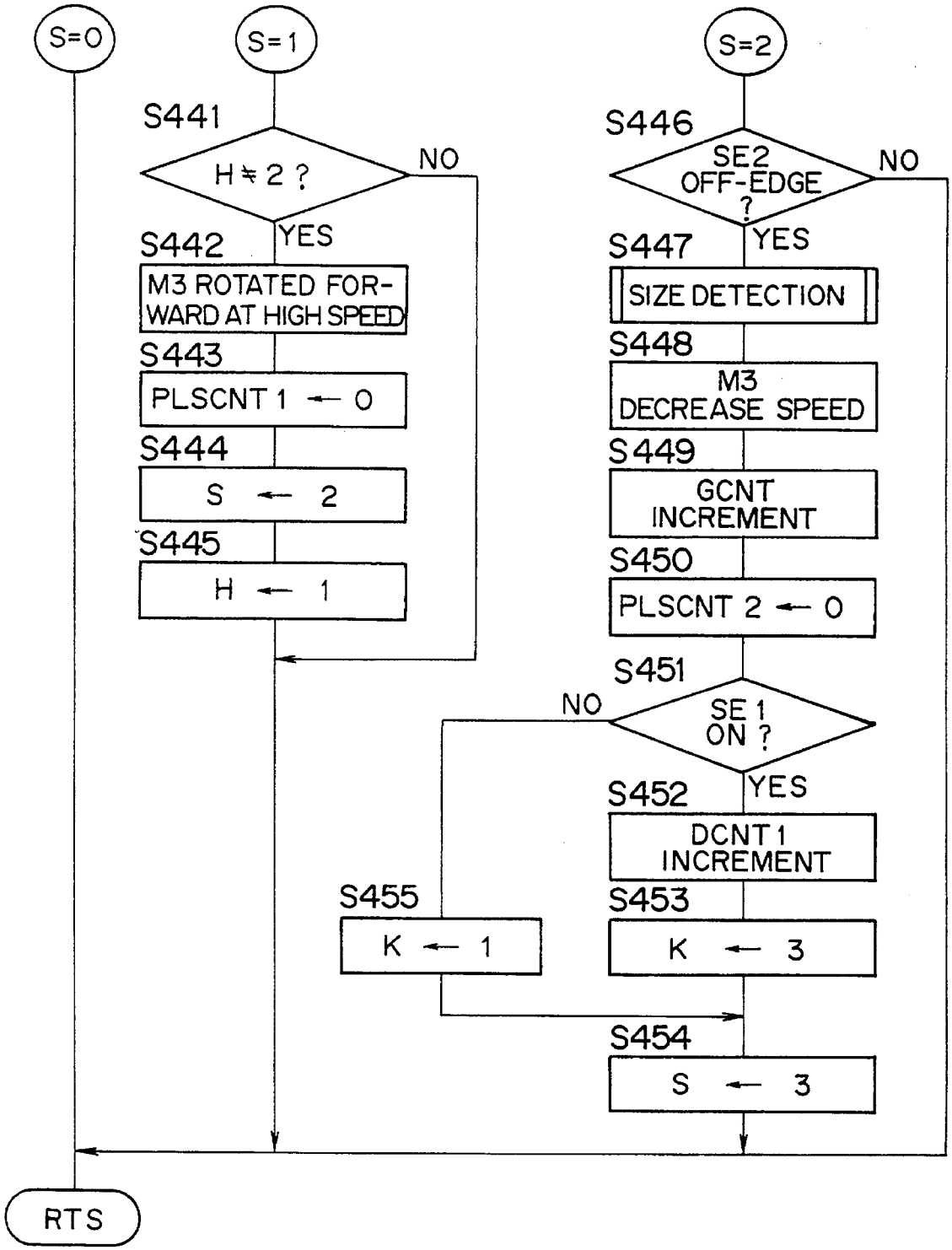
Figure 44C:
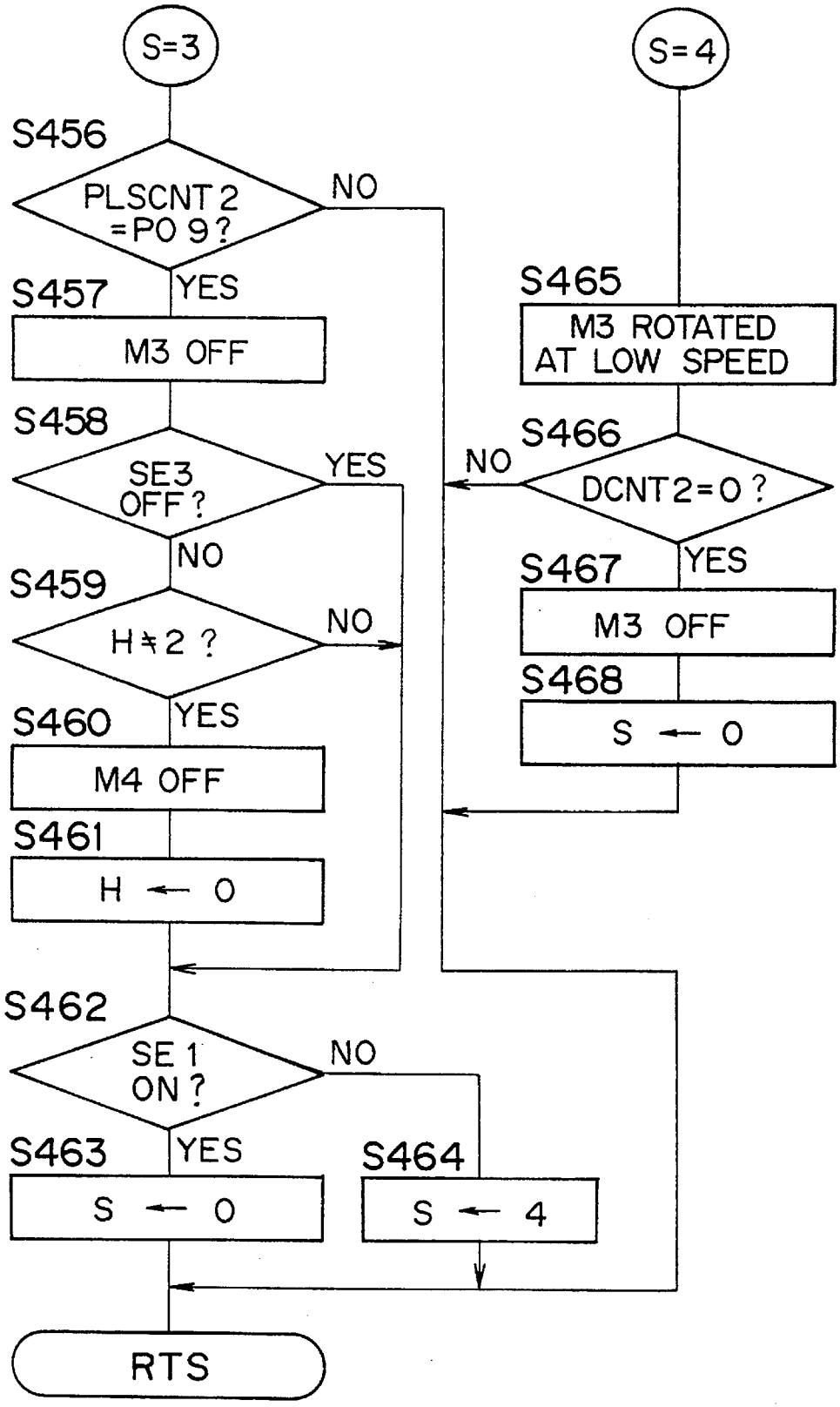

FIGS. 44*a*, 44*b* and 44*c* show a subroutine for the document counting carried out at step S149. In this subroutine and a count ejection subroutine which will be described later, documents are fed from the tray 61 onto the platen glass 29 and then ejected onto the tray 115 one by one, and the documents are automatically counted. In this subroutine, the processing proceeds in accordance with the value of the set status S checked at step S440.

While the status S is "0", nothing is handled in this subroutine.

If the status S is "1", which means that pre-feeding of a document is completed (see step S207), the ejection status H is checked at step S441. If the status H is not "2", that is, if the rotating speed of the ejection motor M4 is not decreased, the main motor M3 is turned on for high-speed forward rotation at step S442. Thereby, the pre-fed document is fed from the register roller pair 90 onto the platen glass 29. Further, the counter PLSCNT1 is reset to "0" at step S443, and the status S is set to "2" at step S444. Then, the status H is set to "1" at step S445.

If the status S is "2", the register sensor SE2 is checked at step S446. On off-edge of the sensor SE2, that is, when the trailing edge of the document has passed the sensor SE2, the size of the document is detected at step S447. Subsequently, the rotating speed of the main motor M3 is decreased at step S448. The counter GCNT for counting documents gains an increment at step S449, and the counter PLSCNT2 is reset to "0" at step S450. Further, the empty sensor SE1 is checked at step S451. If the sensor SE1 is on, the counter DCNT1 gains an increment at step S452, and the pre-feed status K is set to "3" at step S453 to start pre-feeding of the next document. Then, the status S is set to "3" at step S454. If the sensor SE1 is off, which means that no documents are on the tray 61, the status K is set to "1" at step S455, and the processing goes to step S454.

If the status S is "3", it is judged at step S456 whether the counter PLSCNT2 has counted the pulse P09. On the completion of the counting, the main motor M3 is turned off at step S457. The pulse P09 is to stop the document on the platen glass 29 with its trailing edge positioned at the point X (see FIG. 15). The pulse P09 corresponds to the number of pulses to drive the main motor M3 from the time when the trailing edge of the document has passed the register sensor SE2 to the time when the trailing edge reaches the point X. As mentioned, the point X can be set at any place as long as it is downstream of the nipping portion of the register roller pair 90 and as long as it contributes to shortening of the interval between successive two documents.

Next, the ejection sensor SE3 is checked at step S458, and the ejection status H is checked at step S459. If the sensor SE3 is off and the status H is not "2", which means that no documents are being ejected, the ejection motor M4 is turned off at step S460, and the status H is reset to "0" at step S461. Thereafter, the empty sensor SE1 is checked at step S462. If the sensor SE1 is on, the status S is reset to "0" at step S463 so as to wait for the completion of pre-feeding of the next document. If the sensor SE1 is off, the status S is set to "4" at step S464. On the other hand, if the ejection sensor SE3 is on at step S458, or if the status H is "2" at step S459, the processing goes to step S462 immediately.

If the status S is "4", which means that the last document has been fed onto the platen glass 29, the rotating speed of the main motor M3 is decreased. If the counter DCNT2 is judged to be "0" at step S466, which means that no more documents are on the platen glass 29, the main motor M3 is turned off at step S467. Then, the status S is reset to "0" at step S468.

Figure 45:
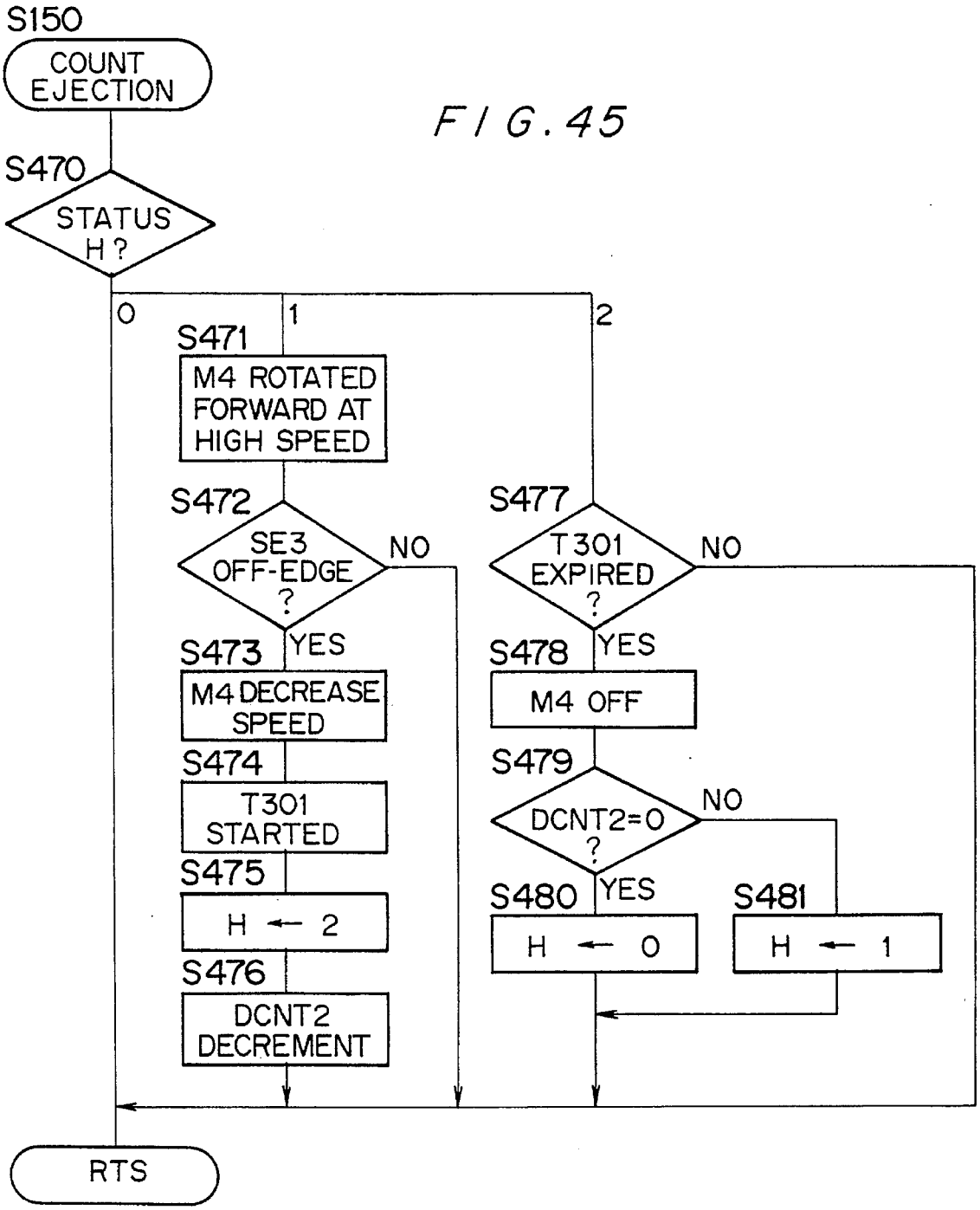
FIG. 45 is a flowchart showing a subroutine of the CPU2 for ejecting documents from the platen glass in the count mode.

FIG. 45 shows a subroutine for the count ejection carried out at step S150.

In this subroutine, the processing proceeds in accordance with the value of the ejection status H checked at step S470.

While the status H is "0", nothing is handled.

If the status H is "1", which means that feeding of a document with forward rotation of the main motor M3 is started (see step S445), the ejection motor M4 is turned on for high-speed rotation at step S471. Thereby, the reversing roller 100 and the ejection roller 110 are rotated, and the document is transported toward the tray 115. On off-edge of the ejection sensor SE3 at step S472, that is, when the trailing edge of the document has passed the sensor SE3, the rotating speed of the ejection motor M4 is decreased at step S473. Further, the timer T301 is started at step S474, and the status H is set to "2" at step S475. Then, the counter DCNT2 has a decrement at step S476.

If the status H is "2", the timer T301 is checked at step S477. On the expiration of the timer T301, the ejection motor M4 is turned off at step S478, and the counter DCNT2 is checked at step S479. If the counter DCNT2 is "0", which means that no documents are on the platen glass 29, the status H is reset to "0" at step S480. If the counter DCNT2 is not "0", which means that one or two documents are on the platen glass 29, the status H is set to "1" at step S481.

Figure 46A:
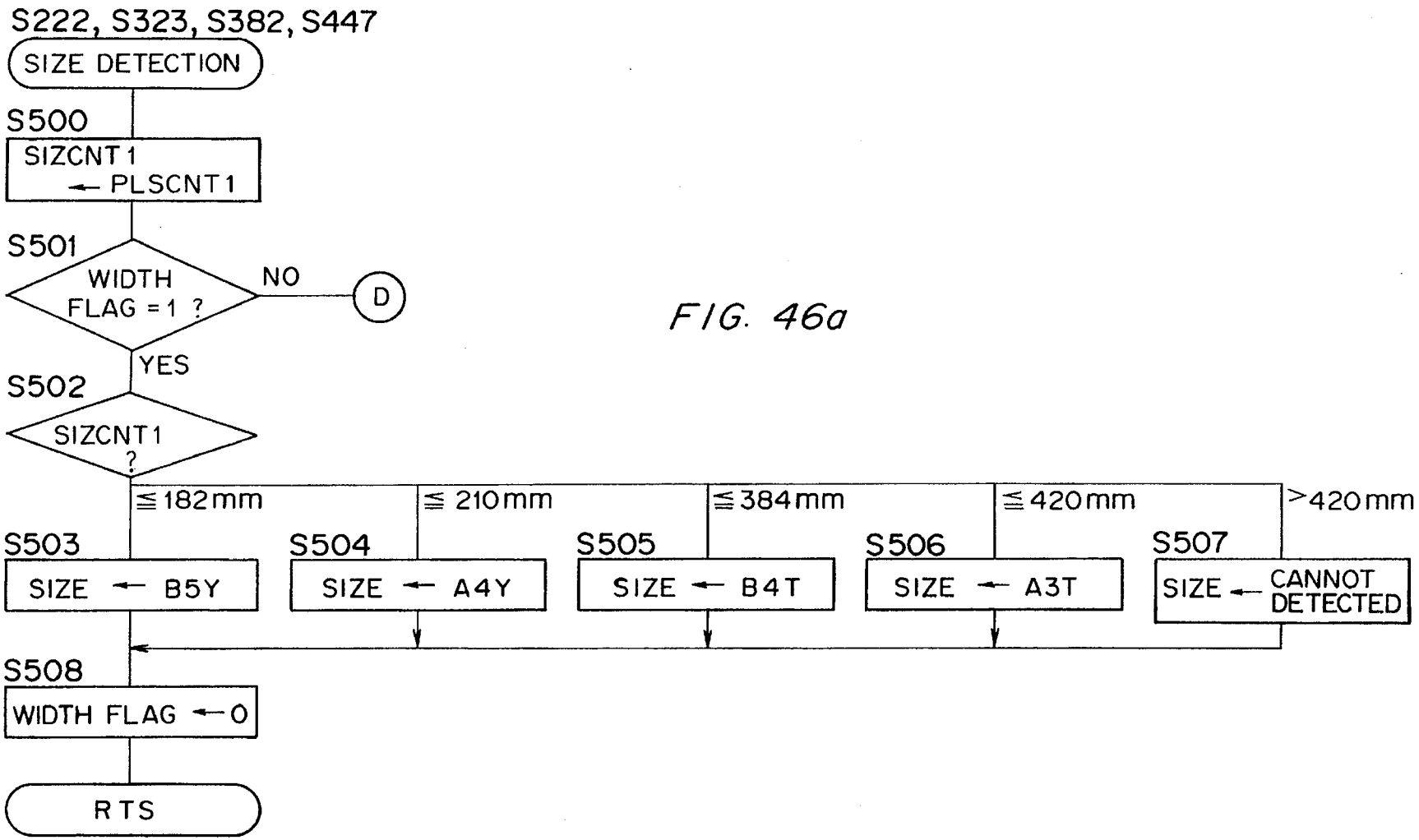
FIGS. 46*a* and 46*b* are flowcharts showing a subroutine of the CPU2 for detecting the size of a document.
Figure 46B:
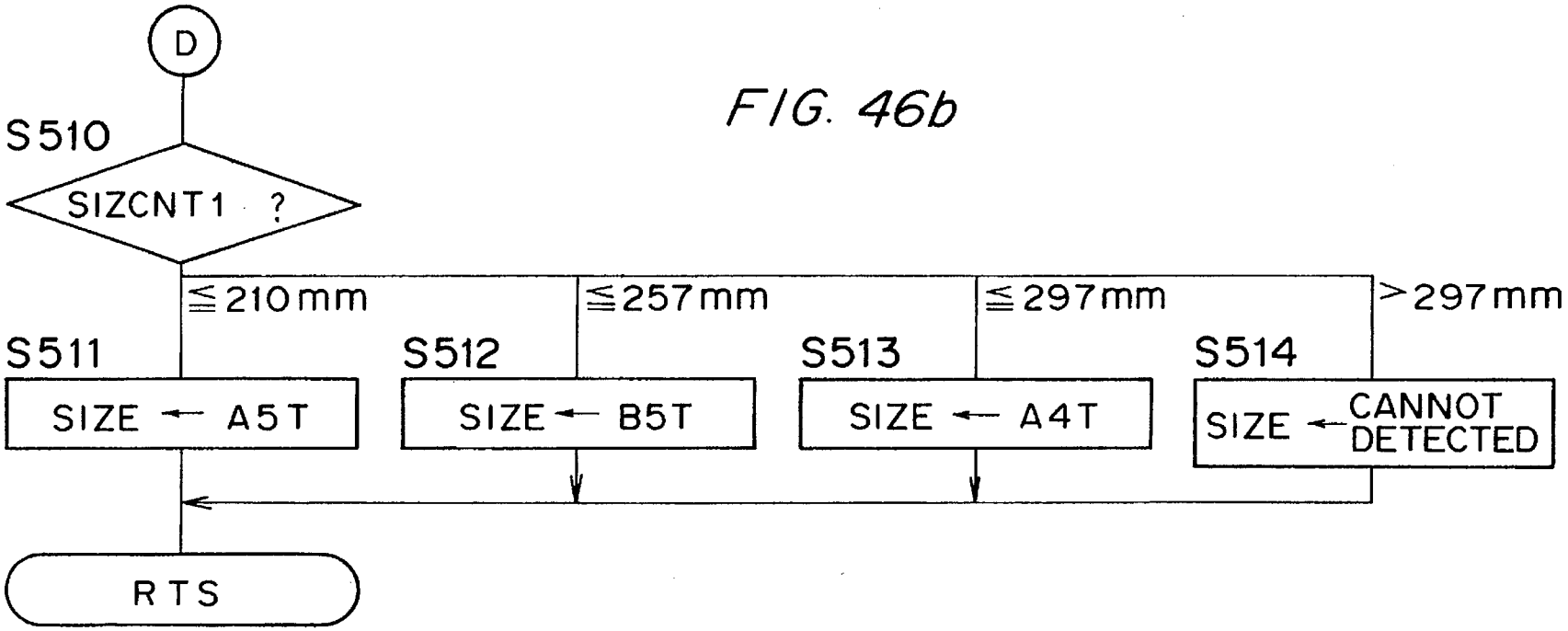
Figure 47A:
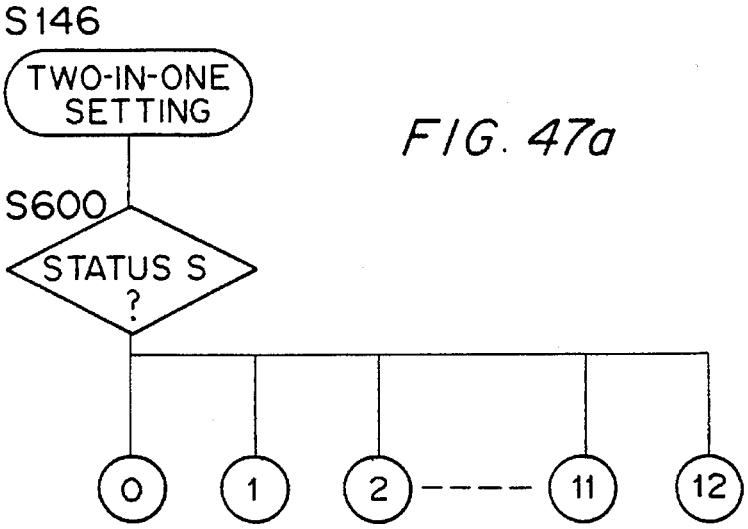
FIGS. 47*a* through 47*f* are flowcharts showing a subroutine for setting documents on the platen glass in two-in-one mode in the second embodiment.
Figure 47B:
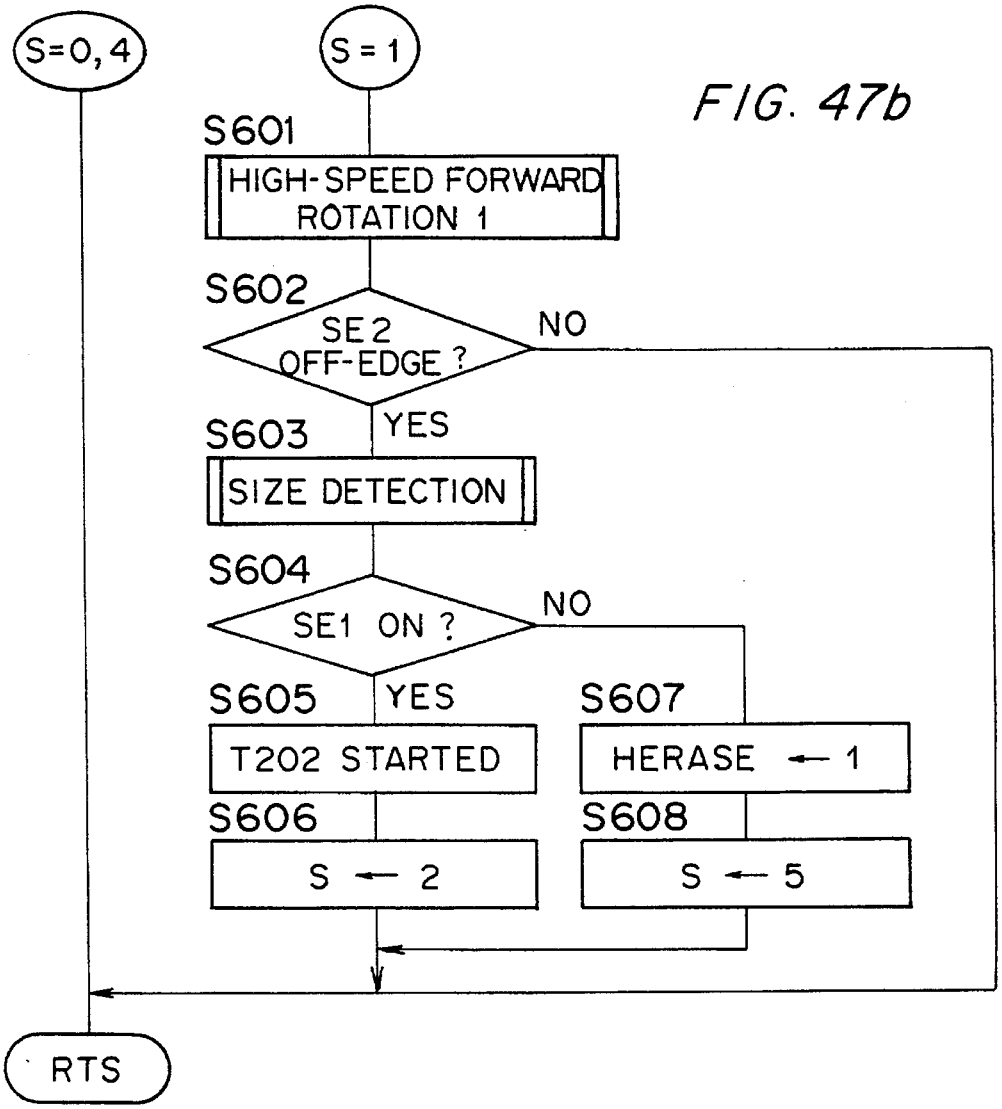
Figure 47C:
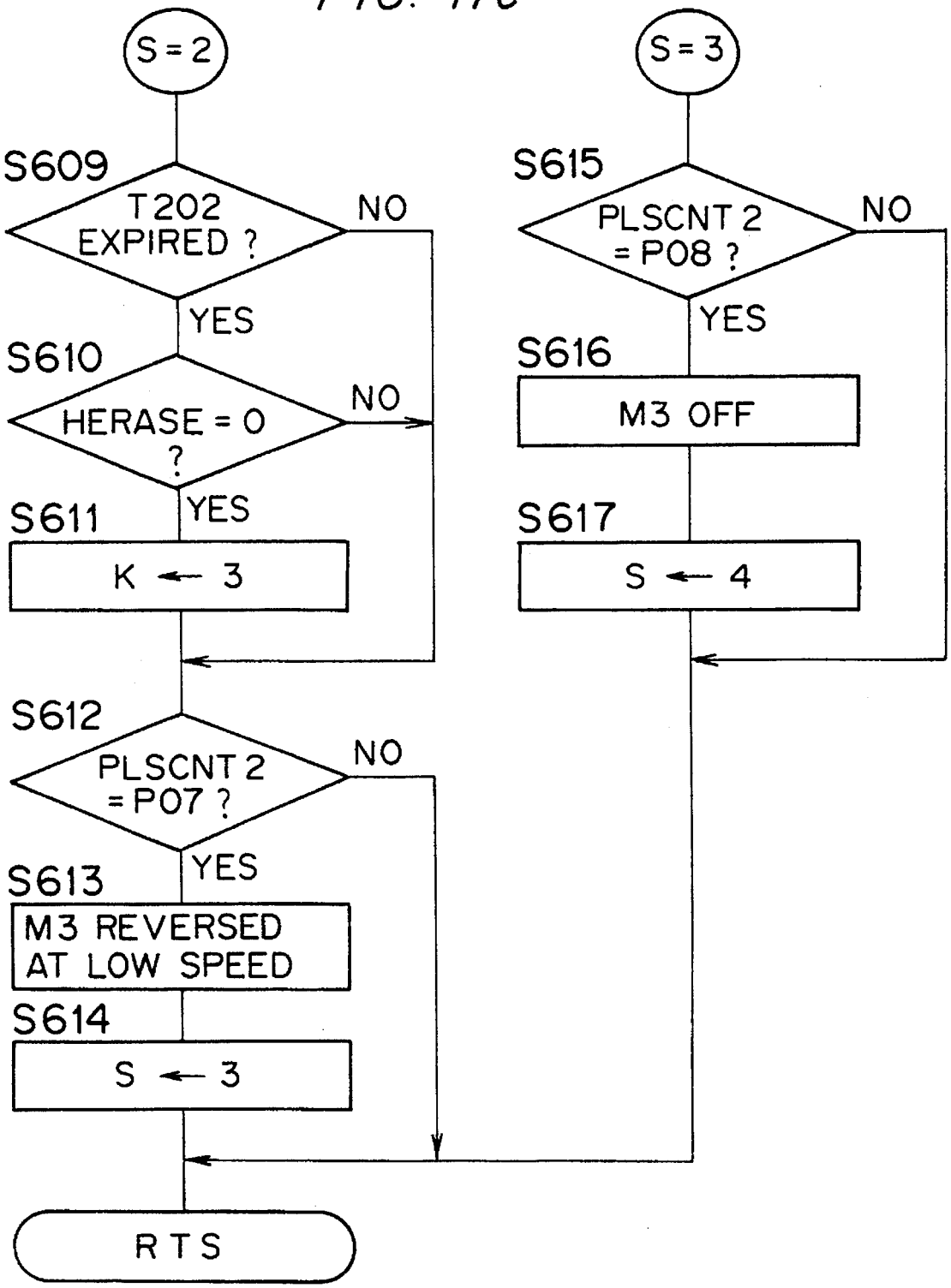
Figure 47D:
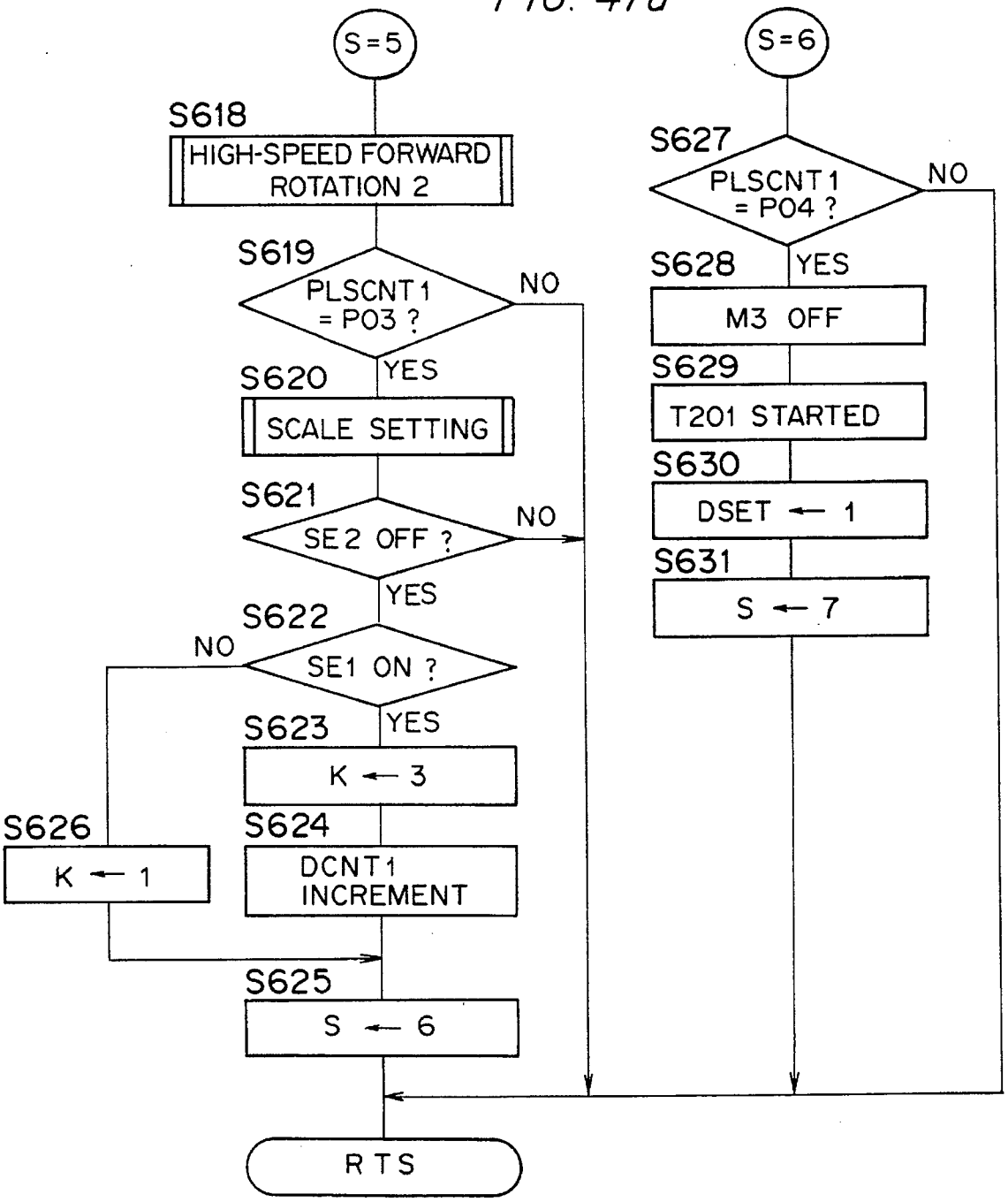
Figure 47E:
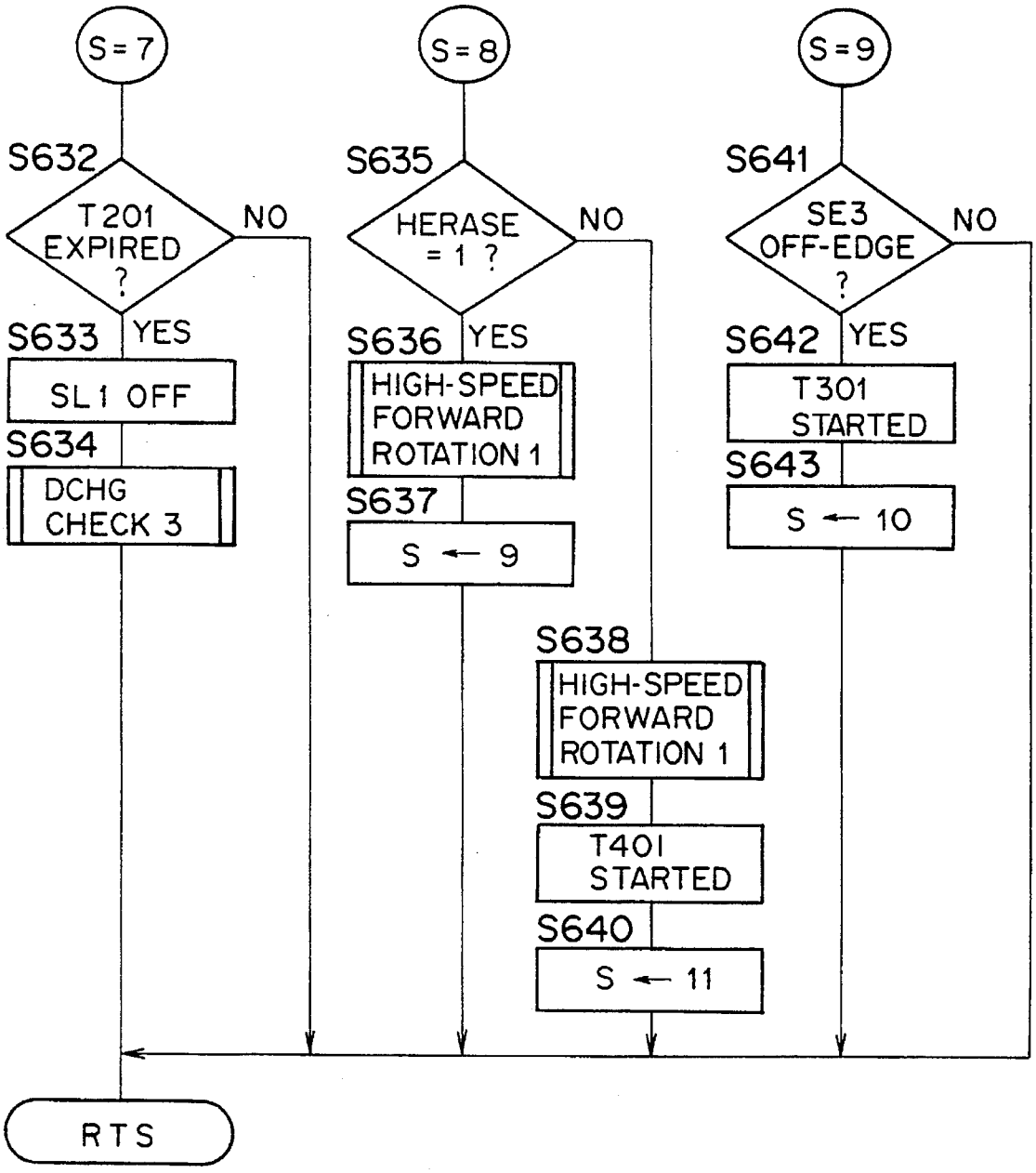
Figure 47F:
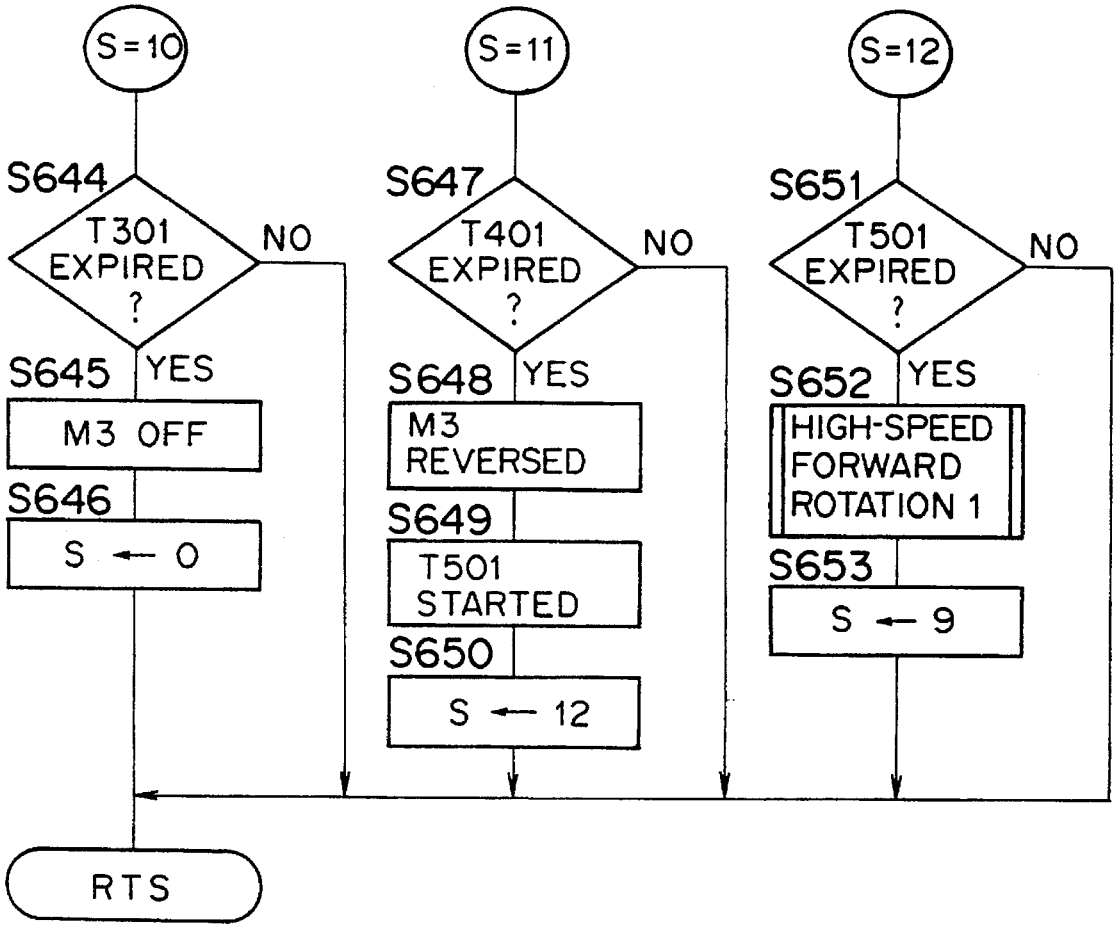

FIGS. 46*a* and 46*b* show a subroutine for detecting the size of a document carried out at steps S222, S323, S382 and S447.

At step S500, the value of the counter PLSCNT1 is stored in the size detection counter SIZCNT1. The counter PLSCNT1 counts pulses for forward rotation of the main motor M3, and its value corresponds to the length of the document. The width flag is checked at step S501. The width flag is in accordance with the on/off state of the width sensor SE10. The width sensor SE10 is turned on when it detects a width larger than that of a B5 laterally-fed document (see steps S198, S199 and S200). The size of a document is judged from the value of the counter SIZCNT1 and the value of the width flag. In FIGS. 46*a* and 46*b*, alphabets "Y" and "T" means "laterally-fed" and "vertically-fed" respectively.

More specifically, if the width flag is "1", the value of the counter SIZCNT1 is checked at step S502. If the value corresponds to 182 mm, B5 laterally-fed is stored in a memory SIZE at step S503. Likewise, in accordance with the value of the counter SIZCNT1, a certain document size is stored in the memory SIZE at step S504, S505 or S506. If the value of the counter SIZECNT1 corresponds to a length larger than 420 mm, "cannot detected" is stored in the memory SIZE at step S507. Then, the width flag is reset to "0" at step S508.

On the other hand, if the width flag is "0", the value of the counter SIZCNT1 is checked at step S510, and in accordance with the value, a certain document size is stored in the memory SIZE at step S511, S512 or S513. If the value of the counter SIZCNT1 corresponds to a length larger than 297 mm, "cannot detected" is stored in the memory SIZE at step S514.

Further, in the two-in-one mode, double the size detected by the counter SIZCNT1 is stored in the memory SIZE.

Now, the second embodiment in which the main motor M3 is also used as an ejection motor is described.

FIGS. 47*a* through 47*f* show a subroutine for setting documents in the two-in-one mode. This subroutine is a substitute of the two-in-one setting subroutine shown in FIGS. 41*a* through 41*h* and 42 and the document ejection subroutine shown in FIGS. 43*a*, 43*b* and 43*c*. Further, a case that a document of the large size is present in the stack of documents to be fed is not considered here.

In this subroutine, the processing proceeds in accordance with the value of the set status S checked at step S600.

While the status S is "0", nothing is handled in this subroutine.

If the status S is "1", which means that pre-feeding of a document is completed (see step S207), the main motor M3 is turned on for high-speed forward rotation (see FIG. 40) at step S601. Thereby, the document is fed from the register roller pair 90 onto the platen glass 29. The register sensor SE2 is checked at step S602. On off-edge of the register sensor SE2, that is, when the trailing edge of the document has passed the sensor SE2, the size of the document is detected at step S603. Then, the empty sensor SE1 is checked at step S604. If the register sensor SE2 is off-edge and the empty sensor SE1 is on, which means that the fed document is of the small size and there is a document on the tray 61, the timer T202 is started at step S605. Then, the status S is set to "2" at step S606.

On the other hand, if the empty sensor SE1 is off, which means that no documents are on the tray 61, the flag HERASE is set to "1" at step S607. Subsequently, the status S is set to "5" at step S608.

If the status S is "2", the timer T202 is checked at step S609. On the expiration of the timer T202, the flag HERASE is checked at step S610. If the flag HERASE is "0", the pre-feed status K is set to "3" at step S611 so as to start pre-feeding of the next document. If the timer T202 has not expired, or if the flag HERASE is "1" after the expiration of the timer T202, the processing goes to step S612, where it is judged whether the counter PLSCNT2 has counted the pulse P07. On the completion of the counting, the main motor M3 is switched to low-speed reverse rotation at step S613. Thereby, the document starts making a switchback. Then, the status S is set to "3" at step S614.

If the status S is "3", it is judged at step S615 whether the counter PLSCNT2 has counted the pulse P08. On the completion of the counting, the main motor M3 is turned off at step S616. Thereby, the switchback of the document is finished. Then, the status S is set to "4" at step S617.

While the status S is "4", nothing is handled in this subroutine.

If the status S is "5", which means that the pre-feeding of the next document is finished (see step S207), the main motor M3 is turned on for high-speed forward rotation (see FIG. 40) at step S618. Thereby, the former document which made a switchback and the latter document are conveyed toward the scanning position. Then, when it is judged at step S619 that the counter PLSCNT1 has counted the pulse P03, in the scale mode, the scale 120 is moved up to protrude over the platen glass 29 at step S620 (see FIG. 38).

Next, the register sensor SE2 is checked at step S621, and the empty sensor SE1 is checked at step S622. If the sensor SE2 is off and the sensor SE1 is on, which means that the latter document is of the small size and there is a document on the tray 61, the pre-feed status K is set to at step S623, and the counter DCNT1 gains an increment at step S624. Then, the status S is set to "6" at step S625. If the empty sensor SE1 is off, which means that no documents are on the tray 61, the pre-feed status K is set to "1" at step S626, and the processing goes to step S625.

If the status S is "6", it is judged at step S627 whether the counter PLSCNT1 has counted the pulse P04. If the result is "YES", which means that the leading edge of the former document reaches the scanning reference point SP, the main motor M3 is turned off at step S628. Subsequently, the timer T201 is started at step S629, and the flag DSET is set to "1" at step S630. Then, the status S is set to "7" at step S631.

If the status S is "7", the timer T201 is checked at step S632. On the expiration of the timer T201, the scale solenoid SL1 is turned off at step S633. Thereby, in the scale mode, the scale 120 is moved down to the retreating position, and in the pulse control mode, the scale 120 is kept in the retreating position. Further, the counter DCHG is checked at step S634. A subroutine for this processing will be described later referring to FIG. 48.

If the status S is "8", the flag HERASE is checked at step S635. If the flag HERASE is "1", the main motor M3 is turned on for high-speed forward rotation (see FIG. 40) at step S636 to start ejection of the document from the platen glass 29 (in this ease, only one document is on the platen glass 29). Then, the status S is set to "9" at step S637. On the other hand, if the flag HERASE is "0", the main motor M3 is turned on for high-speed forward rotation (see FIG. 40) at step S638 to start ejection of the two documents from the platen glass 29. The timer T401 is started at step S639, and the status S is set to "11" at step S640.

If the status S is "9", the ejection sensor SE3 is checked at step S641. On off-edge of the sensor SE3, that is, when the trailing edge of the document has passed the sensor SE3, the timer T301 is started at step S642. Then, the status S is set to "10" at step S643.

If the status S is "10", the timer T301 is checked at step S644. On the expiration of the timer T301, that is when the document has been ejected onto the tray 115, the main motor M3 is turned off at step S645. Then, the status S is reset to "0" at step S646.

If the status S is "11", the timer T401 is checked at step S647. On the expiration of the timer T401, the main motor M3 is switched to reverse rotation at step S648. With the reverse rotation of the motor M3, the conveyer belt 95 is reversed, and the latter document is moved backward on the platen glass 29. Meanwhile, the reversing roller 100 and the ejection roller 110 continue rotating forward, and the former document is ejected toward the tray 115. With this arrangement, a space is made between the former document and the latter document so that disorder of documents on the tray 115 will be prevented. Further, the timer T501 is started at step S649, and the status S is set to "12" at step S650.

If the status S is "12", the timer T501 is checked at step S651. On the expiration of the timer T501, the main motor M3 is turned on for high-speed forward rotation (see FIG. 40) at step S652. Then, the status S is set to "9" at step S653 for ejection of the latter document onto the tray 115.

Figure 48:
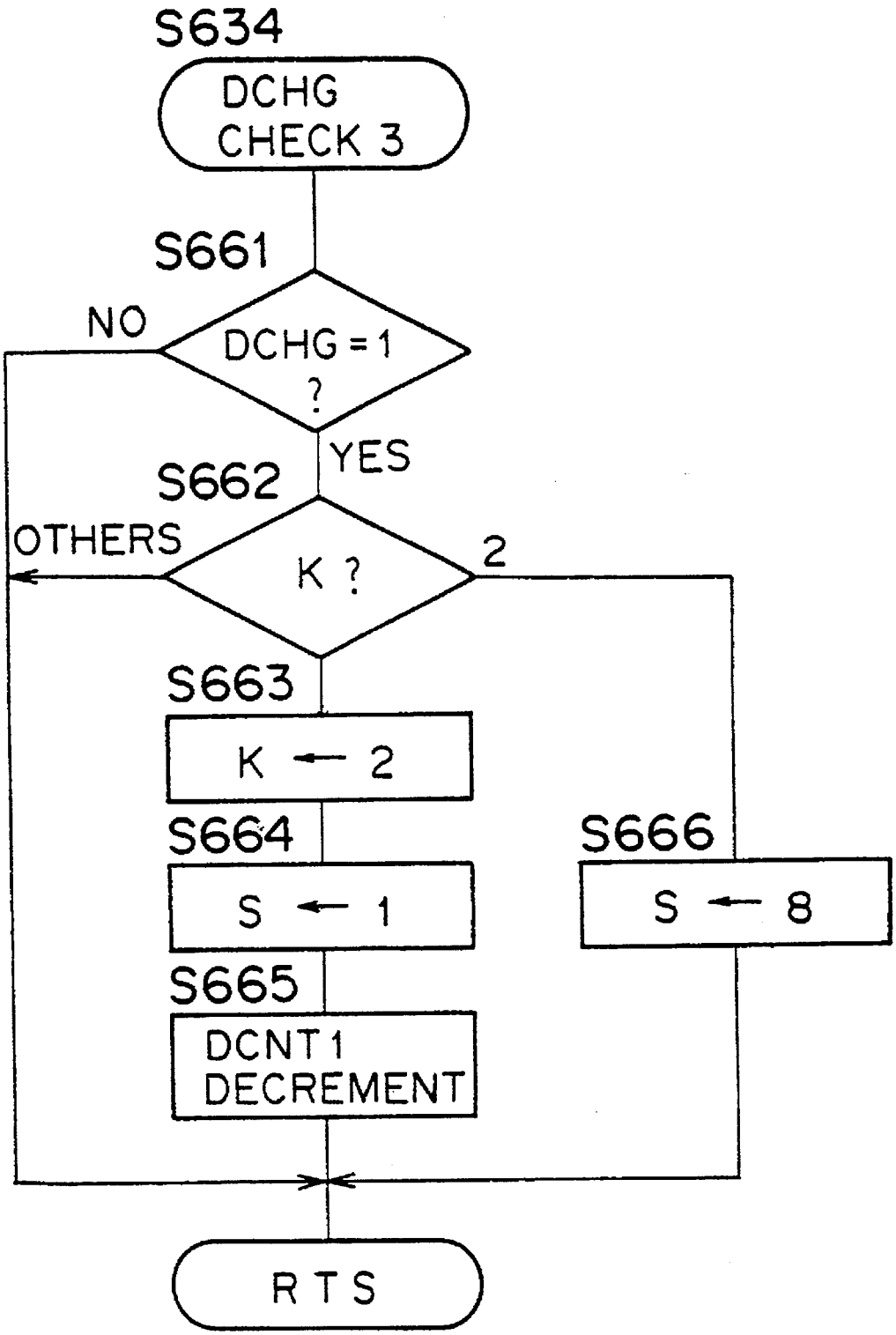
FIG. 48 is a flowchart showing a subroutine for checking the counter DCHG in the two-in-one mode in the second embodiment.

FIG. 48 shows a DCHG check subroutine 3 carried out at step S634.

First, the flag DCHG is checked at step S661, and only if the flag DCHG is "1", the following processing is carried out.

If the flag DCHG is "1", the pre-feed status K is checked at step S662. If the status K is "2" or "8", the processing in this subroutine proceeds.

If the status K is "8", which means that pre-feeding of the next document is completed, the status K is set to "2" at step S663, and the status S is set to "1" at step S664. Further, the counter DCNT1 has a decrement at step S665.

On the other hand, if the status K is "2", which means that no documents are on the tray 61, the status S is set to "8" at step S666.

Although the present invention has been described in connection with the preferred embodiments above, it is to be noted that various changes and modifications will be possible to those who are skilled in the art. Such changes and modifications are to be understood as being within the scope of the invention.

The present invention is applicable to a copy sheet feeder and a copy sheet refeeder for duplex copying and composite copying as well as an automatic document feeder. The automatic document feeder can be so made that documents stacked on the tray are fed one by one from the topmost document. A scanning reference point may be set near the entrance of the platen glass 29 so that a document is set on the platen glass with its trailing edge positioned at the reference point.

What is claimed is:

1. An automatic document feeder which is attachable to different types of copying machines which have different copying speeds, said automatic document feeder comprising;

control means for adjusting a document feeding speed of the document feeder to the copying speed of the copying machine which the automatic document feeder is attached to; and detecting means for detecting copying speed data of the copying machine.

2. An automatic document feeder as claimed in claim 1, wherein the control means receives a copying speed signal generated from control means of the copying machine and adjusts the document feeding speed in accordance with the copying speed signal.

3. An automatic document feeder as claimed in claim 1, wherein the control means has manual input means for setting the document feeding speed by selecting one of speeds corresponding to different copying speeds.

4. The automatic document feeder as claimed in claim 1, wherein the detecting means is in a connecting portion which connects the document feeder with the copying machine.

5. An automatic document feeder comprising:

feeding means for feeding a document out of a tray onto a platen glass, stopping the document in a scanning position on the platen glass and ejecting the document from the platen glass;

driving means for driving the feeding means;

control means for controlling the driving means to drive the feeding means at a standard speed in a condition which does not lower copying efficiency and to drive the feeding means at a speed higher than the standard speed in a condition which lowers copying efficiency;

wherein the condition which lowers copying efficiency is ejection of a last document from the platen glass; and wherein the condition which does not lower the copying efficiency is feeding documents other than the last document from the platen glass.

6. An automatic document feeder for feeding more than two documents comprising:

feeding means for feeding the documents one at a time out of a tray onto a platen glass, stopping the documents in a scanning position on the platen glass and ejecting the documents from the platen glass;

driving means for driving the feeding means;

control means for controlling the driving means to drive the feeding means at a standard speed in a condition which does not lower copying efficiency and to drive the feeding means at a speed higher than the standard speed in a condition which lowers copying efficiency;

wherein the condition which lowers copying efficiency is feeding of a first document to the scanning position on the platen glass;

wherein the condition which does not lower copying efficiency is feeding the first document from the platen glass.

7. An automatic document feeder comprising:

feeding means for feeding a document out of a tray onto a platen glass, stopping the document in a scanning position on the platen glass and ejecting the document from the platen glass;

driving means for driving the feeding means;

control means for controlling the driving means to drive the feeding means at a standard speed while feeding documents other than the last document from the platen glass and to drive the feeding means at a speed higher than the standard speed while ejecting a last document from the platen glass.

* * * * *